US006224423B1

(12) United States Patent
Yip et al.

(10) Patent No.: US 6,224,423 B1
(45) **Date of Patent: *May 1, 2001**

(54) ENHANCED PERFORMANCE TELECOMMUNICATIONS CONNECTOR

(75) Inventors: Maxwell Yip, Trumbull; Denny Lo, Danbury; Randy Below, Cheshire; John A. Siemon, Woodbury, all of CT (US)

(73) Assignee: The Siemon Company, Watertown, CT (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/047,046

(22) Filed: Mar. 24, 1998

Related U.S. Application Data

(63) Continuation-in-part of application No. 09/007,313, filed on Jan. 15, 1998.

(51) Int. Cl.[7] ..... H01R 13/648
(52) U.S. Cl. ..... 439/608; 439/610
(58) Field of Search ..... 439/607–610, 439/405–412, 946

(56) References Cited

U.S. PATENT DOCUMENTS

| | | | |
|---|---|---|---|
| 4,337,989 | 7/1982 | Asick et al. . | |
| 4,659,163 | 4/1987 | Althouse et al. . | |
| 4,682,836 | 7/1987 | Noorily et al. . | |
| 4,990,094 | 2/1991 | Chandler et al. . | |
| 5,376,021 | 12/1994 | Rodrigues et al. . | |
| 5,509,824 | 4/1996 | Rodrigues et al. . | |
| 5,518,421 * | 5/1996 | Davis | 439/607 |
| 5,564,949 | 10/1996 | Wellinsky . | |
| 5,593,311 * | 1/1997 | Lybrand | 439/295 |
| 5,605,469 | 2/1997 | Wellinsky et al. . | |
| 5,634,817 * | 6/1997 | Siemon et al. | 439/608 |
| 5,895,292 | 4/1999 | Affeltranger . | |

FOREIGN PATENT DOCUMENTS

| | | |
|---|---|---|
| 0 268 441 A2 | 5/1988 | (EP) . |
| 0 517 180 A1 | 12/1992 | (EP) . |
| 0 755 100 A2 | 1/1997 | (EP) . |
| WO87/07441 | 12/1987 | (WO) . |
| WO89/11169 | 11/1989 | (WO) . |
| WO92/08261 | 5/1992 | (WO) . |
| WO92/09119 | 5/1992 | (WO) . |
| WO 98/48488 | 10/1998 | (WO) . |

* cited by examiner

*Primary Examiner*—Lincoln Donovan
(74) *Attorney, Agent, or Firm*—Cantor Colburn LLP

(57) ABSTRACT

A connector made up of a plug and outlet which, when mated, define four shielded quadrants, each of which houses a pair of contacts. Shield members within the plug overlap and shield members within the outlet overlap. In addition, shield members within the outlet overlap adjacent shield members in the plug when mated. Overlapping the shield members at each shield member junction provides enhanced shielding and reduced crosstalk.

11 Claims, 58 Drawing Sheets

ENHANCED PERFORMANCE TELECOMMUNICATIONS CONNECTOR

CROSS-REFERENCE TO RELATED APPLICATIONS

This application is a continuation-in-part of U.S. patent application Ser. No. 09/007,313 filed Jan. 15, 1998.

BACKGROUND OF THE INVENTION

1. Field of the Invention

The invention relates generally to telecommunications connectors and in particular to a telecommunications plug and outlet having enhanced performance characteristics.

2. Prior Art

Improvements in telecommunications systems have resulted in the ability to transmit voice and/or data signals along transmission lines at increasingly higher frequencies. Several industry standards that specify multiple performance levels of twisted-pair cabling components have been established. The primary references, considered by many to be the international benchmarks for commercially based telecommunications components and installations, are standards ANSI/TIA/EIA-568-A (/568) Commercial Building Telecommunications Cabling Standard and 150/IEC 11801 (/11801), generic cabling for customer premises. For example, Category 3, 4 and 5 cable and connecting hardware are specified in both /568 and /11801, as well as other national and regional specifications. In these specifications, transmission requirements for Category 3 components are specified up to 16 MHZ. Transmission requirements for Category 4 components are specified up to 20 MHZ. Transmission requirements for Category 5 components are specified up to 100 MHZ. New standards are being developed continuously and currently it is expected that future standards will require transmission requirements of at least 600 MHZ. To achieve such transmission rates, fully shielded twisted pair cable will be necessary in which each pair is individually wrapped in a foil or screen. In addition, all pairs are wrapped together in a layer of foil or screen.

The above referenced transmission requirements also specify limits on near-end crosstalk (NEXT). Telecommunications connectors are organized in sets of pairs, typically made up of a tip and ring connector. As telecommunications connectors are reduced in size, adjacent pairs are placed closer to each other creating crosstalk between adjacent pairs. To comply with the near-end crosstalk requirements, a variety of techniques are used in the art.

U.S. Pat. No. 5,593,311 discloses a shielded compact data connector designed to reduce crosstalk between contacts of the connector. Pairs of contacts are placed within metallic channels. When the connectors are mated, the channels abut against each other to enclose each pair in a metallic shield. One disadvantage to the design in U.S. Pat. No. 5,593,311 is that the metallic channels are joined at a butt joint; one surface abuts against the adjacent surface with no overlap. Since all components include some manufacturing tolerance, there is a potential for gaps between the shields thereby reducing the shielding effect. Another disadvantage is that wires having the foil removed can be exposed to each other at the rear of the connector thus leading to crosstalk. Thus, there is a perceived need in the art for a connector having improved pair shielding.

SUMMARY OF THE INVENTION

The above-discussed and other drawbacks and deficiencies of the prior art are overcome or alleviated by the enhanced performance telecommunications connector of the present invention. In one embodiment, the connector is made up of a plug and outlet which, when mated, define four shielded quadrants, each of which houses a pair of contacts. In another embodiment, the connector is made up of a plug and outlet which, when mated, define two shielded quadrants, each of which houses a pair of contacts. In a further embodiment of the present invention, a printed circuit board (PCB) connector is provided wherein the connector is made up of a plug and outlet which, when mated, define four shielded quadrants, each of which houses a pair of contacts. In this embodiment, the connector is particularly suitable for mounting onto a circuit board. In yet another embodiment of the present invention, an improved plug top cover is provided having a metallic latch subassembly which allows for a more direct electrical path from a plug cable screen to an outlet cable screen. In all of the embodiments described herein which set forth the improved connector of the present invention, the shield members within the plug overlap and shield members within the outlet overlap. In addition, shield members within the outlet overlap adjacent shield members on the plug when mated. Overlapping the shield members at each shield member juncture provides enhanced shielding and reduced crosstalk.

The above-discussed and other features and advantages of the present invention will be appreciated and understood by those skilled in the art from the following detailed description and drawings.

BRIEF DESCRIPTION OF THE DRAWINGS

Referring now to the drawings wherein like elements are numbered alike in the several FIGURES.

DETAILED DESCRIPTION OF THE INVENTION

Figure 1:
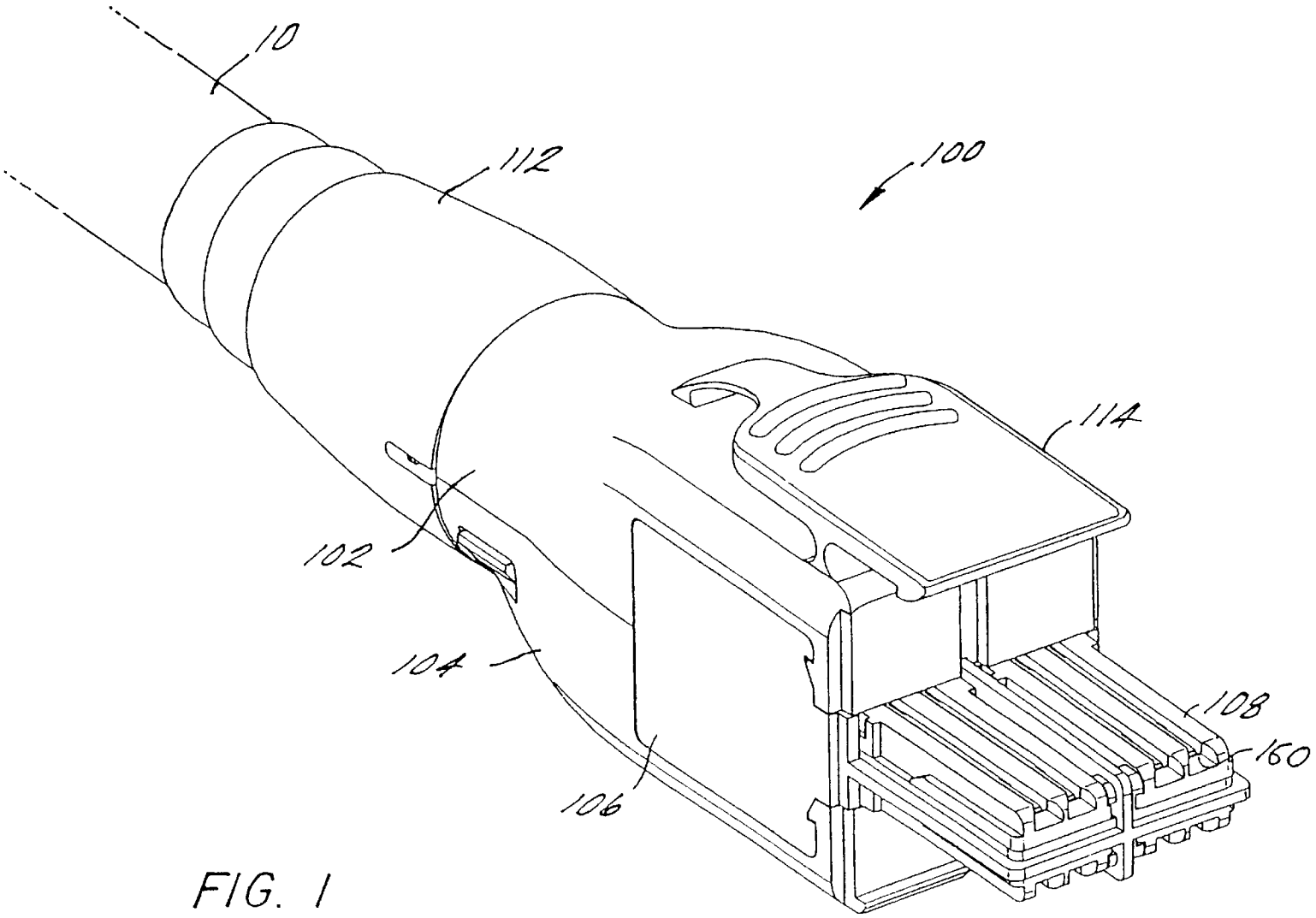
FIG. 1 is a perspective view of an assembled plug of one embodiment in accordance with the present invention.

FIG. 1 is a perspective view of an assembled plug, shown generally as 100, in accordance with the present invention. The plug 100 includes a top cover 102, a bottom cover 104 and a core 106. The top cover 102, bottom cover 104 and core 106 are all conductive to provide shielding as described herein. These conductive components may be made from metal, metallized plastic or any other known conductive material. Core 106 supports insulative (e.g. plastic) contact carriers 108. Each contact carrier 108 includes two contacts 160 defining a pair. A boot 112 provides strain relief and is made from a pliable plastic or rubber. Also shown in FIG. 1 is cable 10 entering boot 112. A latch 114 is provided on the top cover 102 for coupling the plug 100 to outlet 300 as described herein.

Figure 2:
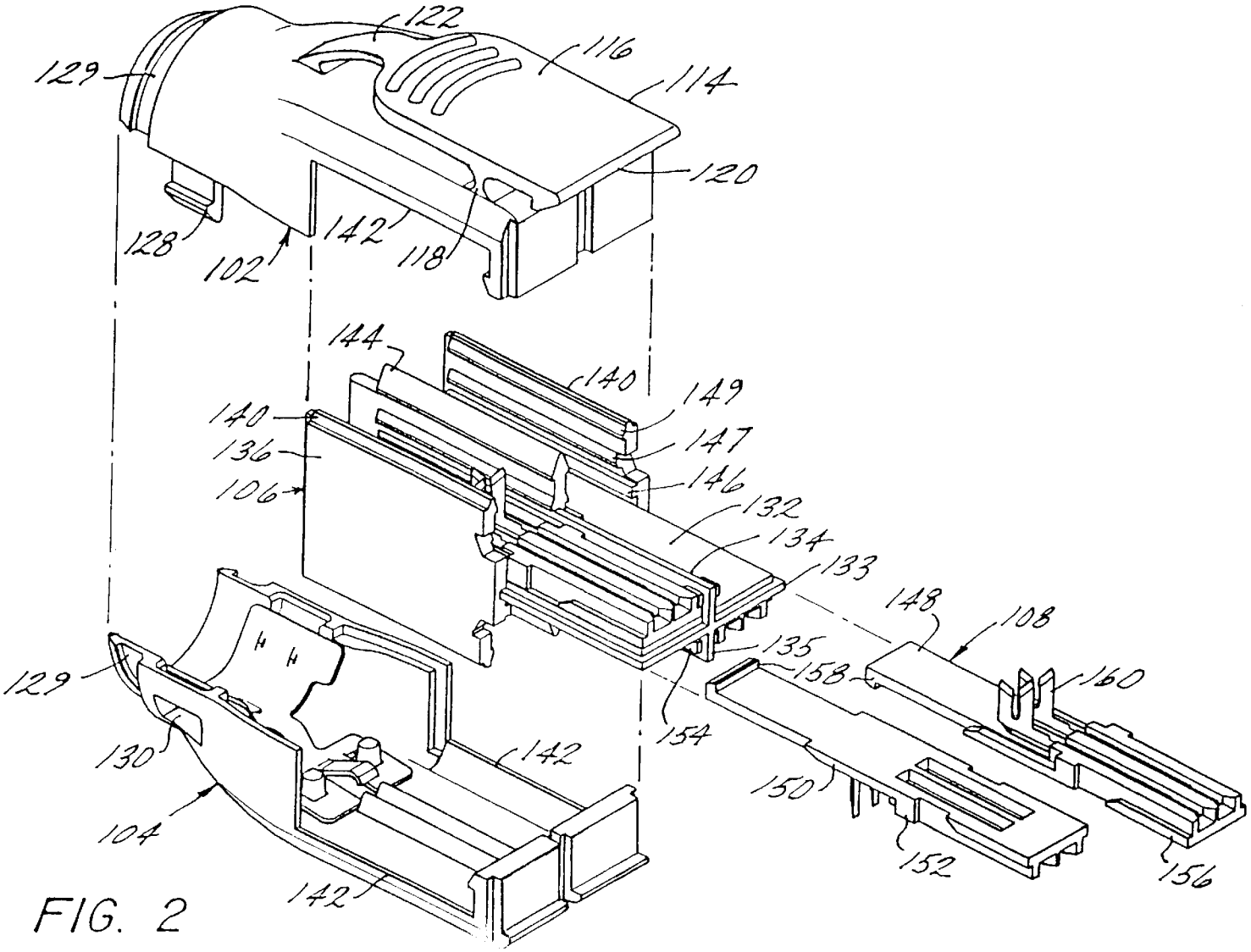
FIG. 2 is an exploded, perspective view of the plug of FIG. 1.

FIG. 2 is an exploded, perspective view of the plug 100. Latch 114 is made up of a latch body 116 secured to the top cover at fulcrum 118. A lip 120 is provided on the bottom of the latch body 116 for engaging a groove formed in outlet 300. This secures the plug 100 to the outlet 300. An important feature of latch 114 is a latch extension 122 that couples the latch body 116 to the top cover 102. The latch extension 122 is a pliable, arcuate member that flexes when pressure is applied to latch body 116. Telecommunications plugs are often pulled through wall spaces during installation. The latch extension 122 reduces the likelihood that the plug 100 will be caught on other cables, wall comers, studs, etc. Top cover 102 includes a semi-circular groove 129 and bottom cover 104 includes a similar semicircular groove 129 that receive a circular lip 113 (FIG. 7) in boot 112 as described below. Two top cover latches 128 engage two bottom cover recesses 130 to secure top cover 102 to bottom cover 104.

Plug core 106 includes a first planar shield 132 and a second planar shield 134 substantially perpendicular to the first planar shield 132. Plug core 106 also includes side walls 136. The top and bottom of each side wall 136 include a ridge 140. Ridges 140 extend beyond side wall 136 and overlap an edge 142 of the top cover 102 and bottom cover 104. Ridges 140 are shown as having a generally triangular cross section, but it is understood that different geometries may be used without departing from the scope of the invention. Ridges 140 serve to locate the core 106 within the top and bottom covers and overlap the edges of the top cover and bottom cover to provide better shielding than a butt joint. The second planar shield 134 also includes a ridge 144 on the top and bottom surfaces. As shown in FIG. 2 central ridge 144 is triangular, however, it is understood that other geometries may be used without departing from the invention. Central ridge 144 engages channels 178 formed in top cover 102 and bottom cover 104 as described below with reference to FIGS. 3 and 4.

Two ribs 146 are formed on the inside surface of each side wall 136 and are parallel to and spaced apart from first planar shield 132. Similar ribs are formed on each surface of the second planar shield 134. Contact carrier 108 has a planar base 148 which rests on the first planar shield 132. Base 148 includes two flanges 150 extending away from the base and a stop 152 adjacent to the flanges 150. When the contact carrier is installed in the core 106, flange 150 is placed under rib 146 to hold the contact carrier 108 to the first planar shield 132. The contact carrier is slid into core 106 until stop 152 contacts the end of rib 146. In this position, a second flange 156 is positioned beneath a nub 154 formed on the second planar shield 134. The contact carrier 108 also includes a lip 158 that extends substantially perpendicular to the planar base 148 and beyond the edge of first planar shield 132 to prevent the contact carrier 108 from sliding out of the core 106. Additional detail of the contact carrier 108 and contacts 160 are described below with reference to FIG. 5. The inside of each side wall 136 and each side of second planar shield 134 also include a first ledge 149 and a second ledge 147 which are used to secure a termination cap to the plug core 106 as described below with reference to FIGS. 6–10.

Figure 3:
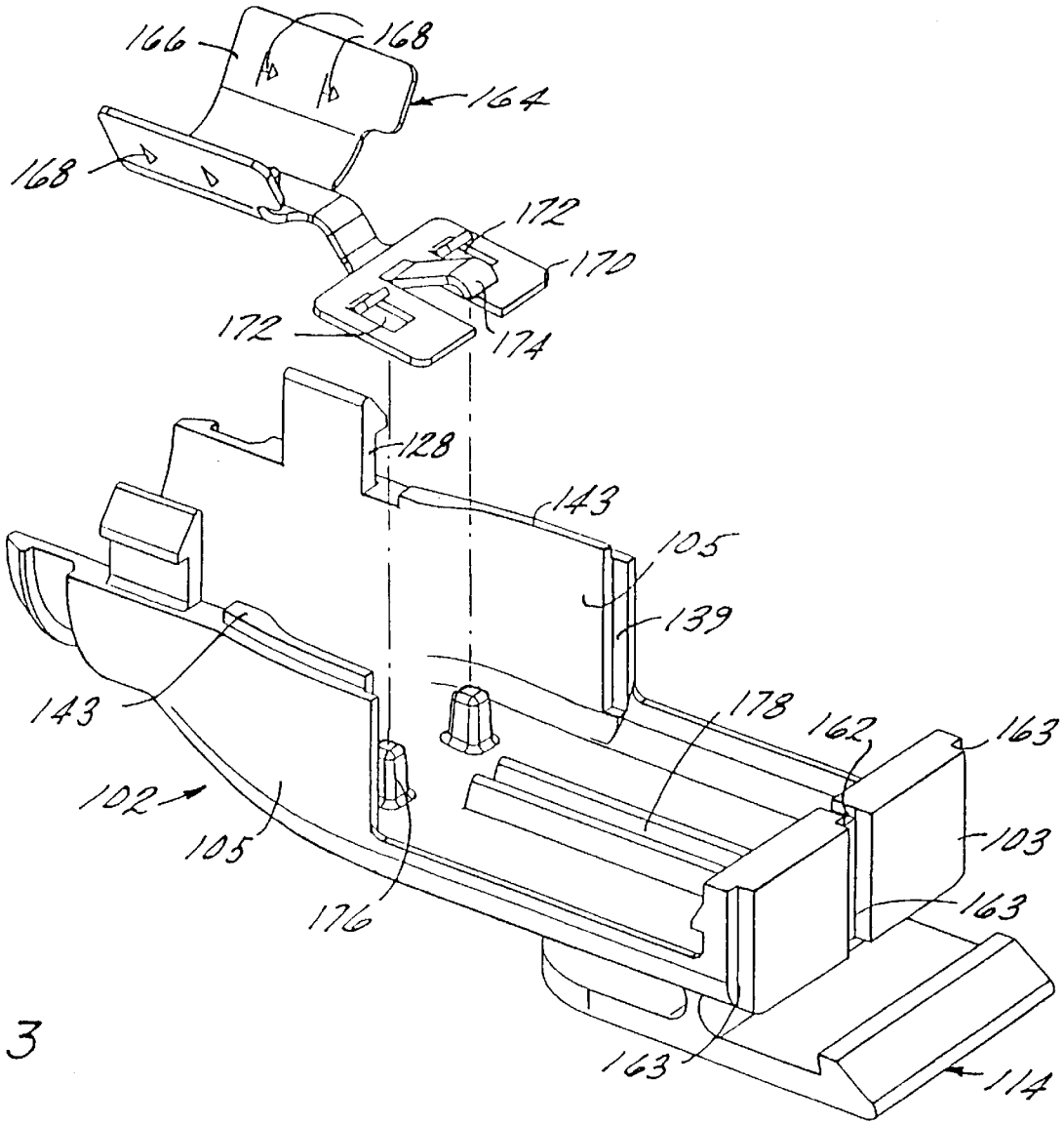
FIG. 3 is an exploded, perspective view of the plug top cover of FIG. 1.

FIG. 3 is an exploded, perspective view of the top cover 102. The top cover includes a shield contact 164 which electrically connects the ground layer of cable 10 to the plug core 106. Shield contact 164 is conductive and is preferably made from metal. Shield contact 164 has an arcuate portion 166 formed to generally follow the shape of cable 10. Arcuate portion 166 includes barbs 168 that pierce the ground layer of cable 10 and the cable jacket. This electrically and mechanically connects the shield contact 164 to cable 10. Shield contact 164 includes a pad 170 having two openings 172 formed therein for receiving two posts 176 formed in top cover 102. The friction fit between posts 176 and openings 172 secures the shield contact 164 to top cover 102. A tab 174 extends away from pad 170 and contacts the plug core 106. A channel 178 is formed in the top cover 102 for receiving central ridge 144 on plug core 106. This allows the central ridge 144 to be overlapped by the side walls of the channel 178 and provides better shielding than a conventional butt joint. A notch 162 is provided in the front face 103 of top cover 102 to receive the second planar shield 134. The front face 103 of plug 102 also includes three recessed areas 163 that receive extensions on the front face 317 of outlet 300 as described below. Top cover 102 includes side wall recesses 139 for receiving rear extensions 137 on plug core 106 (FIG. 6) to create an overlap between the rear of plug core side wall 328 and the plug top cover. Top cover 102 also includes side walls 105 having a top side wall extensions 143 that engage outlet side wall recesses 343 (FIG. 4) to create overlap between the side walls 105 of the top plug cover 102 and the side walls 107 bottom plug cover 104.

Figure 4:
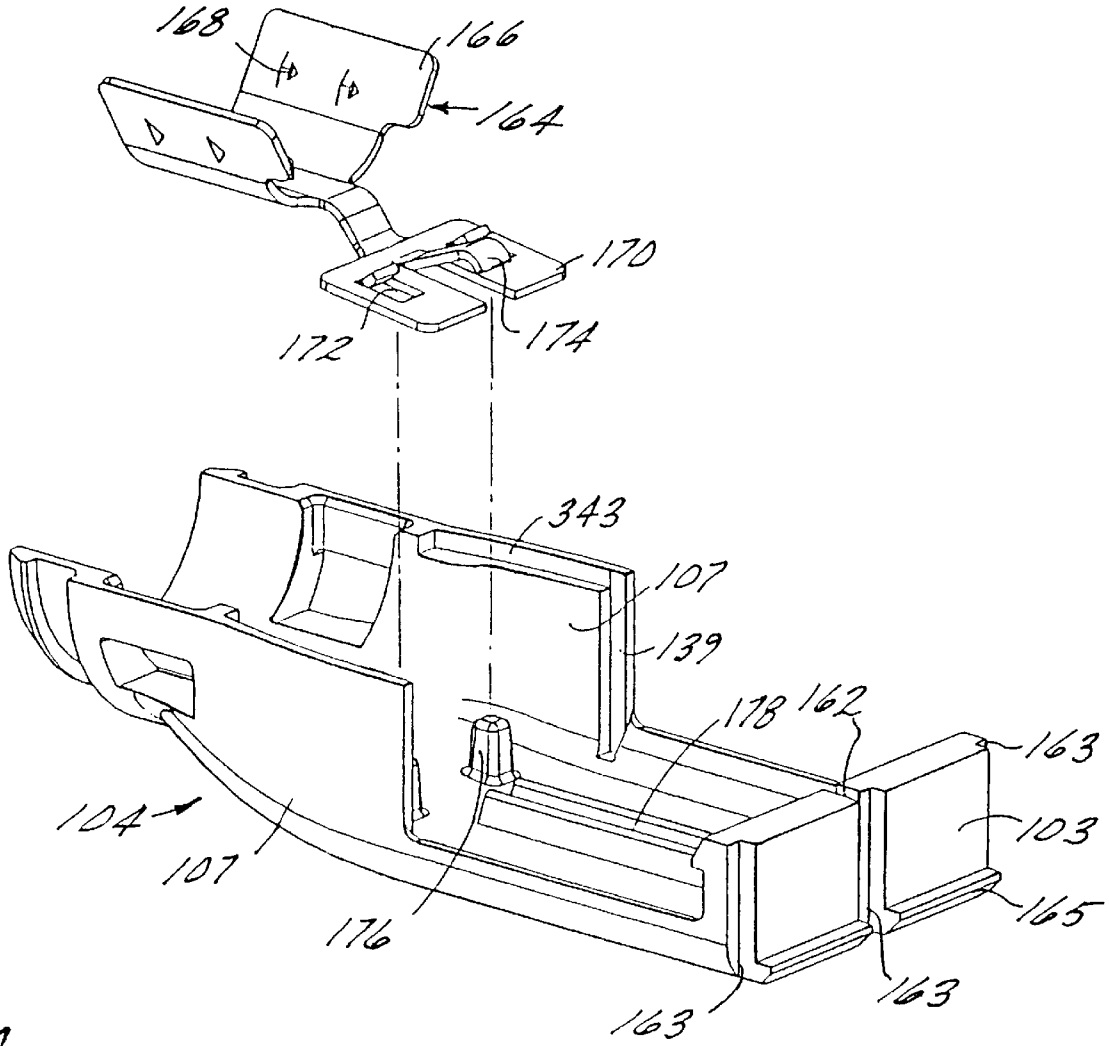
FIG. 4 is an exploded, perspective view of the plug bottom cover of FIG. 1.

FIG. 4 is an exploded, perspective view of the bottom cover 104. Bottom cover 104 is similar to top cover 102 in that both use shield contact 164 in the same manner. Bottom cover 104 also includes channel 178 for receiving central ridge 144 on second planar shield 134. As noted above, this allows the central ridge 144 to be overlapped by the sides of the channel 178 and provides better shielding than a conventional butt joint. Notch 162 is provided in the front face 103 of bottom cover 104 to receive second planar shield 134. Bottom cover 104 includes side walls 107 having side wall recess 139, similar to those on top cover 102, for receiving rear extensions 137 on side wall 136. In addition, bottom cover 104 includes second side wall recesses 343 for receiving side wall extensions 143 on top cover 102. The front face 103 of bottom cover 104 is similar to that of top cover 102 and includes recesses 163 for receiving extensions on the front face 317 of the outlet 300. The front face 103 of bottom cover 104 also includes a lip 165, interrupted by recess 163, that overlaps the outside surface of the bottom wall 332 of outlet core 306.

Figure 5:
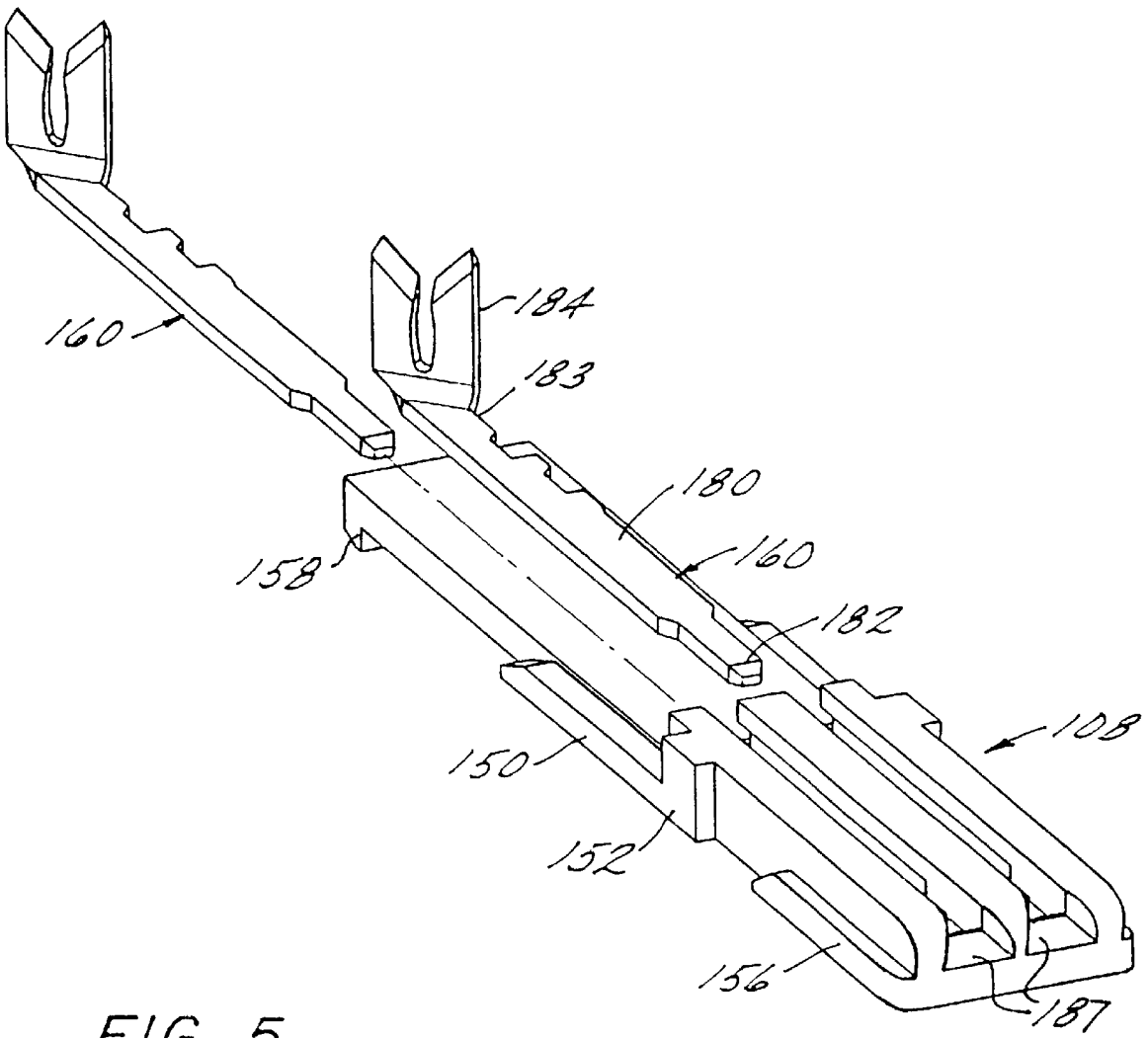
FIG. 5 is an exploded, perspective view of the plug contact carrier of FIG. 1.

FIG. 5 is an exploded perspective view of a contact carrier 108. The contact carrier includes two channels 186, each of which receives a contact 160. Each contact 160 has a generally planar body 180, a contact end 182 and a termination end 183. The termination end includes an insulation displacement contact 184 that pierces the insulation of individual wires in cable 10 to make an electrical contact with the wire as is known in the art. Installation of the wires in the insulation displacement contact 184 is described herein with reference to FIGS. 8–10. Each insulation displacement contact is angled relative to the longitudinal axis of body 180 at an angle of 45 degrees. As shown in FIG. 1, the plug 100 includes four contact carriers 108, each having a pair of contacts 160 for a total of eight contacts.

Figure 6:
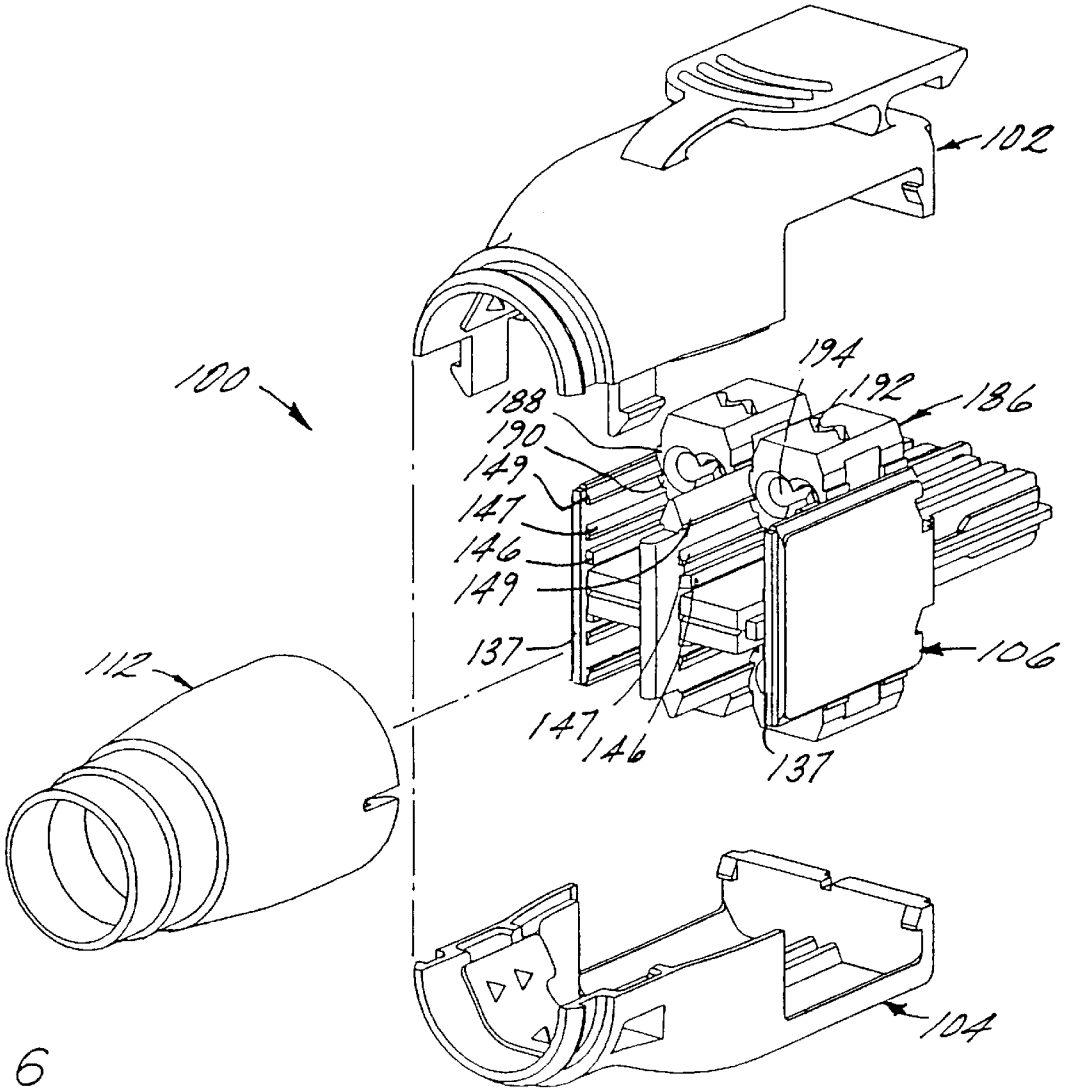
FIG. 6 is an exploded, perspective view of the plug of FIG. 1 including termination caps.

FIG. 6 is an exploded, perspective view of the plug 100 including termination caps 186. A termination cap 186 is provided for each pair of contacts 160. As is known in the art, a termination cap forces wires onto an insulation displacement contact to pierce the insulation and electrically connect the wire and the insulation displacement contact. Termination cap 186 includes a first lip 188 and a second lip 190 that straddle ledges 149 and 147 on the plug core 106. The first lip 188 and the second lip 190 have a beveled surface and first ledge 149 and second ledge 147 similarly include a beveled surface to facilitate installation of the termination cap 186 as disclosed below. Each termination cap 186 also includes two contact openings 192 for receiving the insulation displacement contacts 184 and a pair of wire openings 194 for receiving wires from cable 10. The wire openings 194 are aligned with the insulation displacement contacts 184 in plug core 106. The plug in FIG. 6 is shown in the state as received by the customer. Termination caps 186 are positioned in the plug core 106 and retained in a first positioned. First lip 188 rests upon first ledge 149 to hold the termination cap 186 in a first position and second lip 190 is positioned beneath first ledge 149 to prevent the termination cap 186 from being inadvertently removed from the plug core 106.

Figure 7:
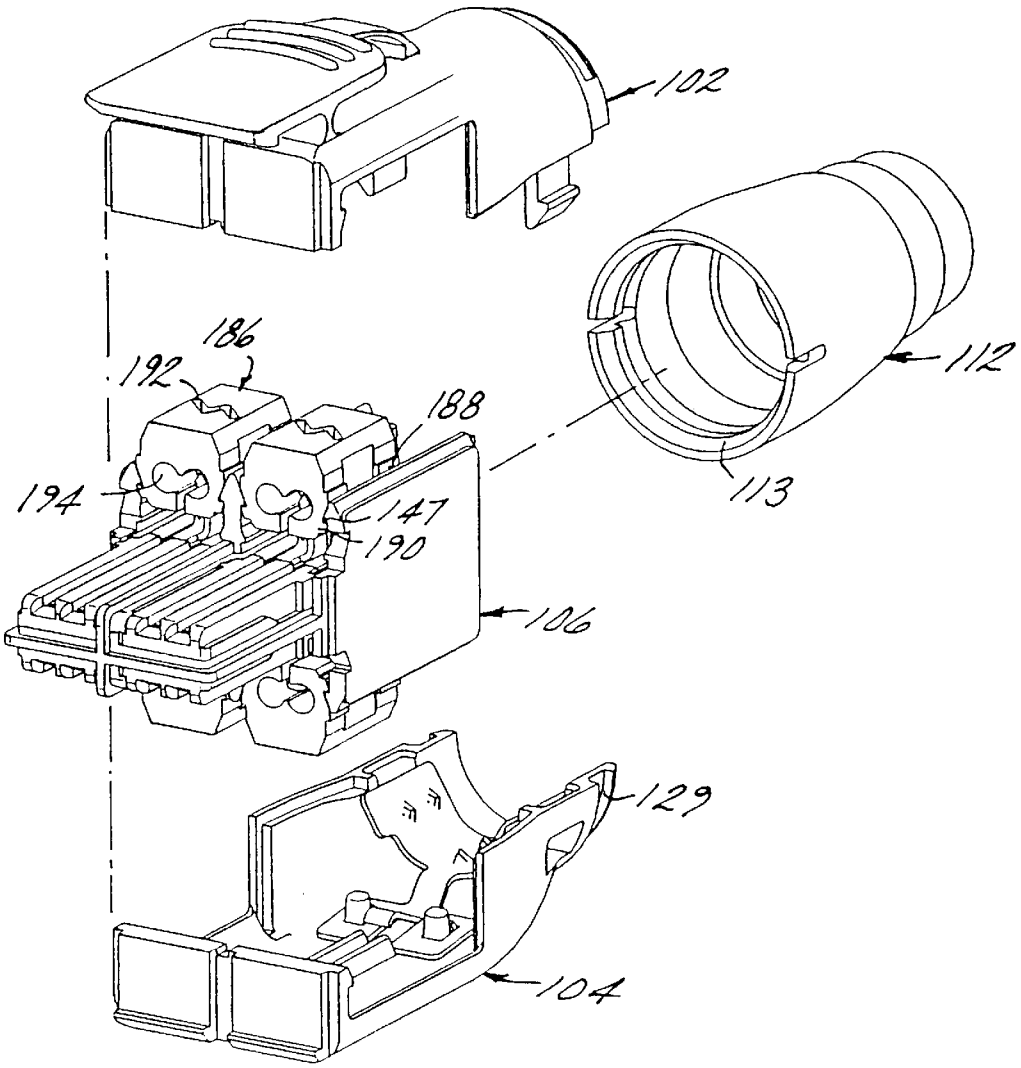
FIG. 7 is another exploded, perspective view of the plug of FIG. 1.

FIG. 7 is another exploded, perspective view of the plug 100. As shown in FIG. 7, each termination cap 186 is in the first position by virtue of first lip 188 and second lip 190 straddling first ledge 149. Boot 112 includes a cylindrical lip 113 that engages groove 129 formed in the top cover 102 and the bottom cover 104. Slots 115 may be formed through the boot 122 and perpendicular to lip 113 to allow the lip 113 to expand during installation of the boot 112 and reduce the force needed to install and remove boot 112.

Figure 8:
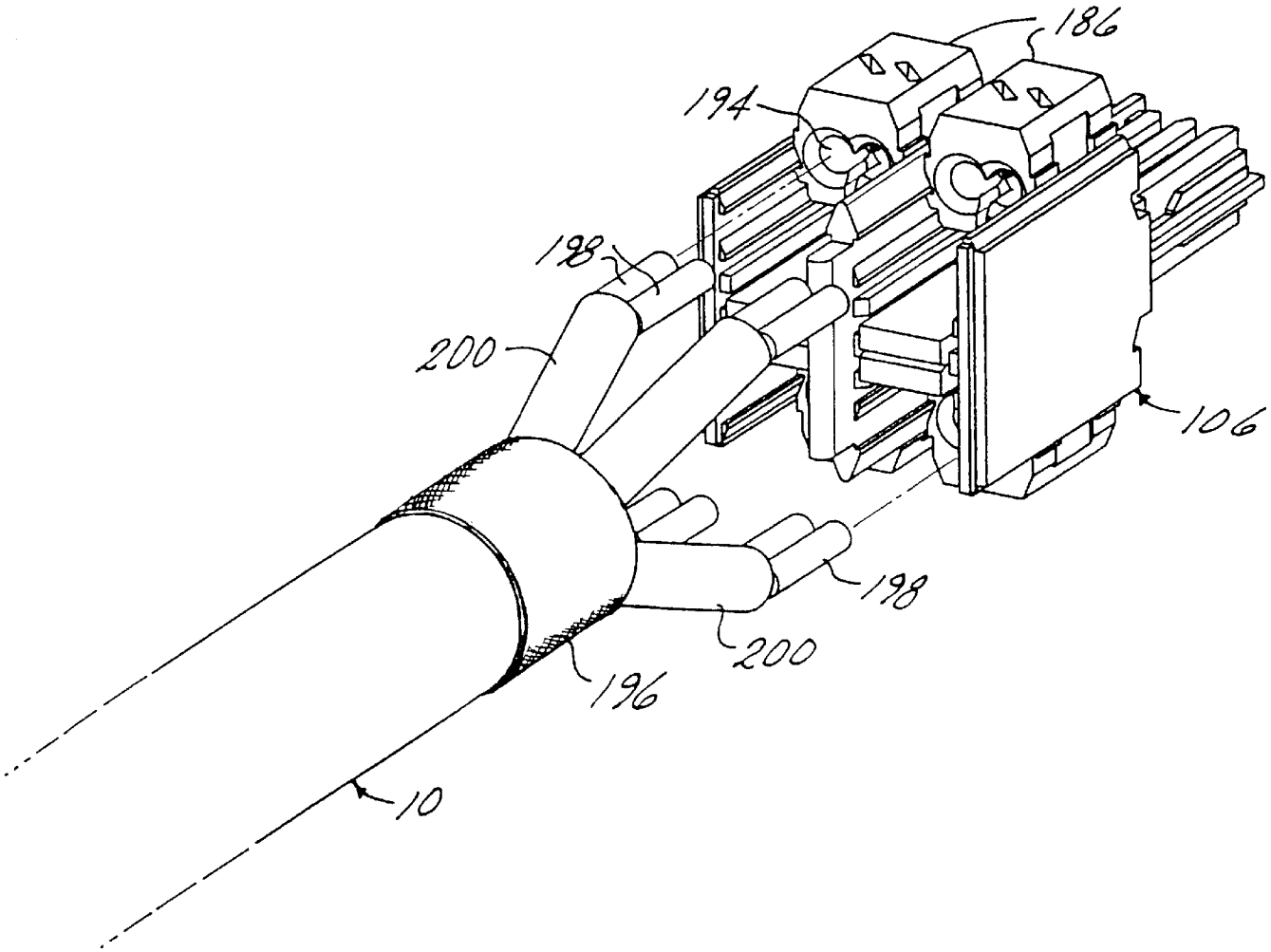
FIG. 8 is a perspective view of the assembly procedure for the plug of FIG. 1.
Figure 9:
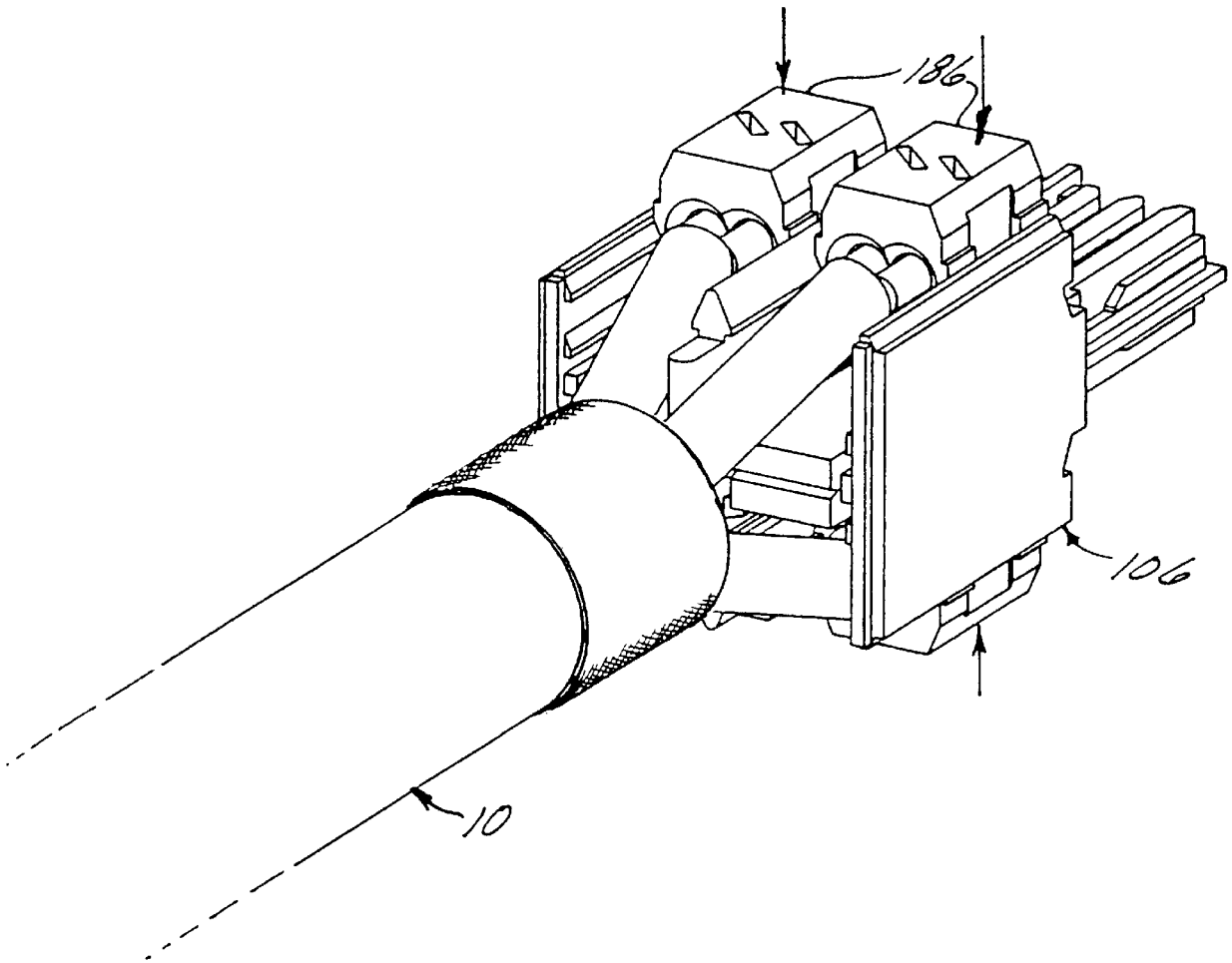
FIG. 9 is a perspective view of the assembly procedure for the plug of FIG. 1.

The installation of the wires into the plug 100 will now be described with reference to FIGS. 8–12. As shown in FIG. 8, cable 10 includes eight wires 198. Each pair of wires 198 is encased by a wire pair shield 200. Ground layer 196 is also housed within cable 10 and is pulled back over the outside jacket of cable 10. Wires 198 are inserted into wire openings 194 in termination caps 186. As described above, each wire opening 194 is aligned with an insulation displacement contact 184 and thus each wire 198 is positioned above an insulation displacement contact 184. It is understood that boot 112 is placed over cable 10 prior to inserting wires 198 into termination caps 186. FIG. 9 shows the wires 198 positioned in the wire openings 194. Once the wires 198 are positioned in the termination caps 186, force is applied to each termination cap 186 towards the plug core 106 in the direction shown by the arrows in FIG. 9. A single hand tool can be used to apply force to all four termination caps 186 at the same time to provide for easy installation.

Figure 10:
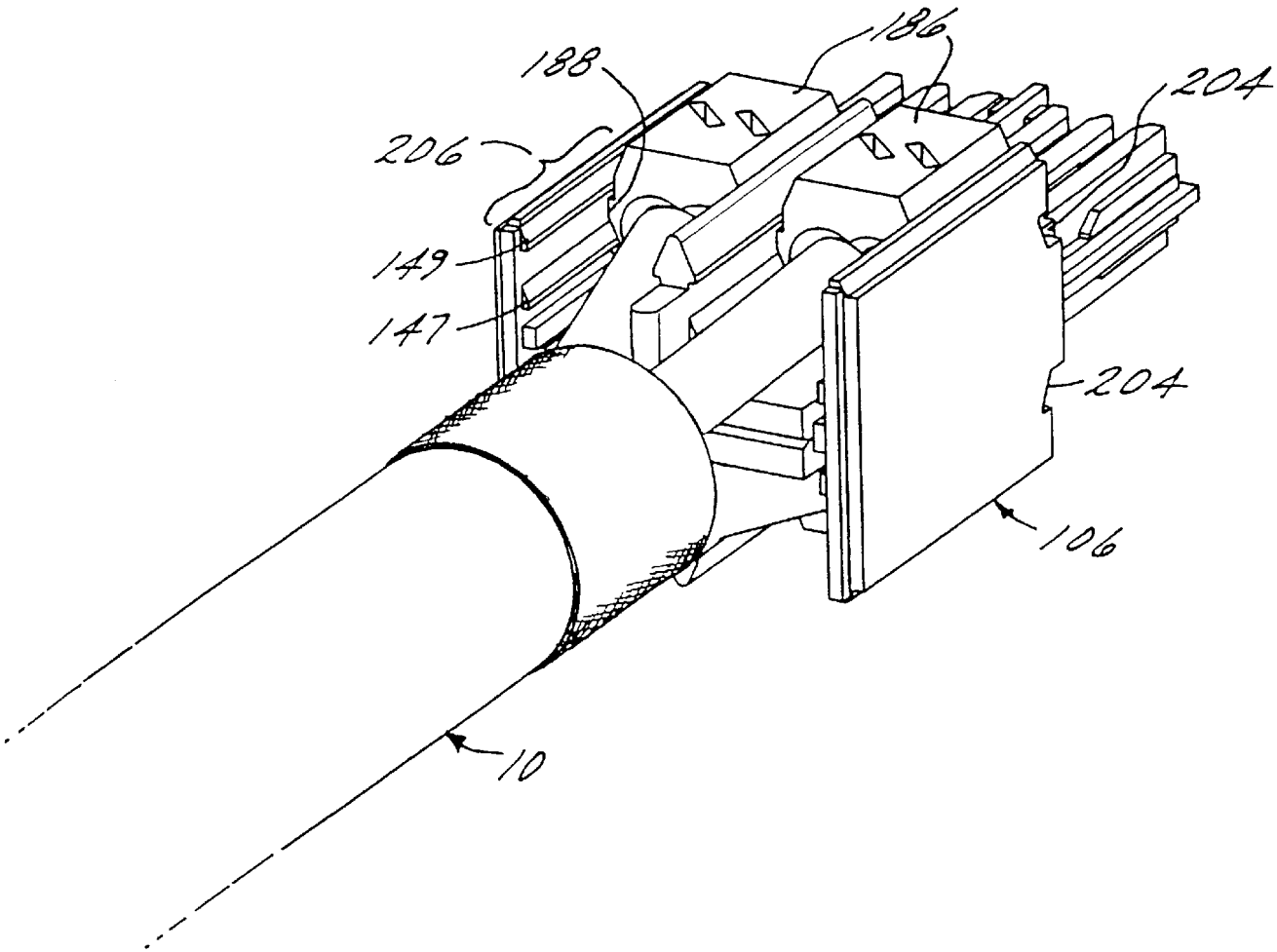
FIG. 10 is a perspective view of the assembly procedure for the plug of FIG. 1.

FIG. 10 shows the termination caps 186 in a second position. First lip 188 and second lip 190 now straddle second ledge 147 to hold the termination cap 186 in the second position. In this state, the wires 198 positioned in wire openings 194 are driven onto insulation displacement contacts 184. As is known in the art, the insulation displacement contacts 184 split the insulation on each wire 198 thereby making electrical contact between the wires 198 and the contacts 160. An important aspect of the invention shown in FIG. 10 is the use of a buffer zone 206. The length of the first planar shield 132 and second planar shield 134 is such that a portion of the first planar shield 132 and the second planar shield extend beyond the rear of each termination cap 186 to establish a buffer zone 206. Each wire pair rests in the buffer zone 206. The buffer zone 206 is important because during installation, the wire pair shield 200 is removed so that individual wires can be inserted in wire openings 194. Even assuming that the installer removed the exact recommended length of wire pair shield 200, a small amount of exposed wire will create cross talk between adjacent pairs at frequencies of greater than 600 MHZ. In non-ideal installations, the installer will remove too much of the wire pair shield 200. Thus, the buffer zone 206 reduces cross talk in ideal or non-ideal installations and enhances the connector performance. The buffer zone should have a length, measured from the rear of the termination cap 186, greater than the length of exposed wire 198 (wire pair shield removed) in a worst case installation.

Figure 11:
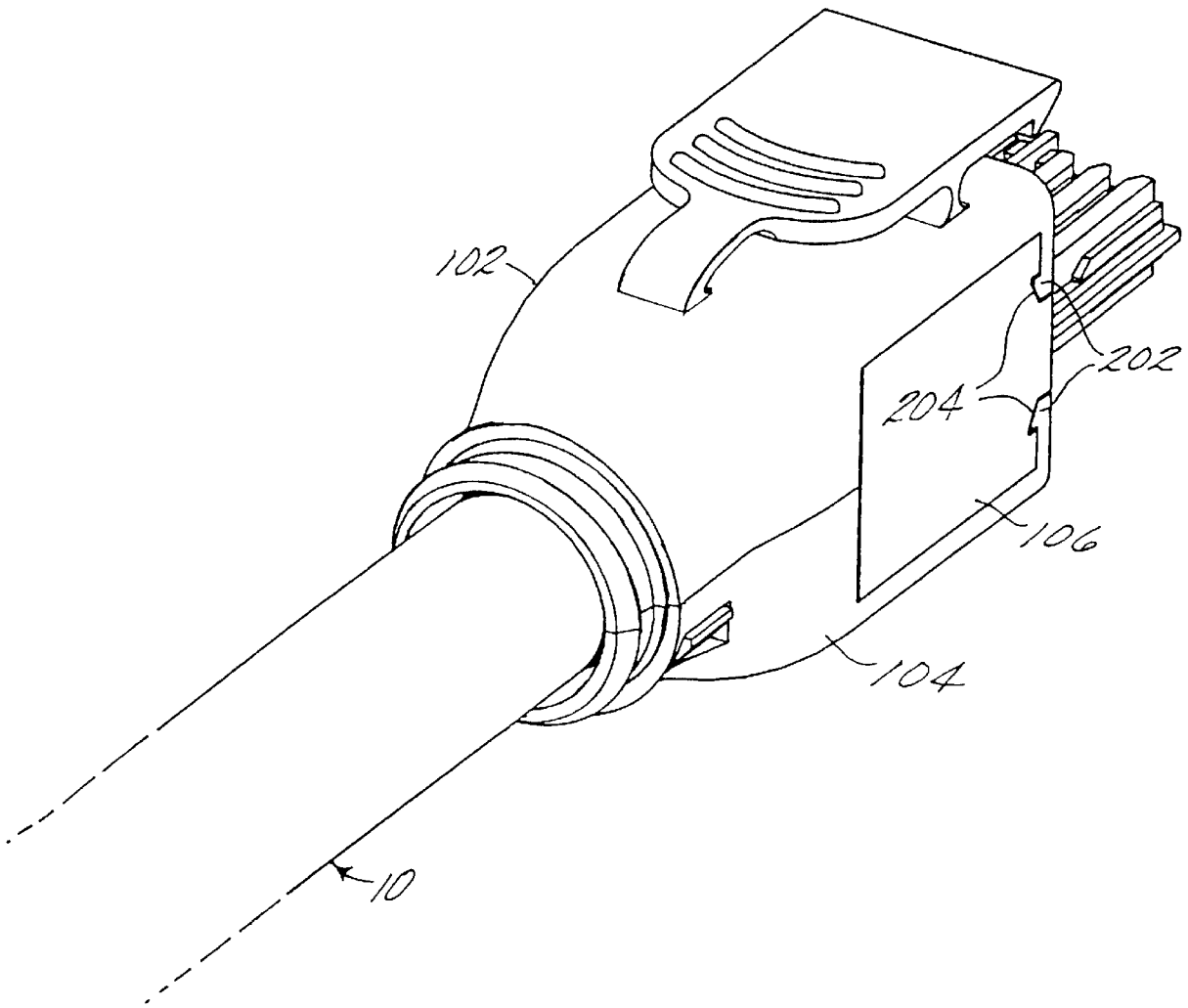
FIG. 11 is a perspective view of the assembly procedure for the plug of FIG. 1.
Figure 12:
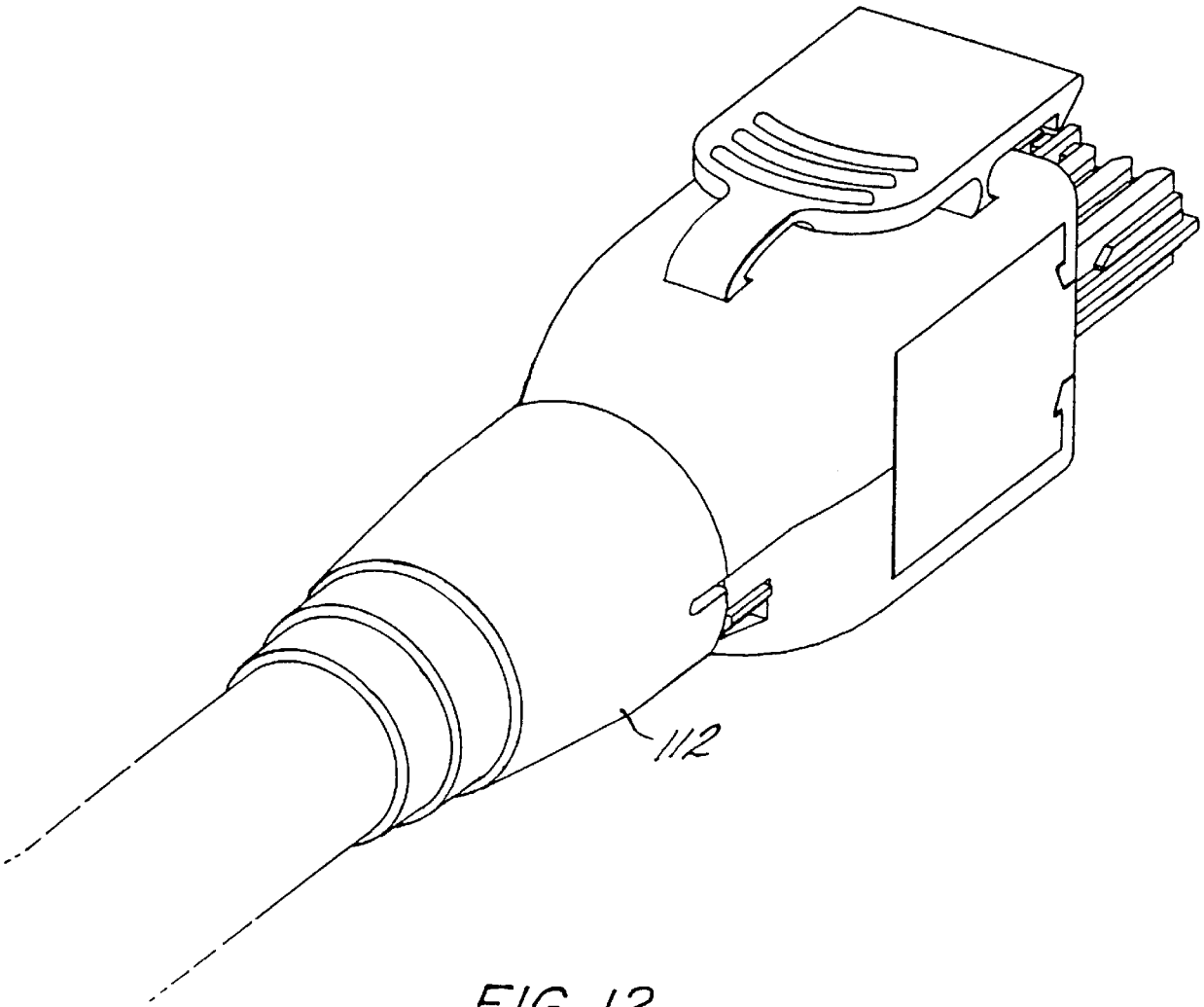
FIG. 12 is a perspective view of the assembly procedure for the plug of FIG. 1.

The next step in the installation process is the placement of top cover 102 and bottom cover 104 on plug core 106 as shown in FIG. 11. Top cover 102 and bottom cover 104 each include projections 202 that engage similarly shaped recesses 204 on plug core 106 to secure the top cover 102 and bottom cover 104 to plug core 106. In addition, top cover latches 128 engage bottom cover openings 130 to secure the top cover 102 to the bottom cover 104. Barbs 168 on shield contacts 164 penetrate the ground layer 196 and the cable jacket to mechanically and electrically connect the shield connectors 164 to cable 10. The final step in the plug assembly is securing the boot 112 to the plug. As shown in FIG. 12, the boot 112 is snapped onto the top and bottom covers. Lip 113 on the inside surface of boot 112 engages the groove 129 formed in top cover 102 and bottom cover 104.

Figure 12A:
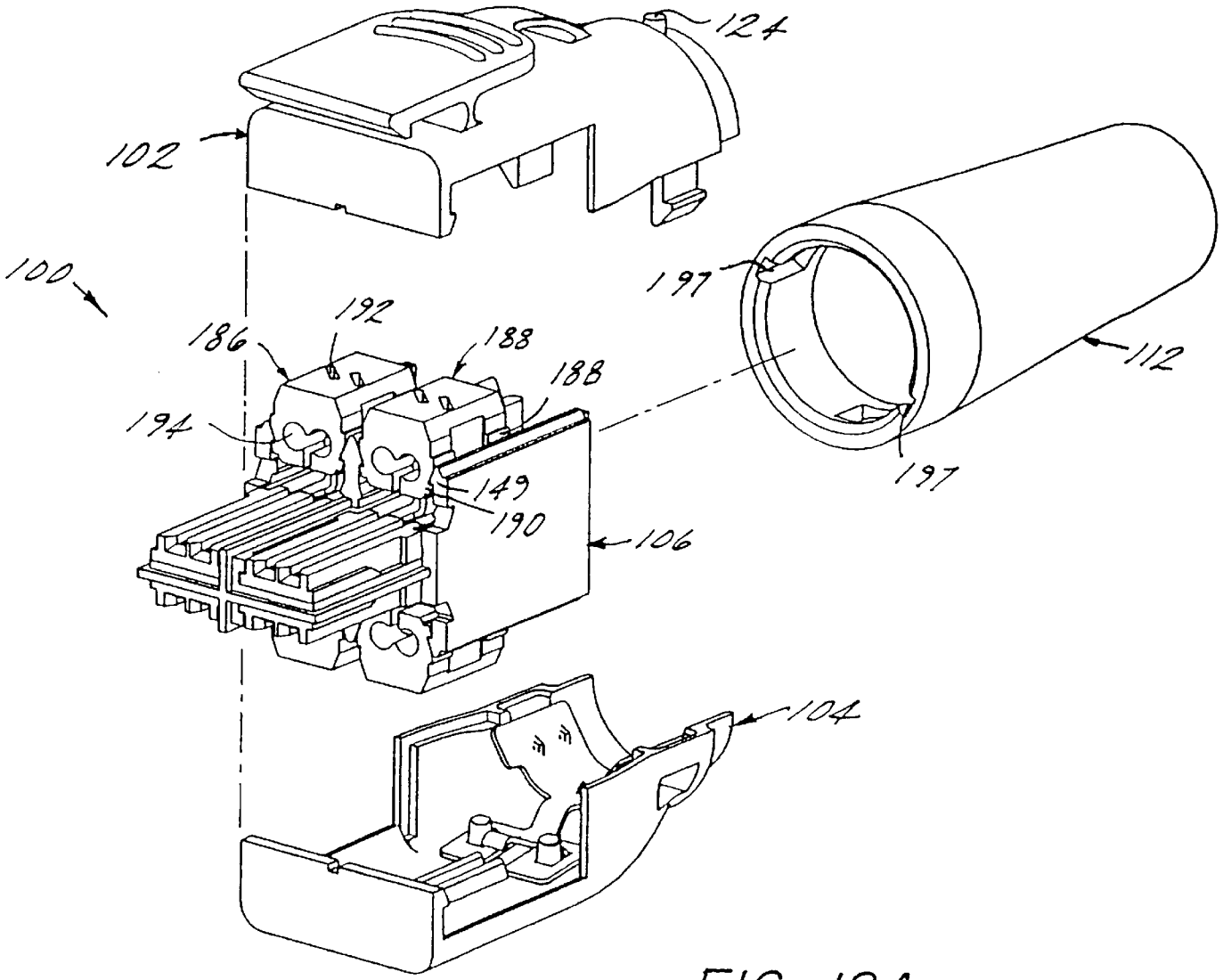
FIG. 12A is a perspective view of an alternative embodiment of the plug of FIG. 1.
Figure 12B:
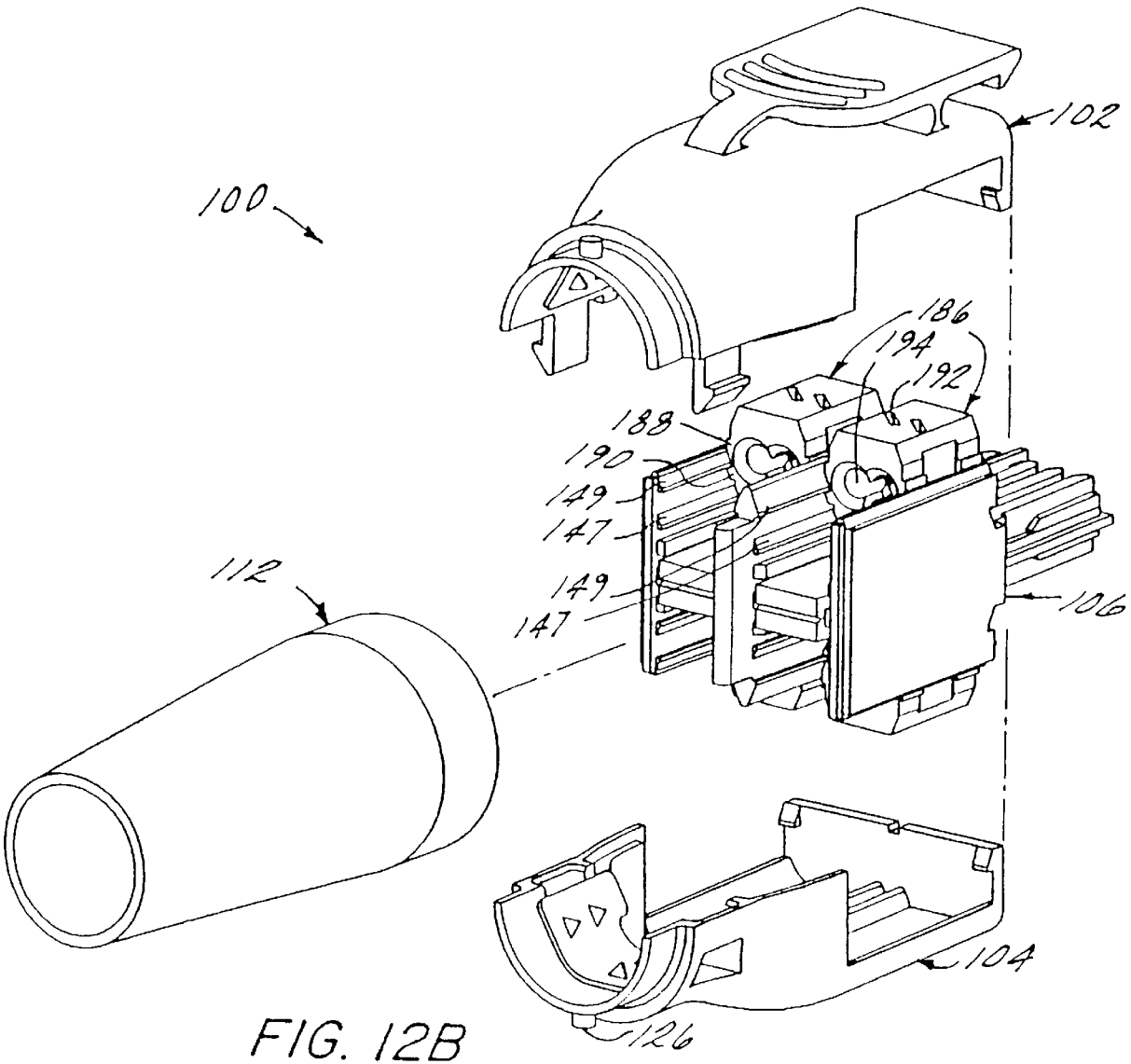
FIG. 12B is a perspective view of the alternative embodiment of the plug of FIG. 1.

FIG. 12A is a perspective view of the plug in an alternative embodiment. As can be seen in FIG. 12A, boot 112 includes two L-shaped channels 197 which receive post 124 formed on the top cover 102 and post 126 formed on the bottom cover 104 (FIG. 12B). Boot 112 is secured to the top cover 102 and bottom cover 104 by placing posts 124 and 126 in channels 197 and rotating the boot 112.

Figure 13:
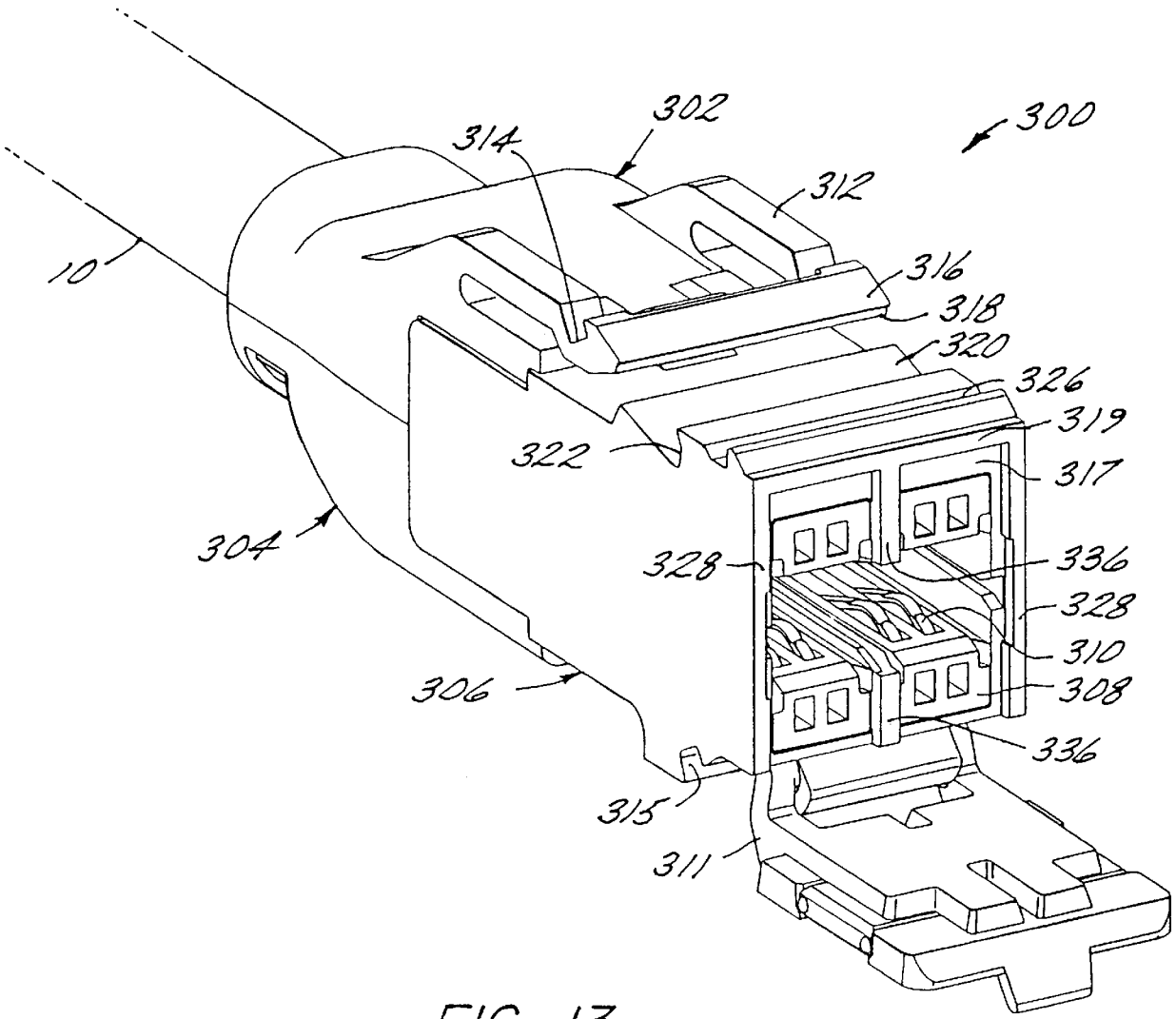
FIG. 13 is a perspective view of one embodiment of the outlet.

FIG. 13 is a perspective view of an outlet 300 for use with plug 100. The outlet 300 includes a top cover 302, a bottom cover 304 and a core 306. The top cover 302, bottom cover 304 and core 306 are all conductive to provide shielding as described herein. These conductive components may be made from metal, metallized plastic or any other known conductive material. Core 306 supports insulative contact carriers 308. Each contact carrier includes contacts 310. An optional door 311 is also provided to prevent contamination (e.g. dust) from entering outlet 300.

Top cover 302 includes a pair of resilient arms 312 having notches 314 formed therein. Notches 314 receive the edge of a faceplate as will be described below with reference to FIG. 23. Another notch 315 is formed on the bottom of outlet core 306 for receiving another edge of the faceplate. Notches 314 and 315 lie in a plane that is at an oblique angle relative to the front face 317 of outlet 300. When mounted in a faceplate, this directs the outlet towards the ground and provides for a gravity feed design. The gravity feed reduces the bend angle of the cable connected to plug 100 and reduces the likelihood that the cable will be bent beyond the minimum bend radius and cause signal degradation or loss. Alternatively, notches 314 and 315 may lie in a plane parallel to the front face 317 of outlet 300. A member 316 connects the ends of resilient arms 314 and includes a recess 318 on a front face thereof. Recess 318 receives one edge of an identification icon 324 (shown in FIG. 14). The identification icon 324 rests on support surface 320 and engages a recess 322. Both support surface 320 and recess 322 are formed on the outlet core 306.

Figure 14:
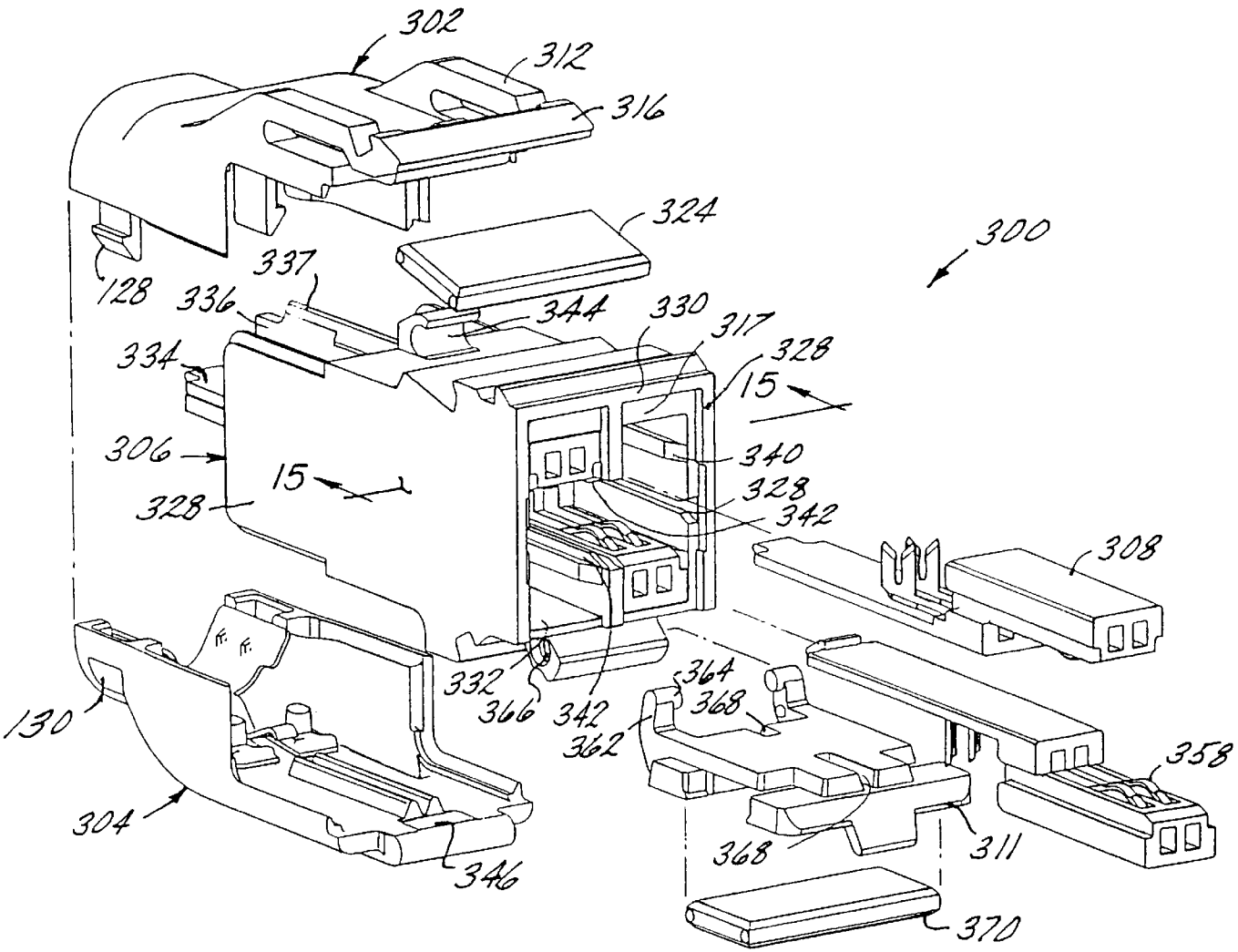
FIG. 14 is an exploded, perspective view of the outlet of FIG. 13.

FIG. 14 is an exploded, perspective view of outlet 300. Top cover 302 includes top cover latches 128 that engage bottom cover openings 130 as described above. Outlet core 306 is generally rectangular and includes side walls 328, top wall 330 and bottom wall 332. A first planar shield 334 extends from the rear of the outlet core and terminates within the interior of the outlet core 306 as will be described below. Second planar shield 336 extends the entire length of the outlet core 306 but includes an open region for receiving plug 100 and overlapping the second planar shield 134 in plug 100. Side walls 328 include grooves 338 for receiving first planar shield 132 of plug 100. Side walls 328 and second planar shield 336 include ribs 340 for securing contact carriers 308 to outlet core 306. Second planar shield 336 includes shield extensions 342 having a reduced thickness and extending away from and parallel to second planar shield 336. As will be described below in detail, shield extensions 342 overlap the edges of second planar shield 134 when the plug 100 is mated with outlet 300. Second planar shield 336 also includes a ridge 337 on its top and bottom for engaging channels 178 formed in the outlet top cover 302 and the outlet bottom cover 304. In addition, side walls 328 and second planar shield 336 extend beyond the front face 317 of outlet 300 and engage recesses 163 formed in the front face 103 of the outlet 100. Top wall 330 extends beyond the front face 317 of outlet 300 and overlaps the front face 103 of plug top cover 102. Lip 165 on plug bottom cover 104 overlaps bottom wall 332.

Door 311 includes two arms having inwardly facing pins 364 that are received in holes 366 on outlet core 306. A pair of slots 368 are formed on the inside surface of door 311 for receiving the first planar shield 336 in outlet core 306. An identification icon 370 can be mounted to the front of door 311 as described in co-pending U.S. patent application Ser. No. 08/652,230, the contents of which are incorporated herein by reference.

Figure 15:
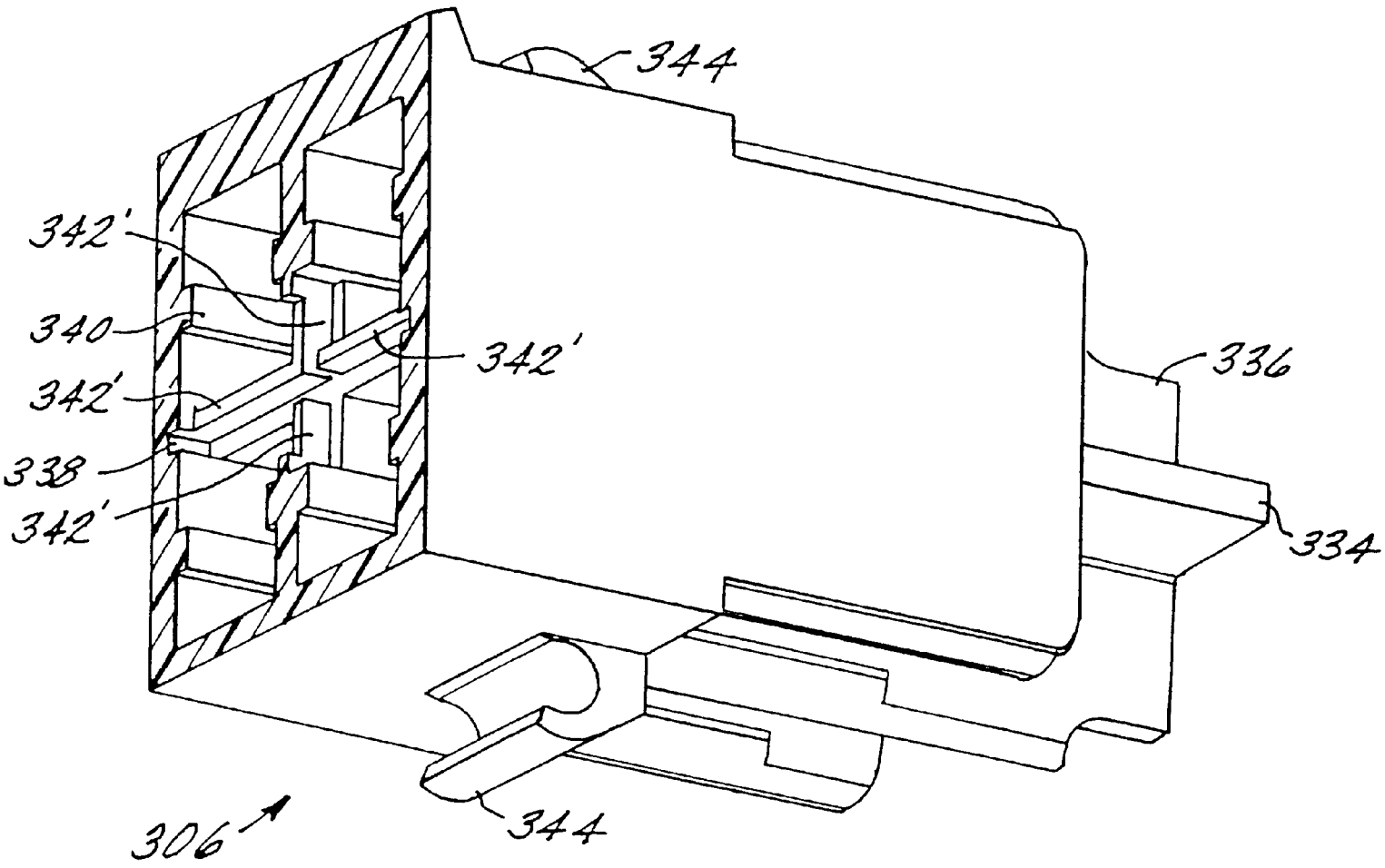
FIG. 15 is a cross-sectional view of the outlet core of FIG. 13.

FIG. 15 is a cross-sectional view of outlet core 306 along line 15—15 of FIG. 14. As shown in FIG. 15, the first planar shield 336 and second planar shield 338 include shield extensions 342' that overlap the ends 133 and 135 of the first planar shield 132 and second planar shield 134 in plug 100. Shield extensions 342' have a thickness that is less than the thickness of the first planar shield 336 or the second planar shield 338. Hooks 344 on the top and bottom of outlet core 306 engage openings 346 in the top cover 302 and the bottom cover 304.

Figure 16:
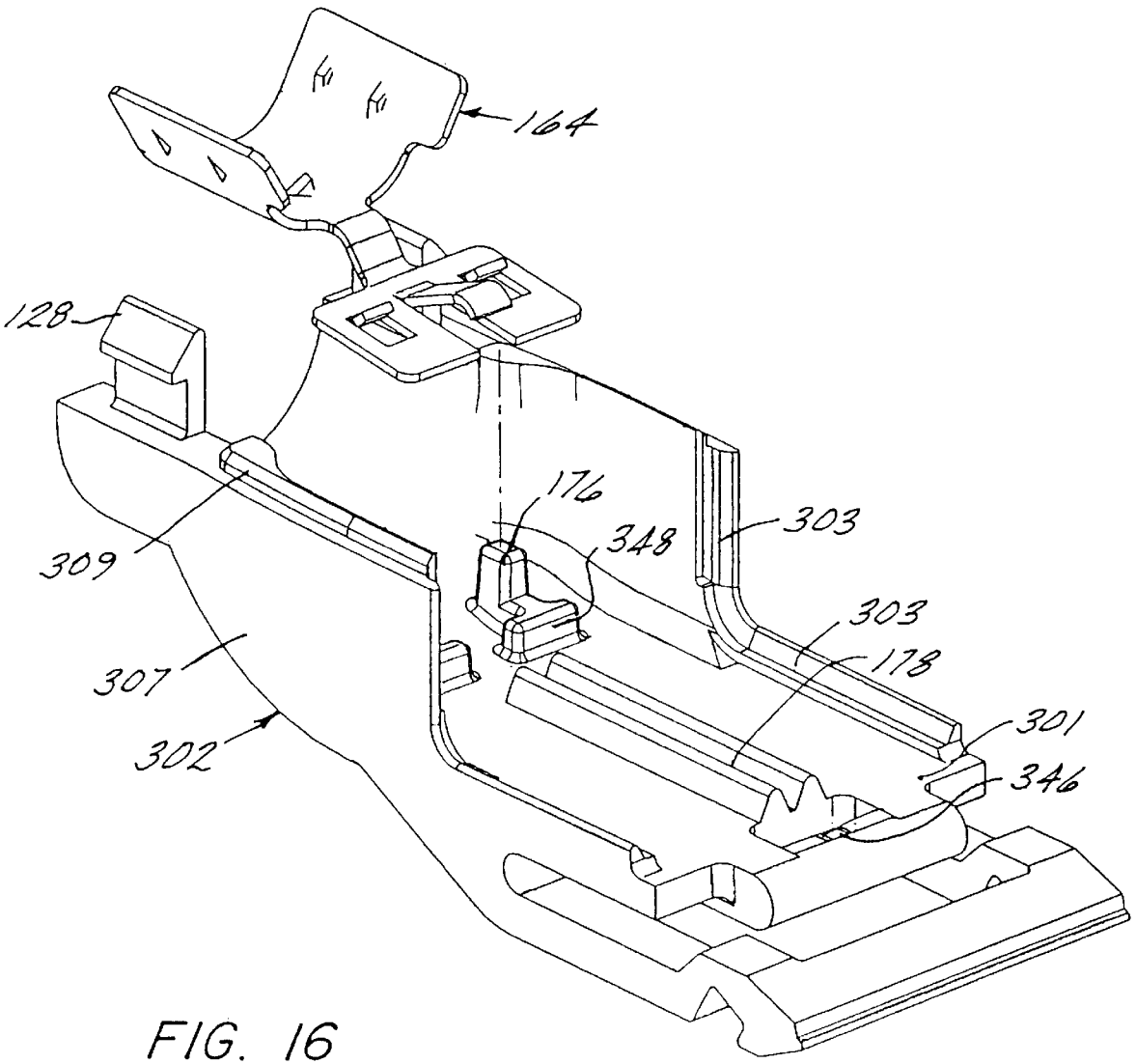
FIG. 16 is an exploded, perspective view of the outlet top cover of FIG. 13.
Figure 19:
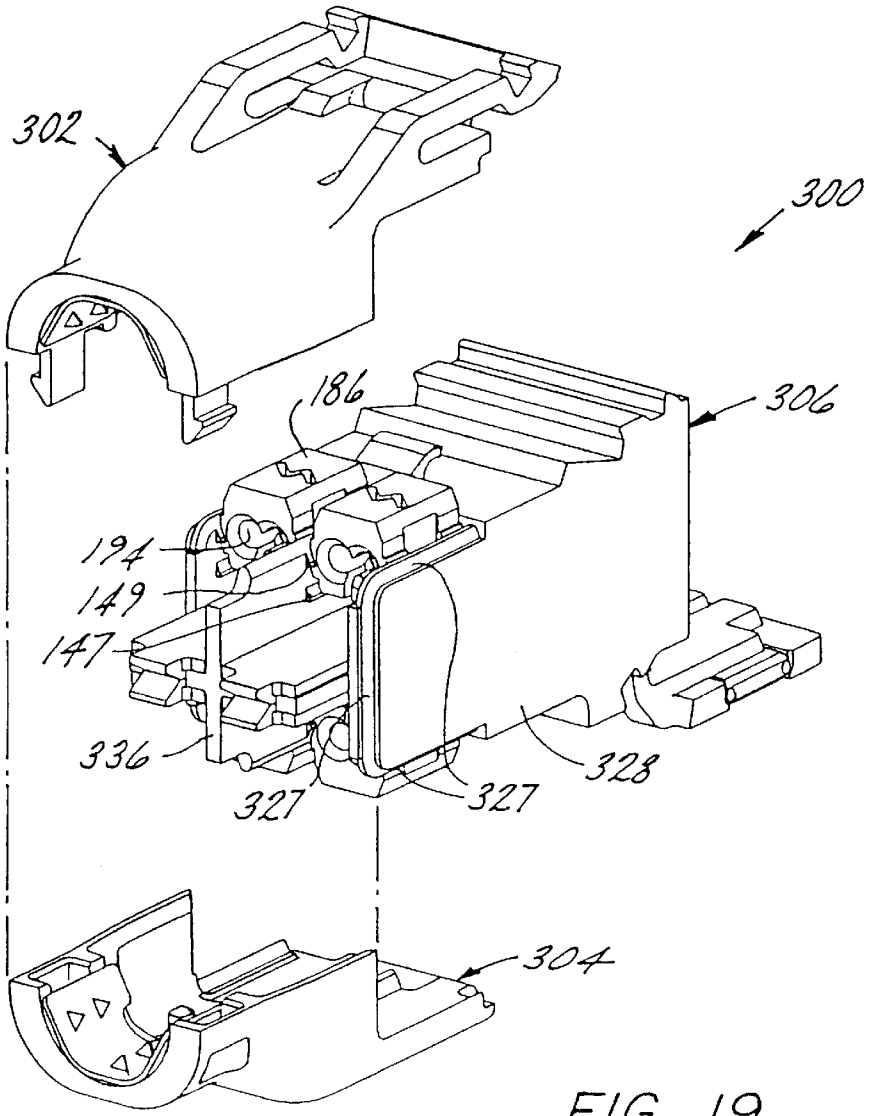
FIG. 19 is an exploded, perspective view of the outlet of FIG. 13 including termination caps.

FIG. 16 is an exploded, perspective view of top cover 302. Top cover 302 includes the shield contact 164 described above with reference to plug 100. Top cover 302 additionally includes projections 348 to support the shield contact 164 due to the different geometry of the outlet 300. Top cover 302 includes recesses 303 along a top wall 301 and a side wall 307 for receiving extensions 327 on the outlet core 306 (FIG. 19). Side walls 307 include projections 309 that are received in recesses 313 on bottom cover 304. A channel 178 is provided on top wall 301 for receiving ridge 337 on second planar shield 336.

Figure 17:
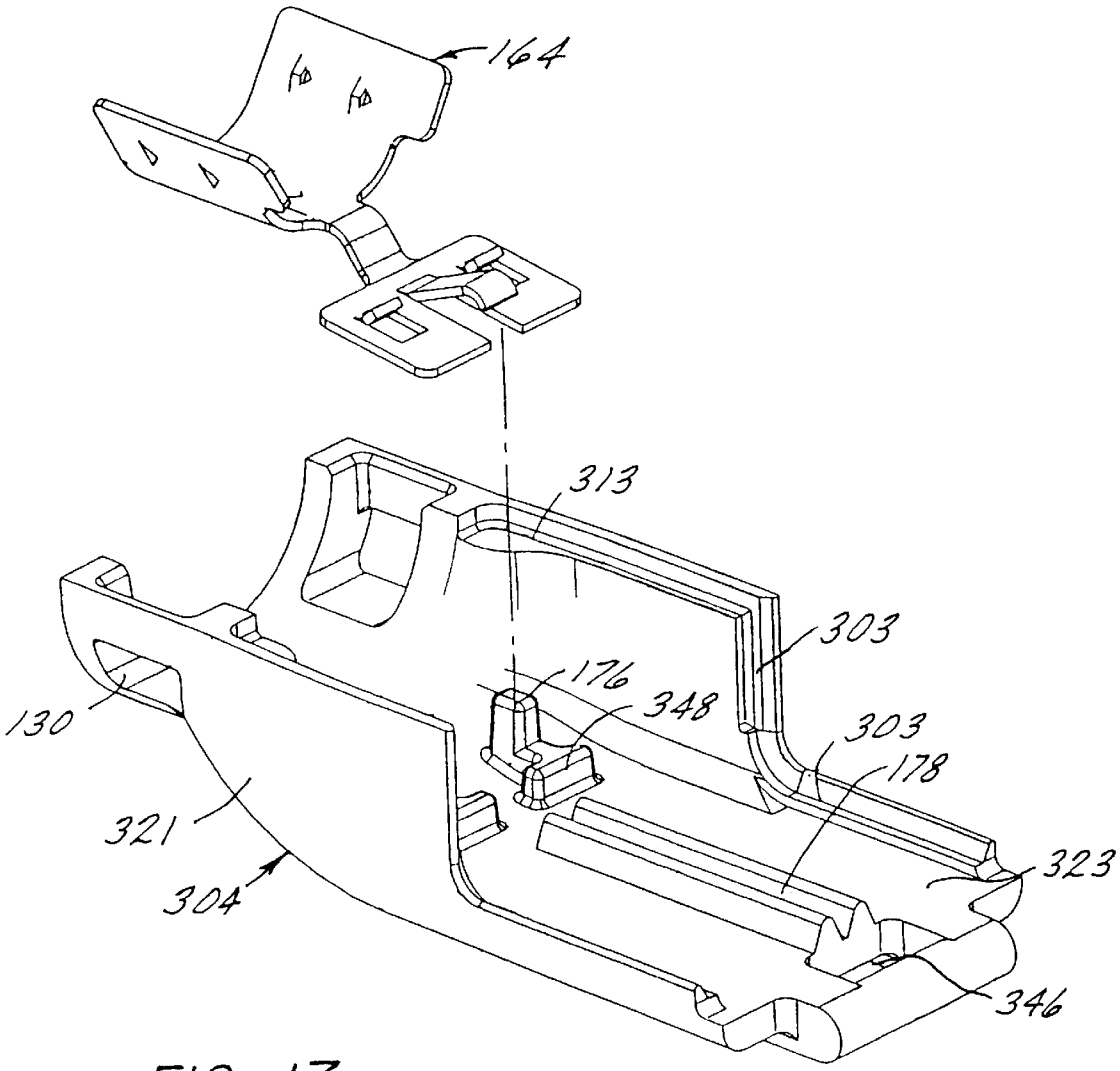
FIG. 17 is an exploded, perspective view of the outlet bottom cover of FIG. 13.

FIG. 17 is an exploded perspective view of bottom cover 304. Bottom cover 304 includes the shield contact 164 described above with reference to plug 100. Bottom cover 304 additionally includes projections 348 to support the shield contact 164 due to the different geometry of the outlet 300. Recesses 303 are formed on the bottom cover bottom wall 323 and side wall 321 and receive extensions 327 (FIG. 19) on the side walls 328 of outlet core 306. Side walls 321 further include recesses 313 for receiving projections 309 on top cover 302. A channel 178 is provided on bottom wall 323 for receiving ridge 337 on second planar shield 336.

Figure 18:
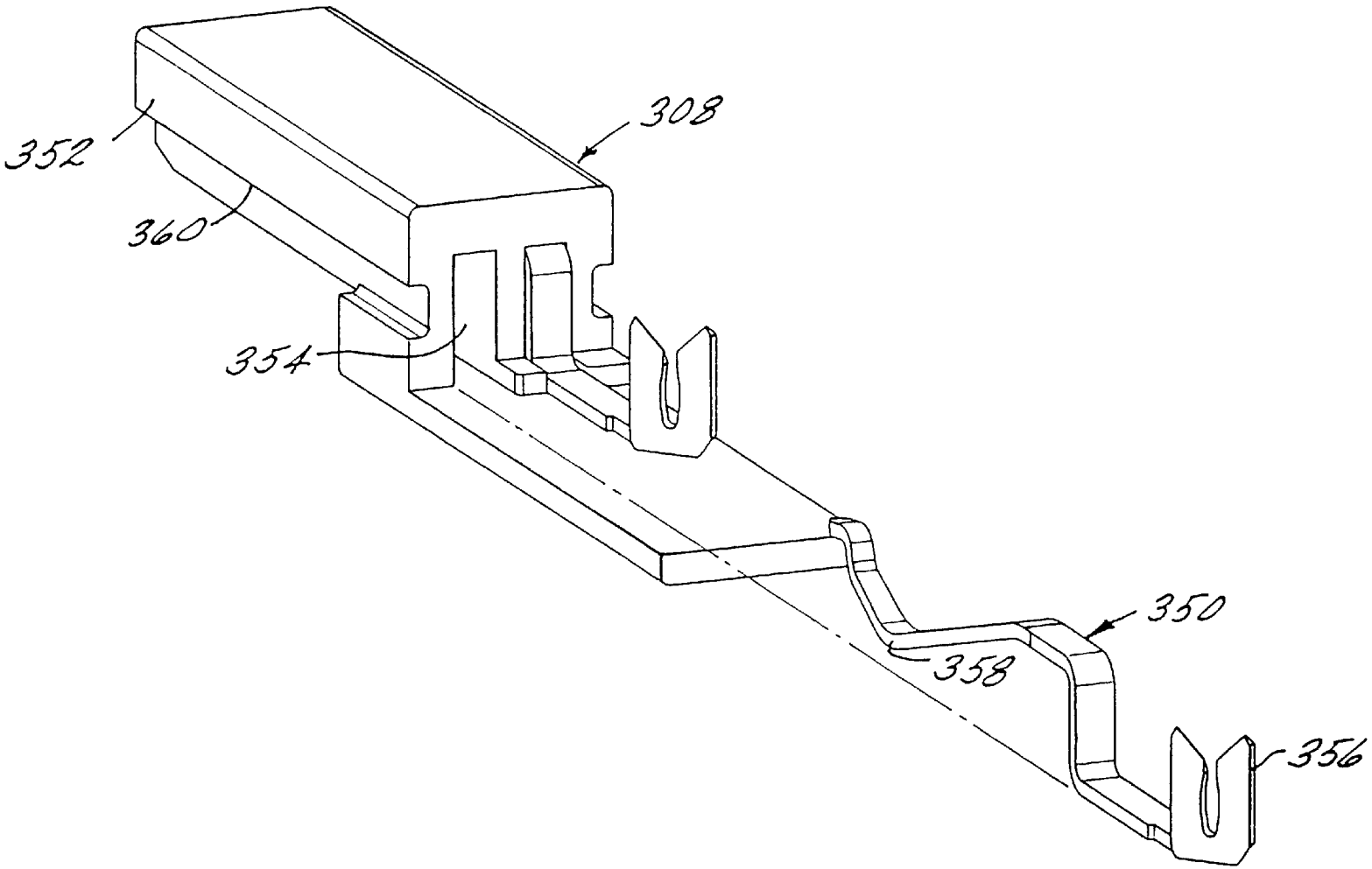
FIG. 18 is an exploded, perspective view of the outlet contact carrier of FIG. 13.

FIG. 18 is an exploded, perspective view of contact carrier 308. The contact carrier is insulative and includes a generally rectangular housing 352 having a pair of slots 354 formed therein for receiving contacts 350. The slots 354 are formed through one surface of housing 352 so that a portion of the contact 350 extends beyond the surface of the housing 352 as shown in FIG. 14. The contact 350 includes an insulation displacement contact 356 at one end for piercing the insulation of a wire and making electrical contact. Insulation displacement contact 356 is angled relative to the longitudinal axis of the contact 350 at an angle of 45 degrees. Contact 350 also includes a spring portion 358 that extends beyond the surface of the housing 352 as shown in FIG. 14. When the plug and outlet are mated, the contacts 110 in plug 100 contact the spring portion 358 of contacts 350 in outlet 300 and deflect the spring portion 358 towards housing 352. The spring portion 358 is biased against contact 110 and ensures good electrical contact between the plug 100 and outlet 300. Housing 352 includes shoulder 360 that contacts rib 340 on outlet core 306 to secure the contact carrier 308 to the outlet core 306.

FIG. 19 is an exploded, perspective view of the outlet 300. Termination caps 186 are used to install wires onto the insulation displacement contacts 356. Termination caps 186 are identical to those described above with reference to the plug 100. Outlet 300 includes first ledges 149 and a second ledges 147 formed on the side walls 328 and second planar shield 336. As described above with reference to plug 100, the termination cap 186 is held in a first position by first lip 188 and second lip 190 straddling first ledge 149. Wire openings 194 receive wires 198 and are aligned with insulation displacement contacts 356. As described above, side walls 328 include extensions 327 on the top, bottom and rear side thereof for engaging recesses 303 on outlet top cover 302 and outlet bottom cover 304.

Figure 20:
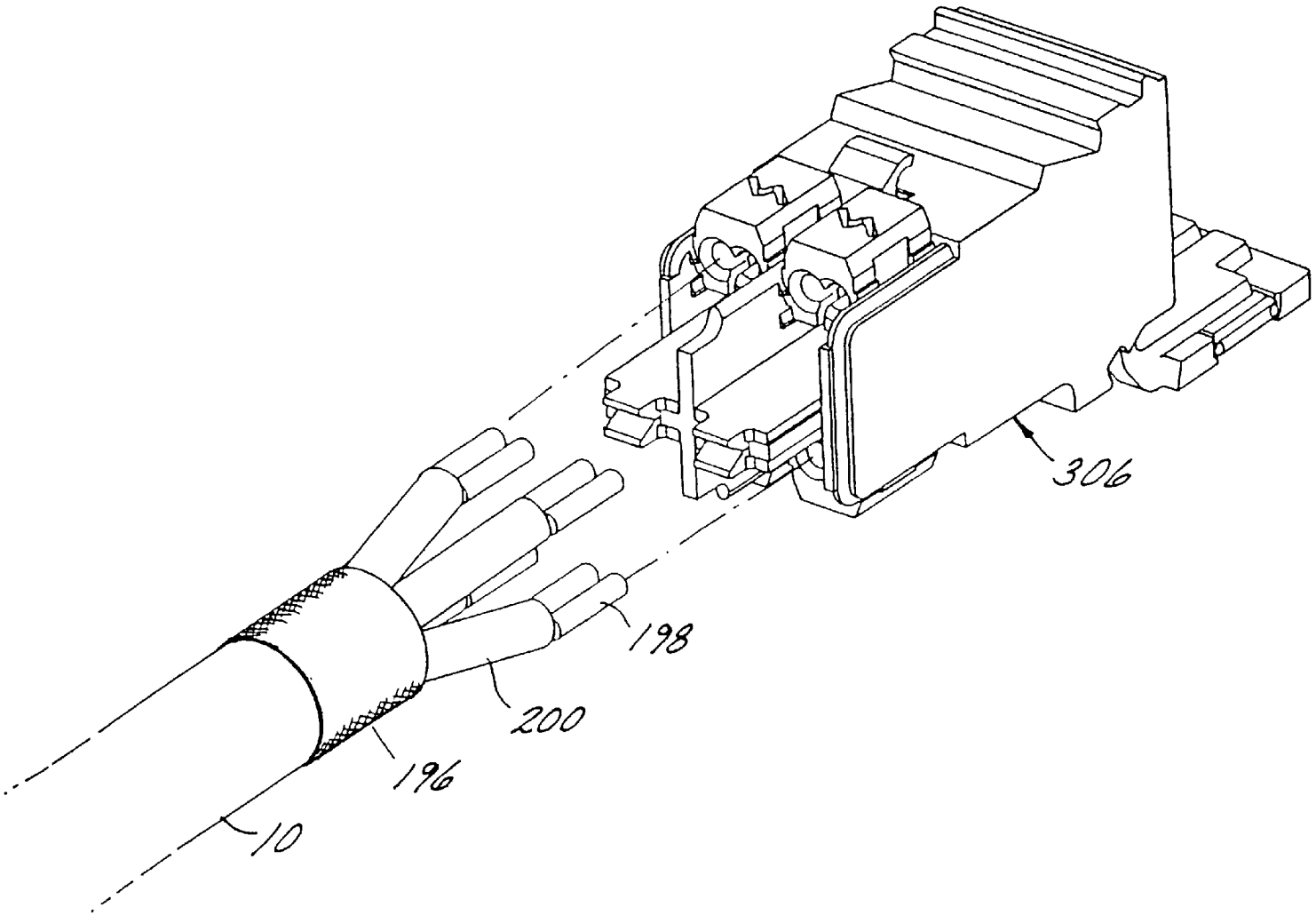
FIG. 20 is a perspective view of the assembly procedure for the outlet of FIG. 13.

The installation of the wires into the outlet 300 will now be described with reference to FIGS. 20–22. As shown in FIG. 20, cable 10 includes eight wires 198. Each pair of wires 198 is encased by a wire pair shield 200. Ground layer 196 is also housed within cable 10 and is pulled back over the outside jacket of cable 10. Wires 198 are inserted into wire openings 194 in termination caps 186. As described above, each wire opening 194 is aligned with an insulation displacement contact 356 and thus each wire 198 is positioned above an insulation displacement contact 356.

Figure 21:
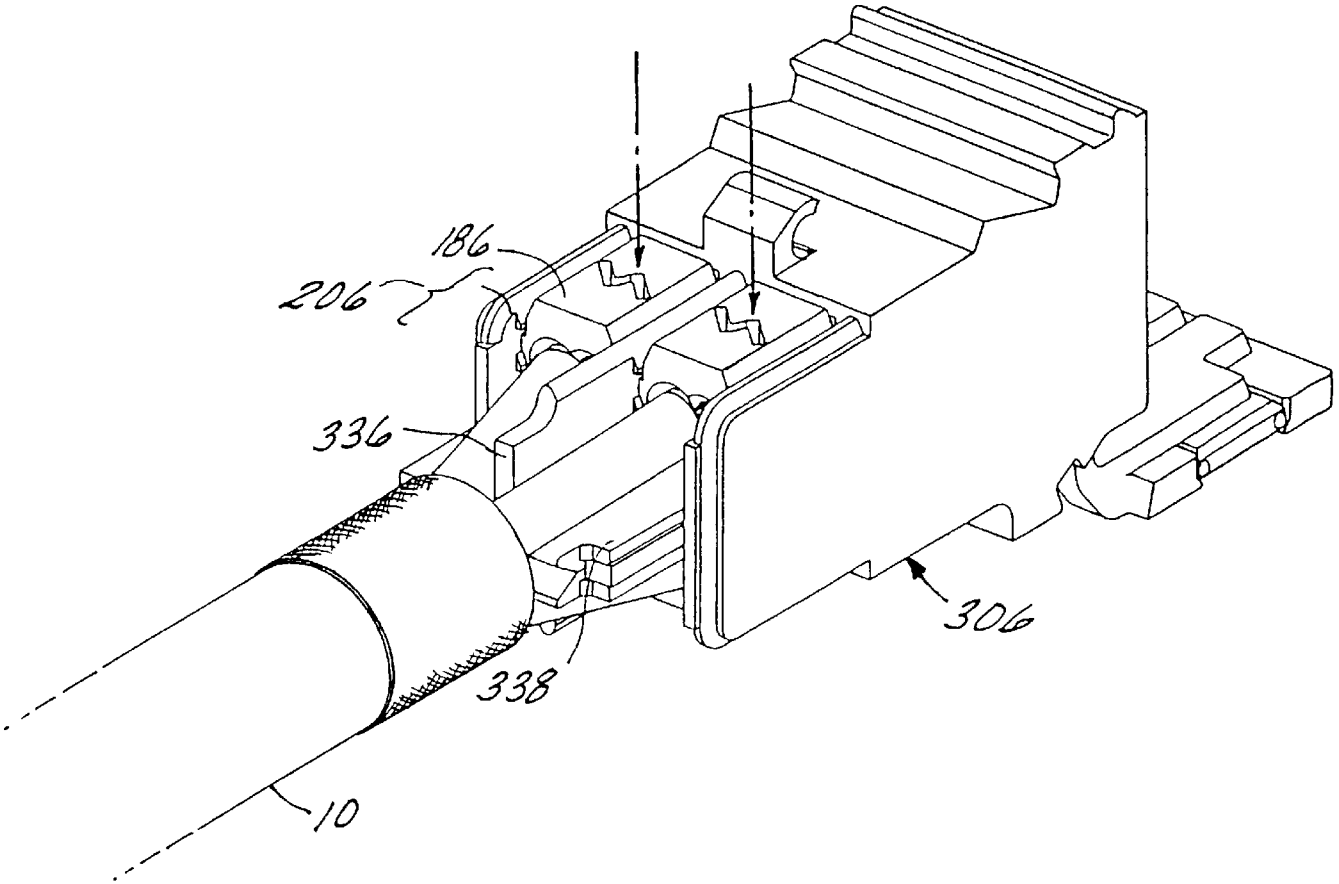
FIG. 21 is a perspective view of the assembly procedure for the outlet of FIG. 13.

FIG. 21 shows the wires 198 positioned in the wire openings 194. Once the wires 198 are positioned in the termination caps 186, force is applied to each termination cap 186 towards the outlet core 306 in the direction shown by the arrows in FIG. 21. As discussed above with reference to plug 100, a single tool can apply force to all four termination caps at once. FIG. 21 shows the termination caps 186 in a second position. First lip 188 and second lip 190 now straddle second ledge 147 to hold the termination cap 186 in the second position. In this state, the wires 198 positioned in wire openings 194 are driven onto insulation displacement contacts 356. As is known in the art, the insulation displacement contacts 356 split the insulation on each wire 198 thereby making electrical contact between the wires 198 and the contacts 350. The outlet 300 also includes a buffer zone 206 similar to that described above with reference to plug 100. A portion of first planar shield 336 and the second planar shield 338 extend past the termination caps 186 to provide the buffer zone 206 having the advantages described above with reference to plug 100.

Figure 22:
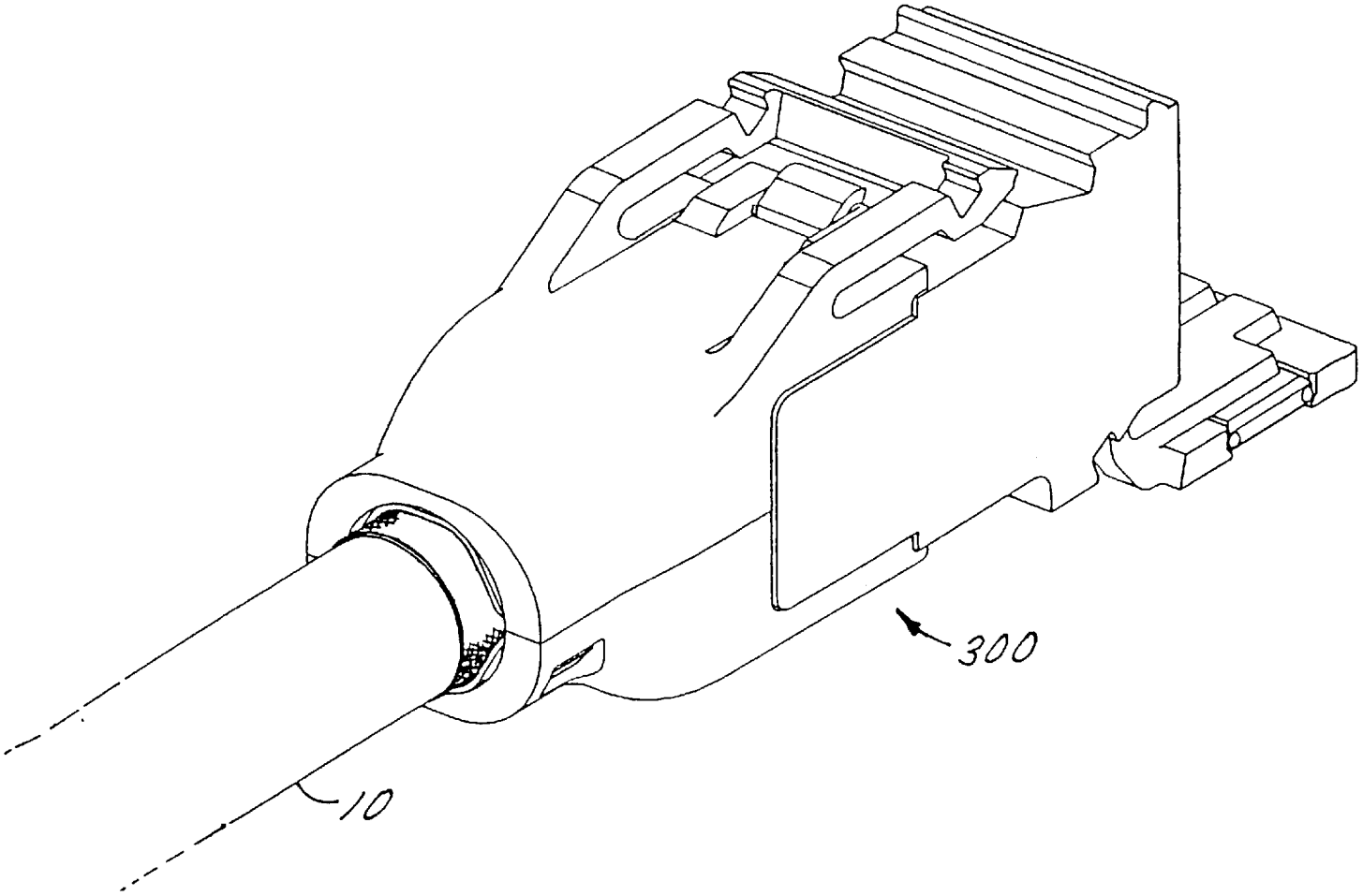
FIG. 22 is a perspective view of the assembly procedure for the outlet of FIG. 13.

The next step in the installation process is the placement of top cover 302 and bottom cover 304 on outlet core 306 as shown in FIG. 22. The opening 346 in both the top cover 302 and the bottom cover 304 is placed over a respective hook 344. The top cover 302 and the bottom cover 304 are then rotated towards each other and top cover latches 128 engage bottom cover openings 130 to secure the top cover 302 to the bottom cover 304. Barbs 168 on shield contacts 164 penetrate the ground layer 196 and the jacket of cable 10 to mechanically and electrically connect the shield contacts 164 to the cable 10.

Figure 23:
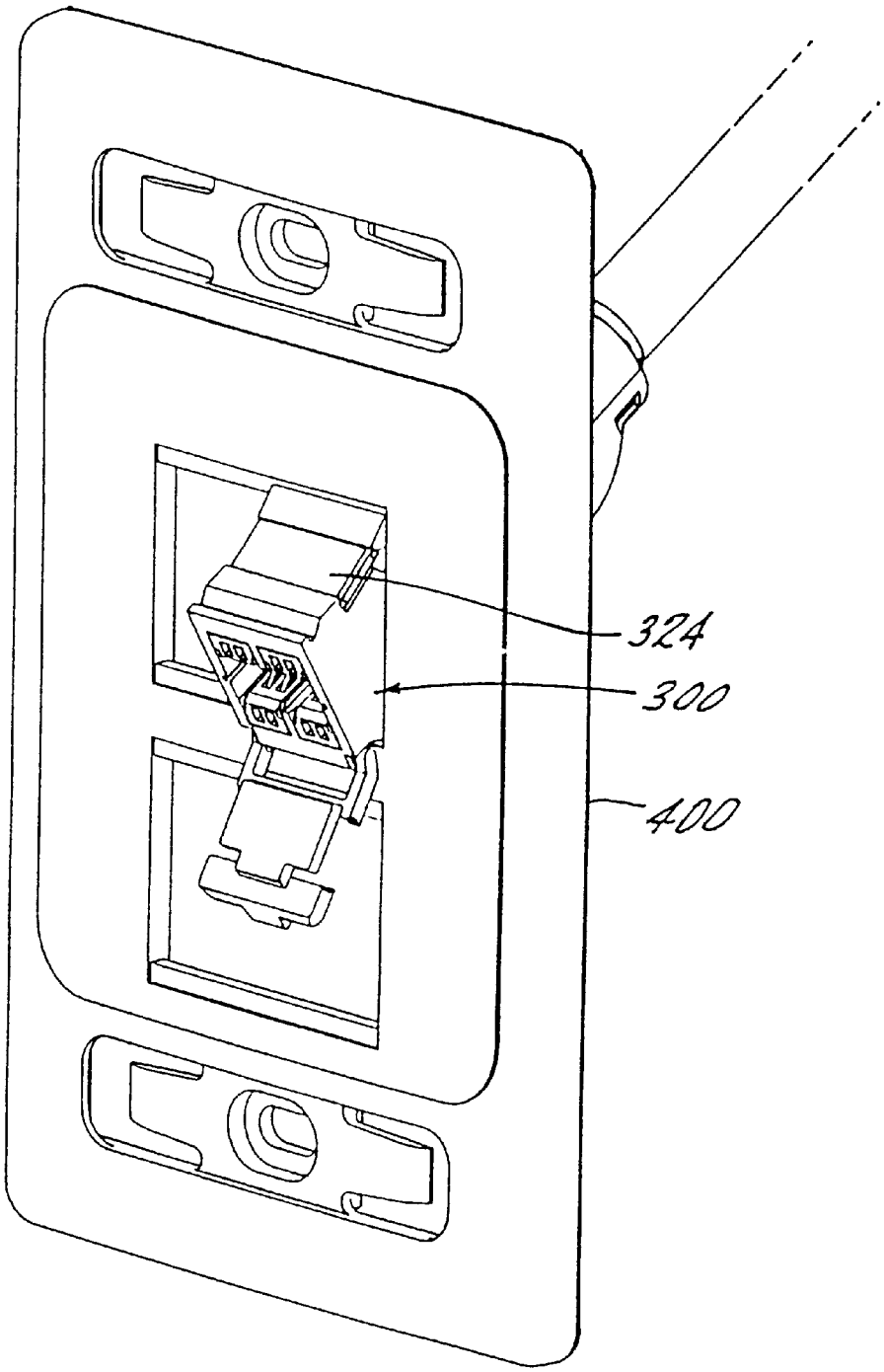
FIG. 23 is a perspective view of the outlet of FIG. 13 mounted in a faceplate.
Figure 24:
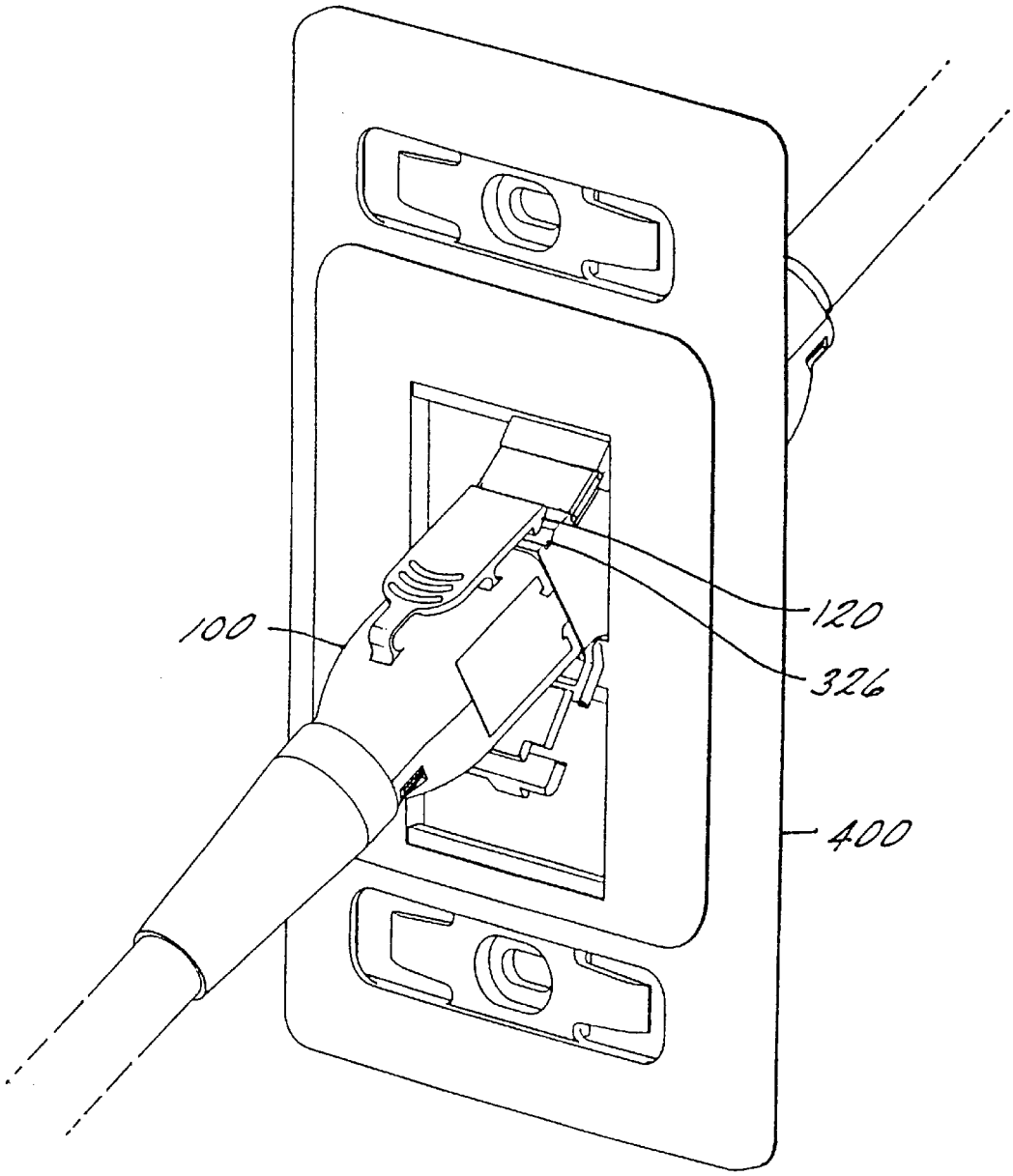
FIG. 24 is a perspective view of the plug of FIG. 1 mated with the outlet of FIG. 13 mounted in the faceplate.

FIG. 23 is a perspective view of the outlet 300 mounted in a faceplate 400. As shown in FIG. 23, the opening of the outlet 300 is at an angle relative to the faceplate. This angle is established by notch 314 on the outlet top cover 302 and notch 315 on the outlet core 306 lying in a plane at an oblique angle relative to the face 317 of the outlet As noted previously, this creates a gravity feed orientation in which the cable connected to a plug mated with outlet 300 is angled towards the floor thereby reducing the bend on the cable. This reduces the likelihood that the cable will be bent below the minimum bend radius. The identification icon 324 also serves as a lock securing the outlet 300 in the faceplate 400. To install the outlet 300 in the faceplate 400, the resilient arms 312 are deflected until both notch 314 and notch 315 are aligned with the edge of the faceplate opening. At this point, arms 312 return to their original position. When the identification icon 324 is positioned in recess 318 and recess 322, this prevents the arms 312 from deflecting towards outlet core 306 and thus locks the outlet 300 in position in the faceplate 400. FIG. 24 is a perspective view of the plug 100 mated with the outlet 300. Lip 120 engages recess 326 to secure plug 100 to outlet 300. In an alternative embodiment, the outlet 300 can also be mounted in a flat configuration in which the face of the outlet is parallel to the faceplate 400 as described above.

Figure 25:
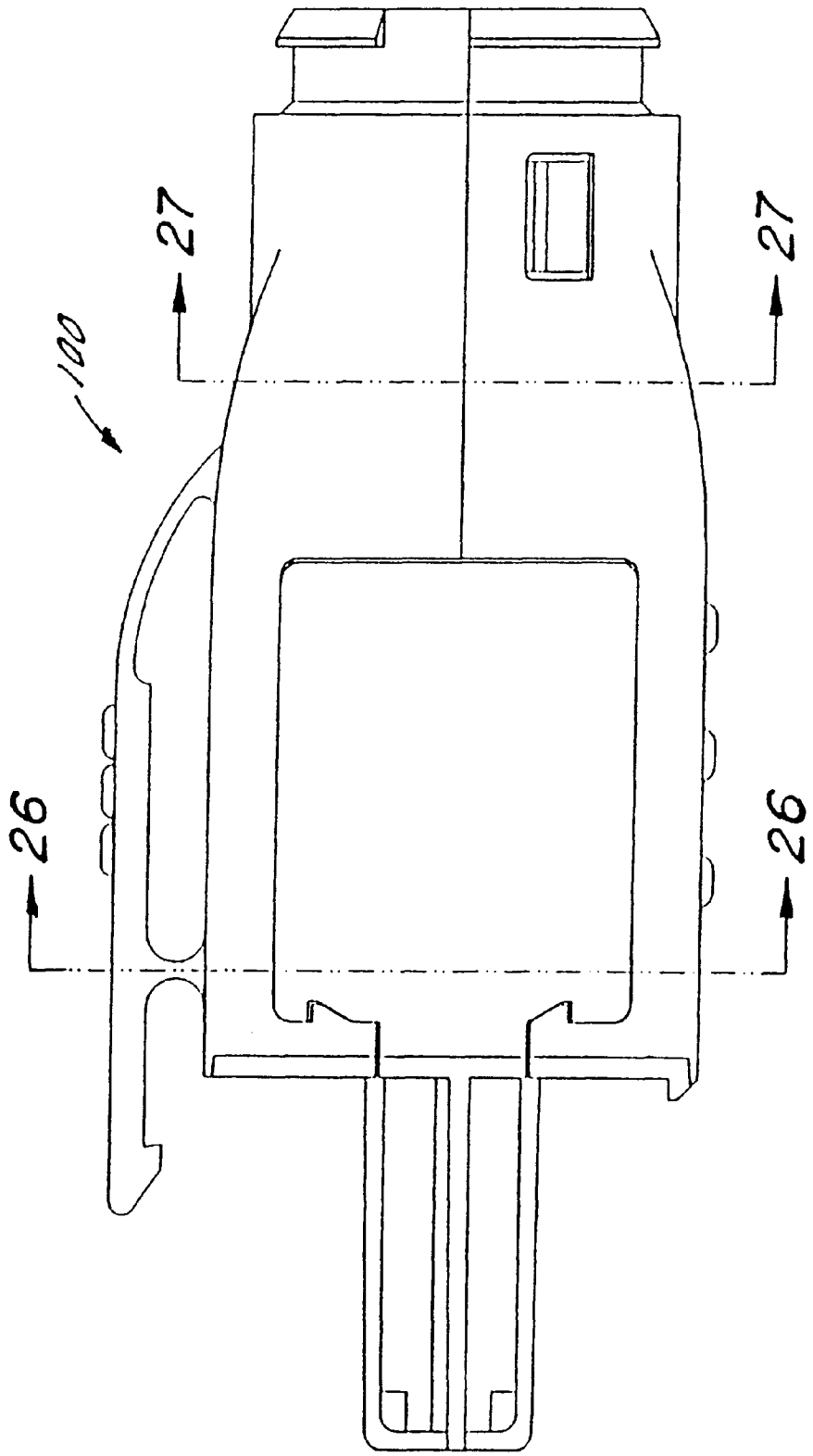
FIG. 25 is a side view of the plug of FIG. 1.
Figure 27:
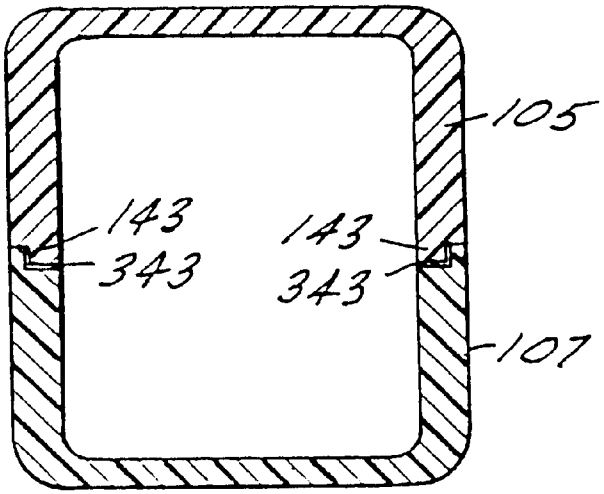
FIG. 27 is a cross sectional view taken along line 27—27 of FIG. 25.
Figure 26:
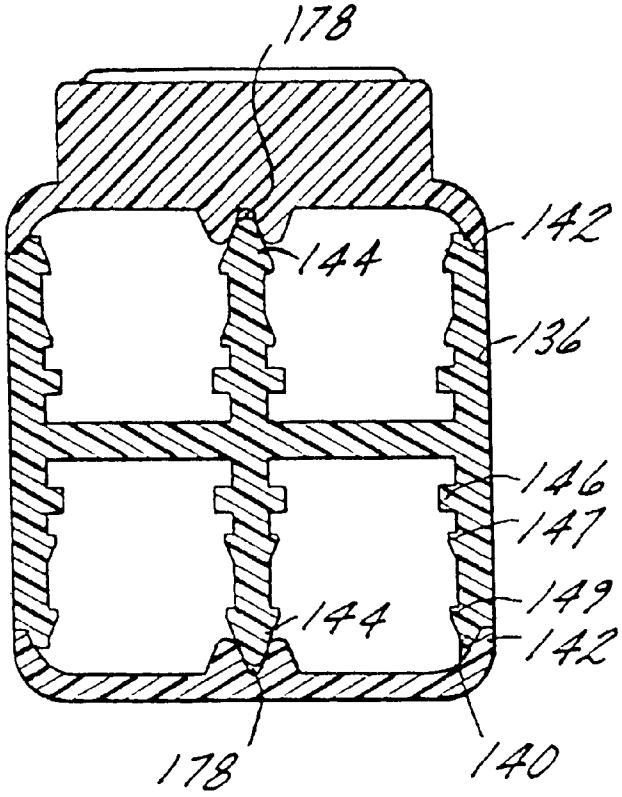
FIG. 26 is a cross sectional view taken along line 26—26 of FIG. 25.

The present invention provides an enhanced telecommunications plug and outlet in which each pair of contacts is individually shielded. No two separate shield members are joined at a butt joint, but rather all significant junctions between separate (non-integral) shield members include some form of overlap. FIGS. 25–32 illustrate the overlapping shield joints. FIG. 25 is a side view of plug 100. FIG. 26 is a cross-sectional view taken along line 26—26 of FIG. 25 and shows the overlap between various plug shield members. FIG. 27 is a cross sectional view taken along line 27—27 of FIG. 25. Outlet 300 is similar to plug 100 in that top cover 302 and bottom cover 304 includes channels 178 for receiving ridges 337 on second planar shield 336. The top cover 302 and bottom cover 304 include recesses 303 for receiving extensions 327 on outlet core side walls 326. Extensions 309 on outlet top cover 302 are received in recesses 313 in outlet bottom cover 304.

Figure 28:
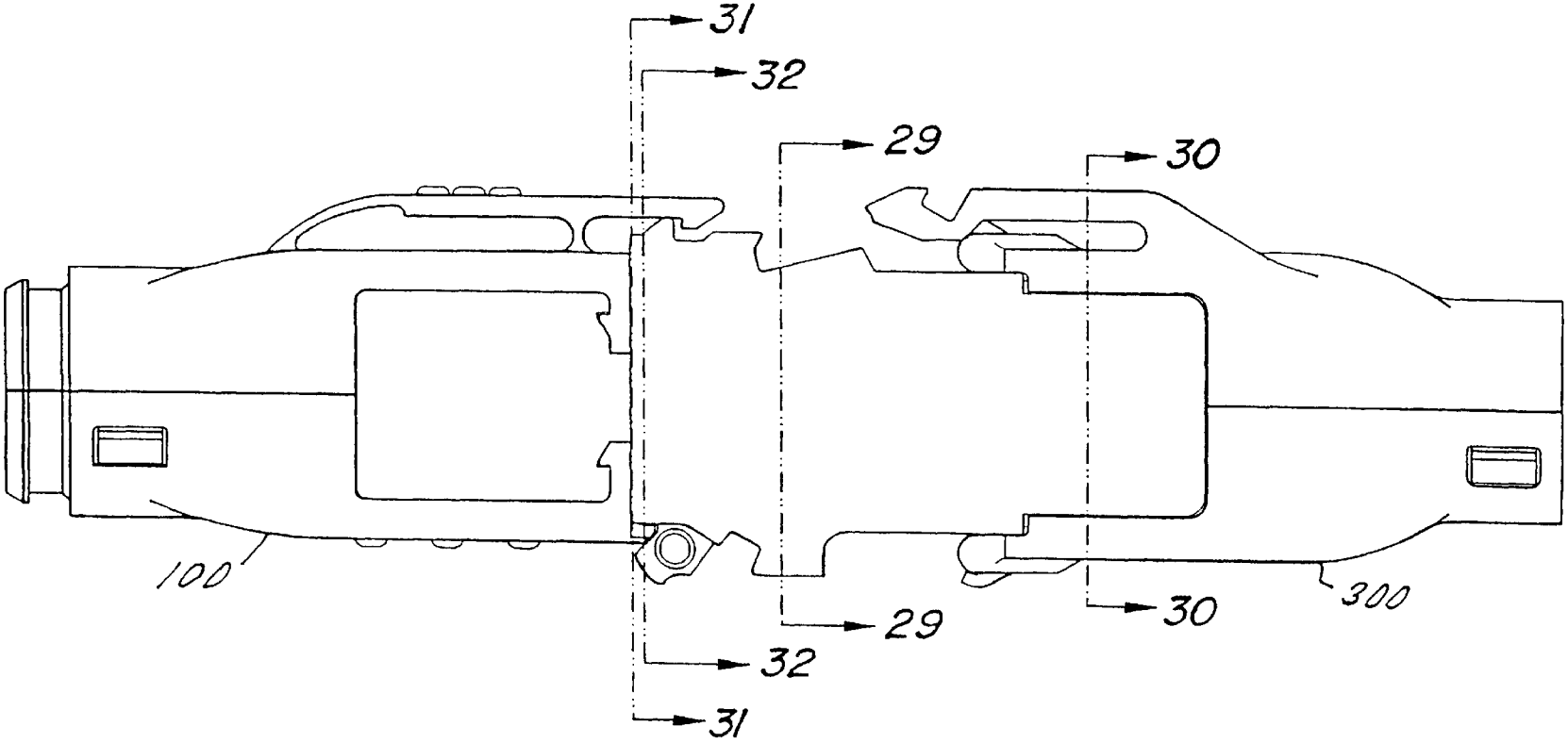
FIG. 28 is a side view of the plug of FIG. 1 and outlet of FIG. 13 mated.
Figure 30:
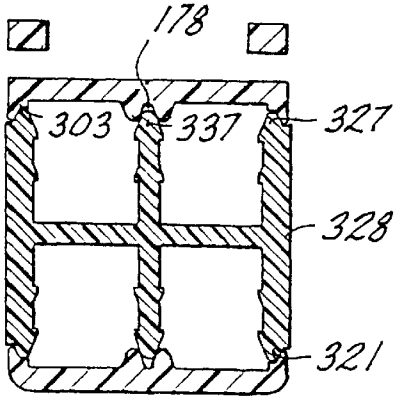
FIG. 30 is a cross sectional view taken along line 30—30 of FIG. 28.
Figure 32:
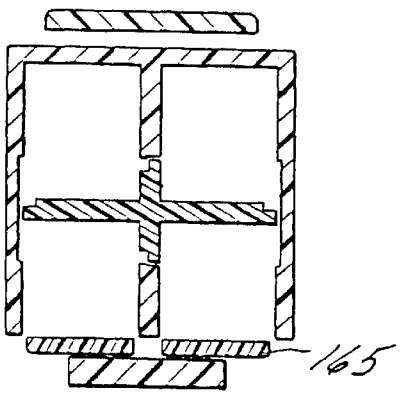
FIG. 32 is a cross sectional view taken along line 32—32 of FIG. 28.
Figure 29:
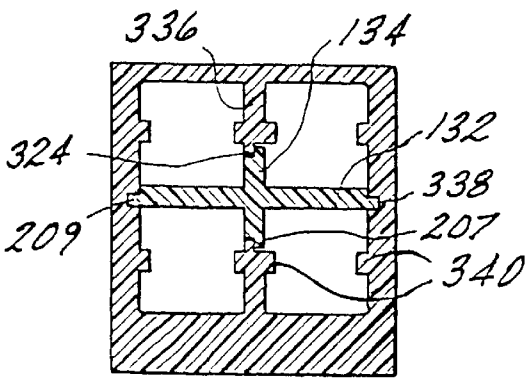
FIG. 29 is a cross sectional view taken along line 29—29 of FIG. 28.
Figure 31:
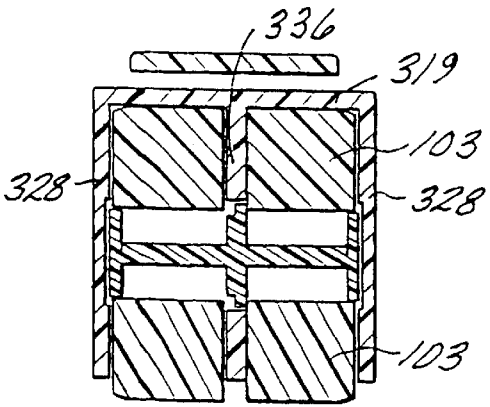
FIG. 31 is a cross sectional view taken along line 31—31 of FIG. 28.

FIG. 28 is a side view of the plug 100 mated to the outlet 300 and FIGS. 29–32 are cross-sectional views taken along FIG. 28. FIG. 29 illustrates the overlap between shield members in the outlet core and plug core. As shown in FIG. 29, second planar shield member includes an offset rib 207 along its edge that overlaps shield extension 342. The offset rib 207 also provides a keying function so that the plug can only be installed in outlet 300 in one orientation. Similarly, first planar shield 132 includes an offset rib 209 on its edge for engaging channel 338 which also provides keying. FIG. 30 illustrates the overlap between the outlet core, the outlet top cover and the outlet bottom cover. FIG. 31 is a cross sectional view of the junction between the plug and the outlet showing how the outlet top wall 319 and outlet side walls 328 overlap the front face 103 of the plug 100. FIG. 32 is a cross-sectional view taken along line 32—32 of FIG. 28 showing the bottom cover lip 165 which extends under outlet core bottom wall 332. Accordingly, each contact carrier is enclosed in a quadrant where all shield joints have some overlap and the amount of shielding between pairs is enhanced as compared to a shield arrangement using butt joints.

Figure 33:
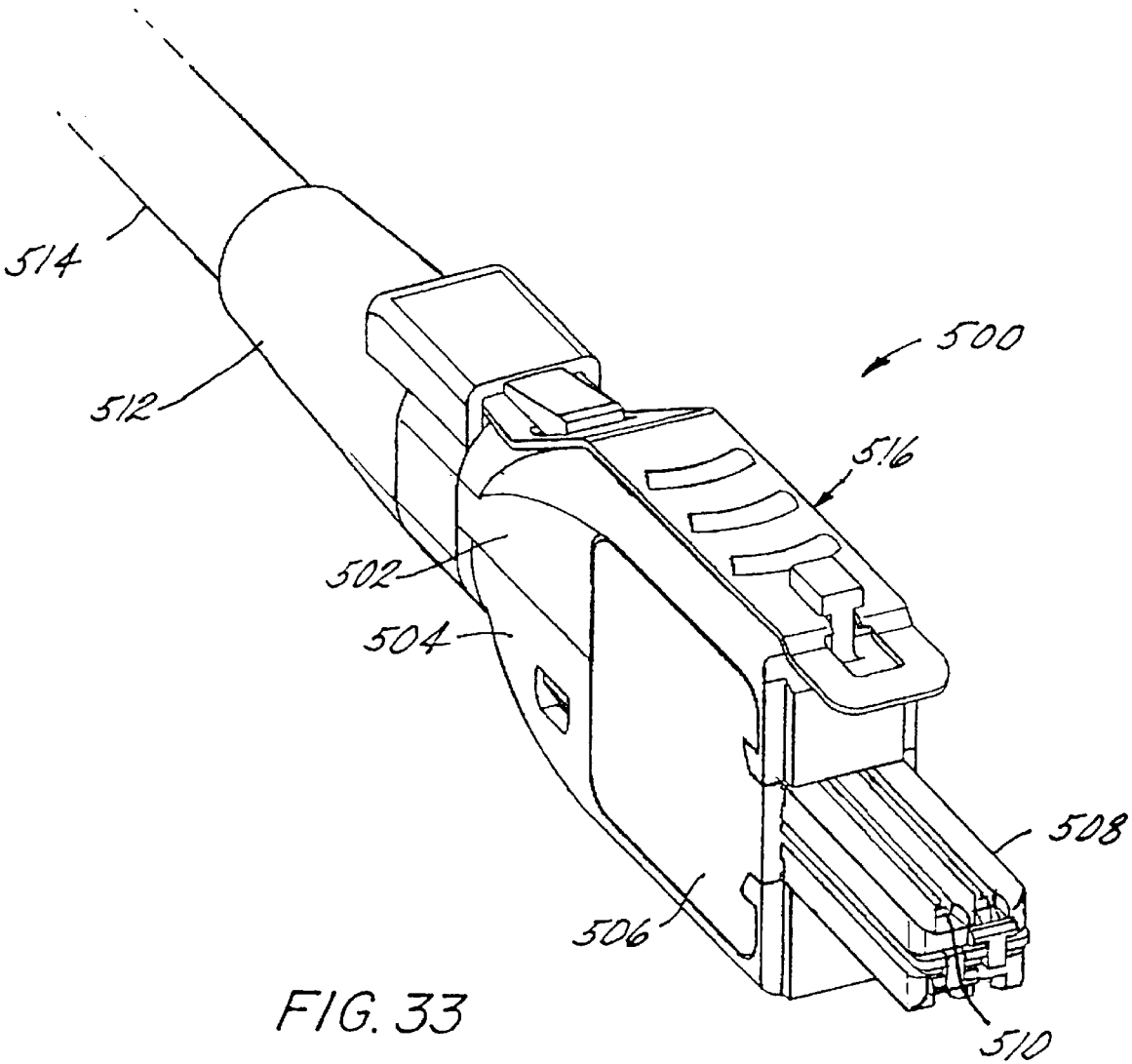
FIG. 33 is a perspective view of an assembled plug of a first alternate embodiment in accordance with the present invention.

FIG. 33 is a perspective view of an assembled plug of a first alternative embodiment in accordance with the present invention, shown generally as 500. Plug 500 is similar to plug 100 but includes two pairs of contacts, instead of four pairs of contacts. The plug 500 includes a top cover 502, a bottom cover 504 and a core 506. The top cover 502, bottom cover 504 and core 506 are all conductive to provide shielding as described herein. These conductive components may be made from metal, metallized plastic or any other known conductive material. Core 506 supports insulative (e.g. plastic) contact carriers 508. Each contact carrier 508 includes two contacts 510 defining a pair. A boot 512 provides strain relief and is made from a pliable plastic or rubber. Also shown in FIG. 33 is cable 514 entering boot 512. A latch 516 is provided on the top cover 502 for mechanically connecting the plug 500 to outlet 700 and electrically connecting the cable ground layer to the outlet 700 as described herein.

Figure 34:
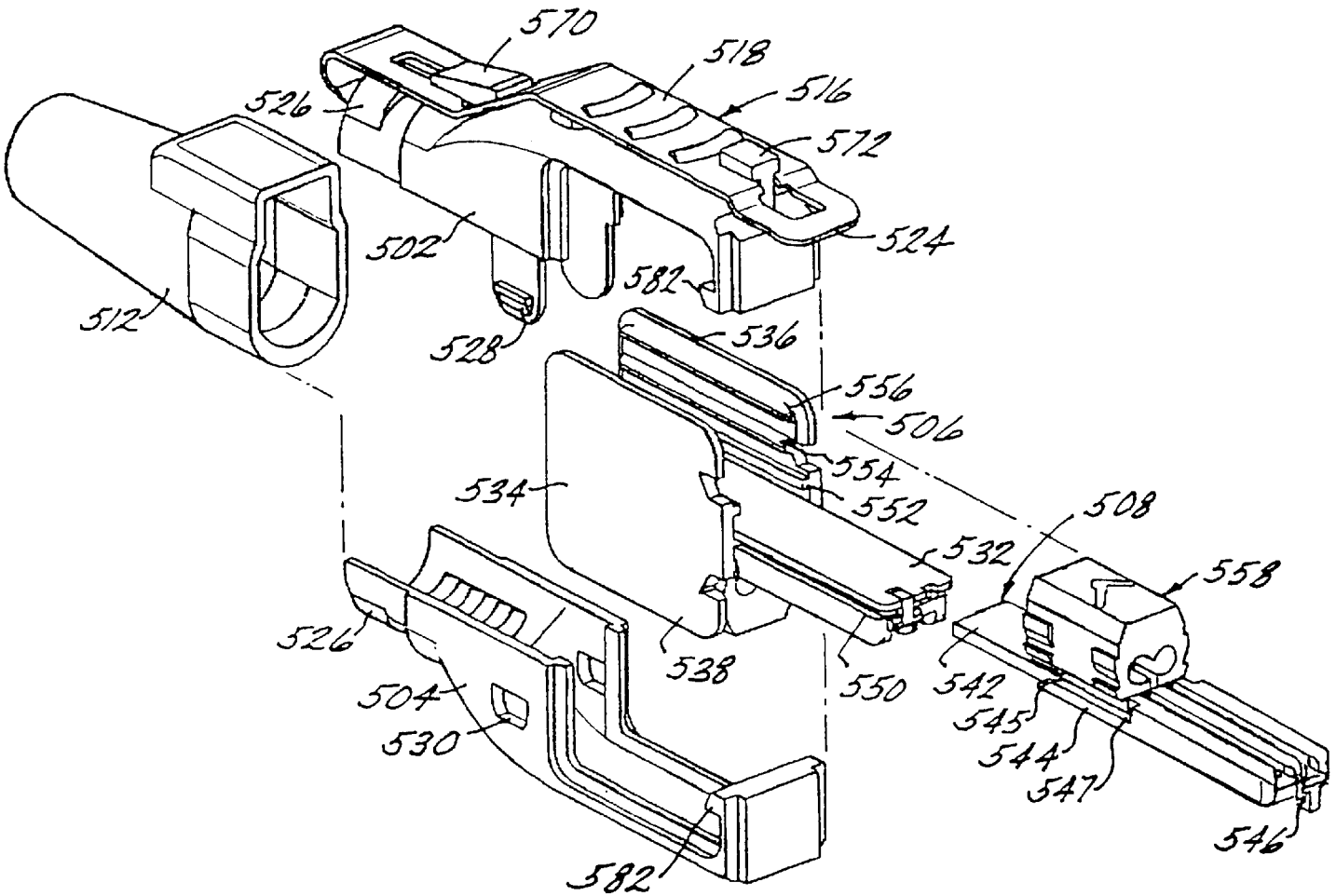
FIG. 34 is an exploded, perspective view of the plug and latch of FIG. 33.

FIG. 34 is an exploded, perspective view of the plug 500. Latch 516 is conductive (e.g. metal) and is made up of a latch body 518 secured to the top cover 502 at latch engaging pawl 570 and latch engaging post 572. A portion of the latch body 518 comprises a latch extension 524 for engaging an opening 740 formed in outlet 700. In addition to securing the plug 500 to the outlet 700, latch extension 524 allows for electrical contact from the cable ground layer to outlet core 706 in the outlet 700. Top cover 502 includes a semi-circular groove 526 and bottom cover 504 includes a similar semi-circular groove 526 that receives a circular lip 513 (FIG. 37) in boot 512 as described below. Two top cover latches 528 engage two bottom cover recesses 530 to secure top cover 502 to bottom cover 504.

Plug core 506 includes a planar shield 532. Plug core 506 also includes side walls 534. The top portion 536 and bottom portion 538 of the side walls 534 serve to locate the core 506 within the top cover 502 and bottom cover 504 and overlap the edges of the top cover 502 and bottom cover 504 to provide better shielding than a butt joint. Two ribs 552 are formed on the inside surface of each side wall 534 and are parallel to and spaced apart from planar shield 532. Contact carrier 508 has a planar base 542 which rests on the planar shield 532. Base 542 includes two flanges 544 extending away from the base 542 wherein flange 544 has an incline portion 545 at one end and a stop 547 at the opposite end. When contact carrier 508 is installed in the core 506, flange 544 is placed under rib 552 to hold the contact carrier 508 to the planar shield 532. The contact carrier 508 is slid into the core 506 until stop 547 contacts the end of rib 552. In this position, a tab 546 is provided so that when contact carrier 508 is slid into core 506, tab 546 contacts a similarly shaped recess in planar shield 532 and positions contact carrier 508 in core 506. The contact carrier 508 also includes a lip 603 (shown in FIG. 36B) that extends substantially perpendicular to planar base 542 and beyond the edge of planar shield 532 to prevent the contact carrier 508 from sliding out of core 506.

Recesses 550 are provided in planar shield 532 to receive ribs 736 on the side walls of outlet 700 and provide an overlap between the side walls of outlet 700 and planar shield 532. The inside of each side wall 534 also includes a first ledge 556 and a second ledge 554 which are used to secure a termination cap 558 as described below with reference to FIGS. 36–39.

Figure 35:
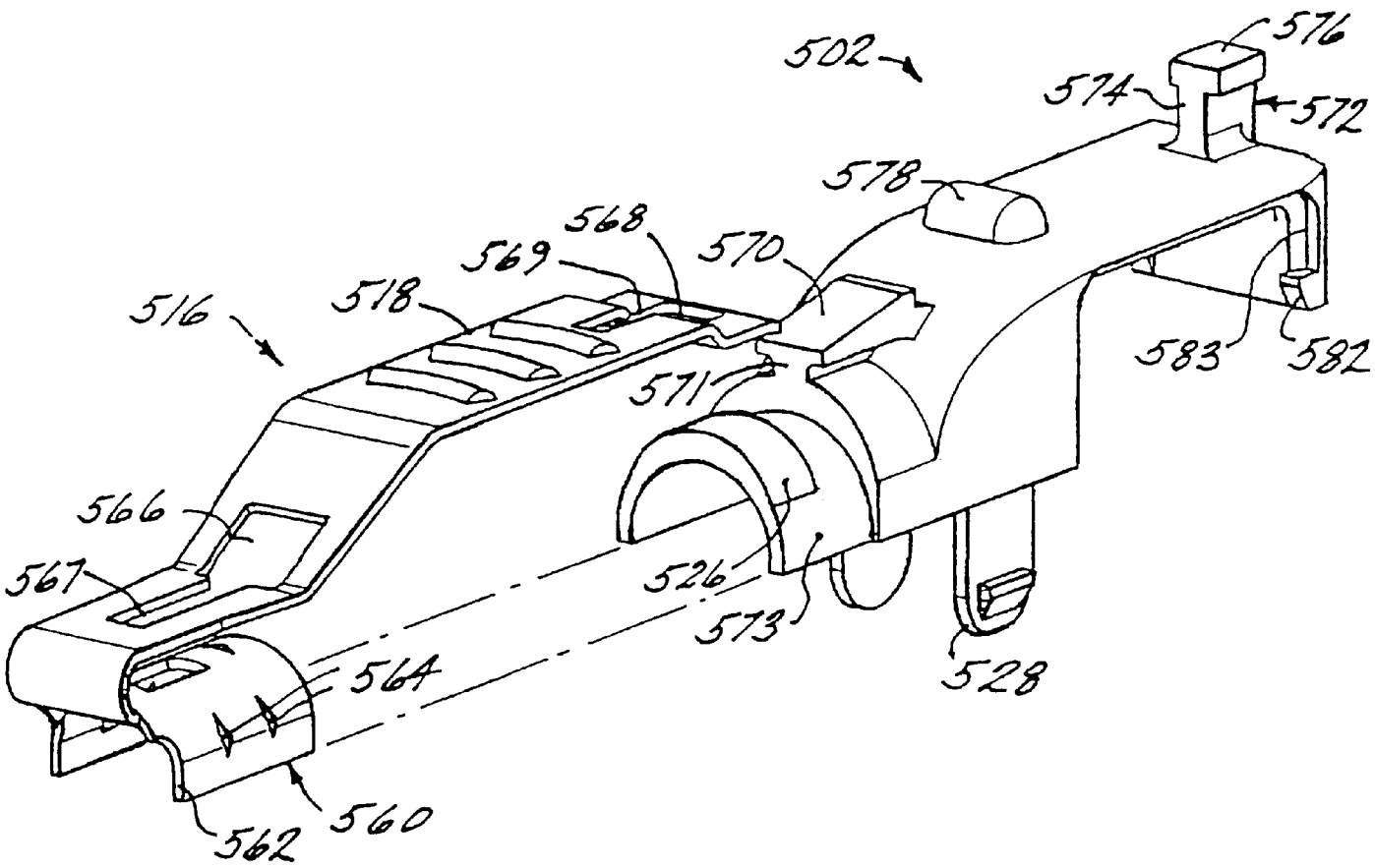
FIG. 35 is an exploded, perspective view of the plug top cover of FIG. 33.

FIG. 35 is an exploded, perspective view of the top cover 502 and latch 516. The latch 516 includes a shield contact 560 which electrically connects the ground layer of cable 514 to the outlet core 706 of outlet 700. Shield contact 560 is conductive and is preferably made from metal. Shield contact 560 has an arcuate portion 562 formed to generally follow the shape of cable 514. Arcuate portion 562 includes barbs 564 that pierce the ground layer of cable 514 and the cable jacket. This electrically and mechanically connects the shield contact 560 to cable 514. When latch 516 is coupled with top cover 502, arcuate portion 562 fits underneath neck 573 of top cover 502. When assembled, arcuate portion 560 is positioned within the interior of the plug 500 and the remainder of latch 516 is positioned outside of the plug 500. Latch 516 includes a first receiving opening 566 and a second receiving opening 568 formed within the latch body 518. First opening 566 is for receiving a pawl 570 formed in top cover 502 and second opening 568 is for receiving a post 572 formed in top cover 502. Post 572 includes a neck portion 574 and a head portion 576. First receiving opening 566 has a slot 567 and second receiving opening 568 has a slot 569 for engaging the neck 571 of pawl 570 and neck 574 of post 572, respectively. Latch 516 is engaged with top cover 502 by aligning first receiving opening 566 with the chamfered surface of pawl 570 and aligning the second receiving opening 568 with the head portion 576 of post 572 and then sliding the latch 516 in the direction toward post 572 so that neck 571 of pawl 570 slidably engages with slot 567 and neck 574 of post 572 slidably engages with slot 569. Top cover 502 also includes a nub 578 positioned beneath latch 516. Projections 582 engage a similarly shaped recesses 584 in side walls 534. Nub 578 is formed on top cover 502 beneath body portion 518 to limit travel of the latch 516 towards the top cover 502. Top cover 502 includes side recesses 583 for receiving and engaging with side walls 534, wherein the recesses 583 include a ridge having an incline portion 588 (FIG. 36A) and a land 590 (FIG. 36A), wherein side walls 534 are received on the ridge portion and the incline portion of said ridge causes side walls 534 to ride onto the land thereby coupling the two together in an overlapping manner.

Figure 36A:
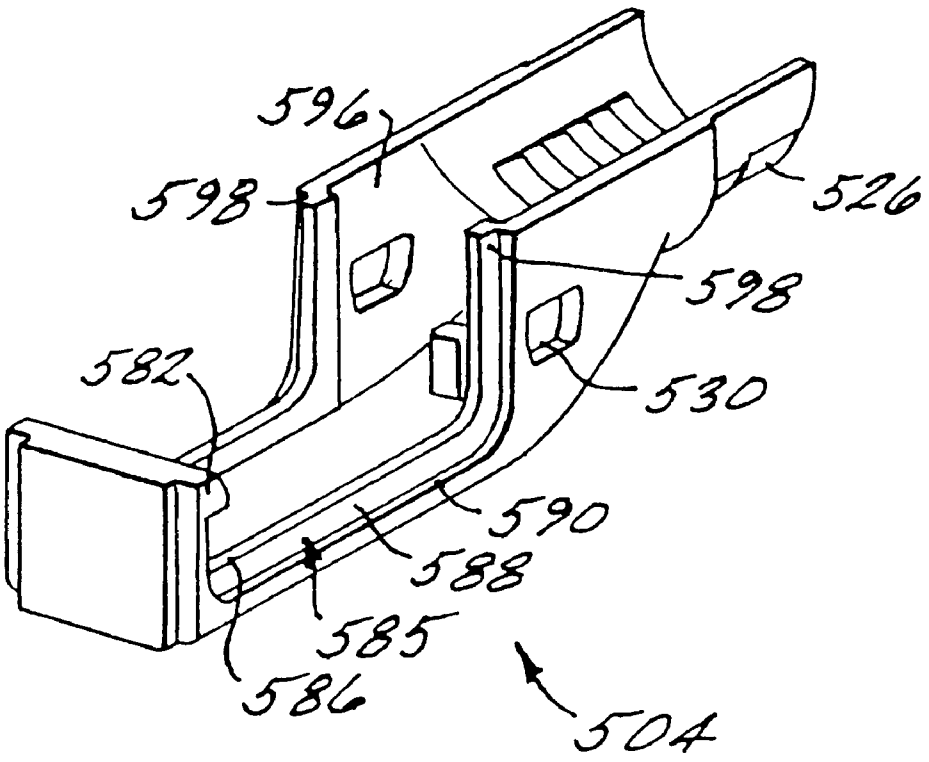
FIG. 36A is a perspective view of the plug bottom cover of FIG. 33.

FIG. 36A is a perspective view of the bottom cover 504. Bottom cover 504 includes a recess 585 similar to recess 583 in top cover 506 wherein recess 585 comprises a ledge 586, a ledge incline 588 and a land 590 for receiving side walls 534 of core 506. Side walls 534 are received at ledge 586 and side walls 534 ride on ledge incline 588 to land 590. This allows the side walls 534 to be overlapped by recess 584 of the bottom cover 504. Bottom cover 508 also includes a projection 582 for engaging similarly shaped recess 584 in each of side walls 534. Bottom cover includes side walls 596 having side wall recess 598 with a shoulder portion, similar to those on top cover 506, for receiving side walls 534 thereby allowing overlapping of the side walls 534 and the bottom cover 508 when side walls 534 abut the shoulder portion. Bottom cover 504 may include a lip 165 as described above with reference to plug 100 to overlap the bottom of outlet 700.

Figure 36B:
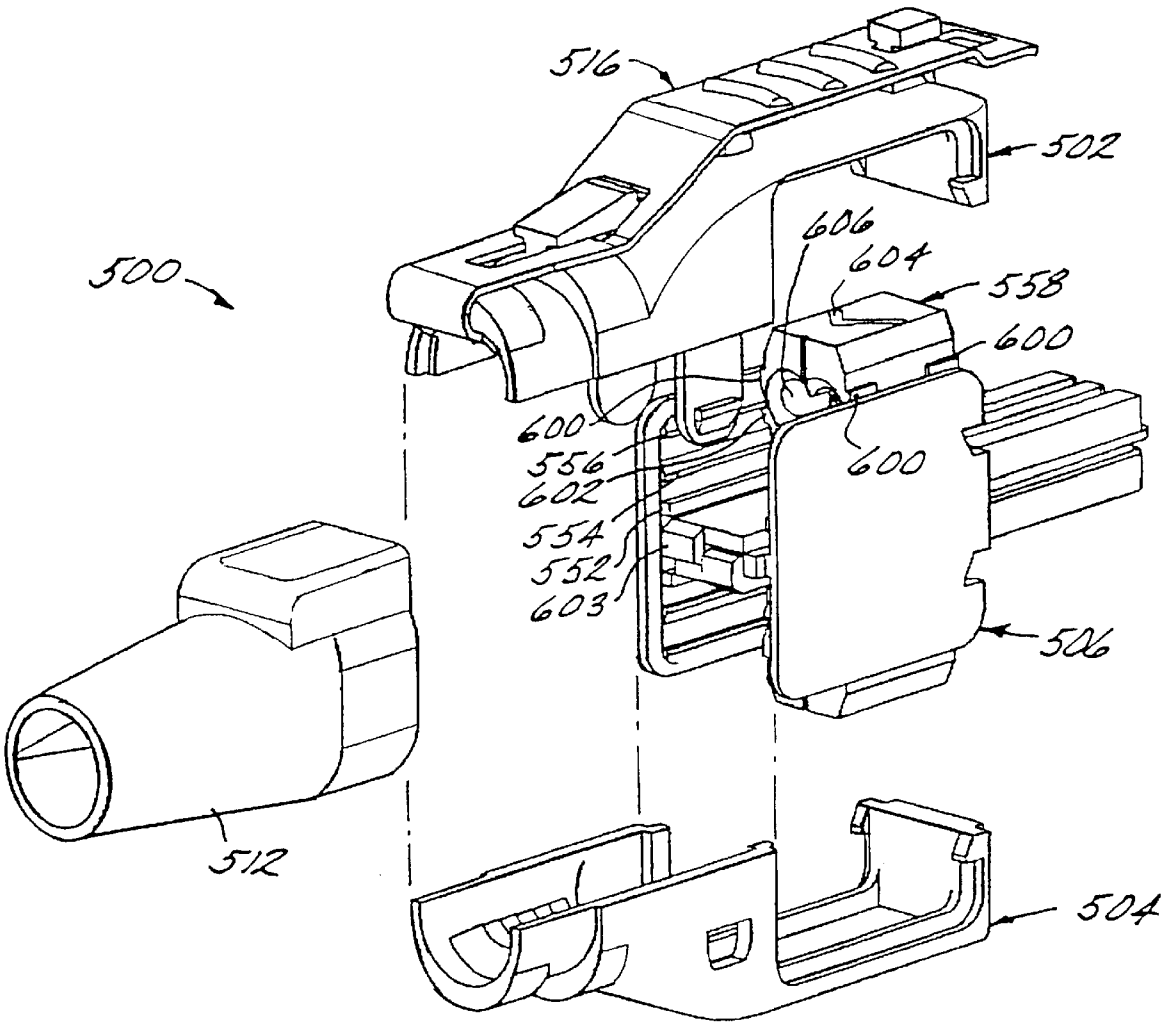
FIG. 36B is an exploded, perspective view of the plug of FIG. 33 including termination caps.

FIG. 36B is an exploded, perspective view of the plug 500 including termination caps 558. A termination cap is provided for each pair of contacts. As is known in the art, a termination cap forces wires onto an insulation displacement contact to pierce the insulation and electrically connect the wire and the insulation displacement contact. Termination cap 558 includes a first lip 600 and a second lip 602 that straddle ledges 554 and 556 on the plug core 506. The first lip 600 and second lip 602 have a beveled surface and first ledge 556 and second ledge 554 similarly have a beveled surface to facilitate installation of the termination cap 558 as disclosed below. Each termination cap 558 also includes a contact opening 604 for receiving the insulation displacement contacts 184 (shown in FIG. 5) and a pair of wire openings 606 for receiving wires from cable 514. The wire openings 606 are aligned with the insulation displacement contacts 184 (FIG. 5). The plug in FIG. 36B is shown in the state as received by the customer. Termination caps 558 are positioned in the plug core 506 and retained in a first position. First lip 600 rests upon first ledge 556 to hold the termination cap 558 in a first position and second lip 602 is positioned beneath first ledge 556 to prevent termination cap 558 from being inadvertently removed from the plug core 506.

Figure 37:
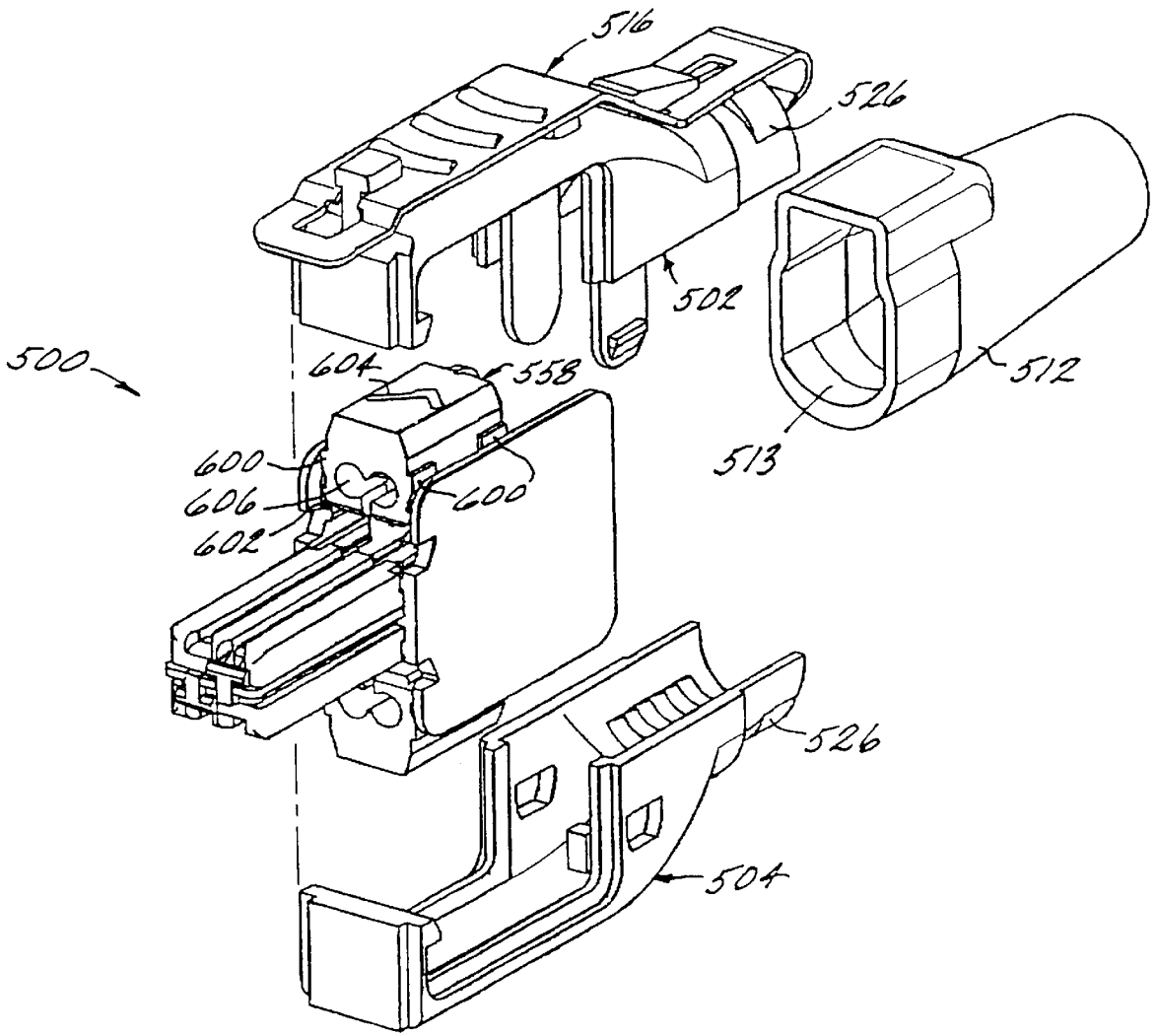
FIG. 37 is another exploded, perspective view of the plug of FIG. 33.

FIG. 37 is another exploded, perspective view of the plug 500. As shown in FIG. 37, each termination cap 558 is in the first position by virtue of first lip 600 and second lip 602 straddling first ledge 556. Boot 512 includes a cylindrical lip 513 that engages groove 526 in the top cover 502 and the bottom cover 504.

Figure 38:
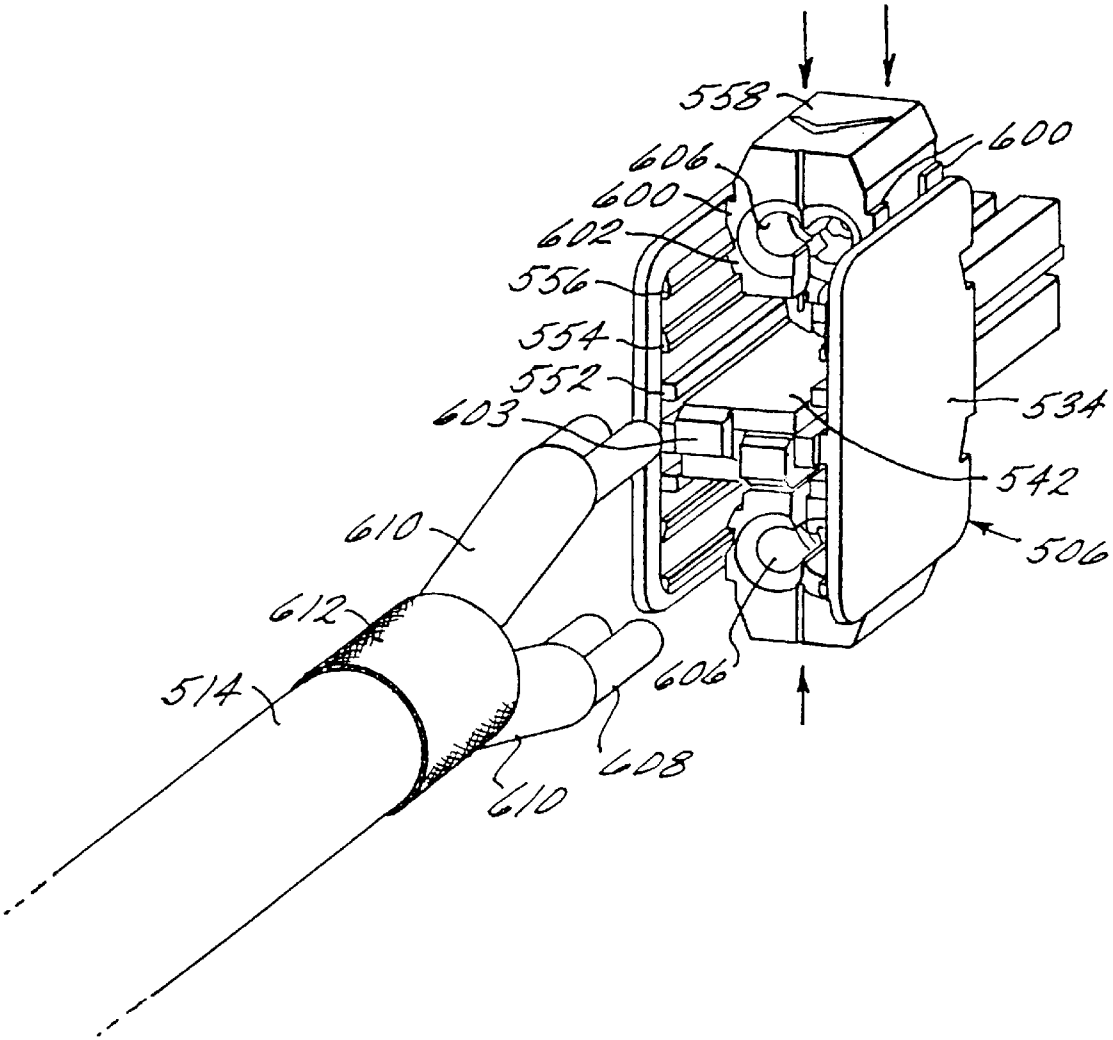
FIG. 38 is a perspective view of the assembly procedure for the plug of FIG. 33.

The installation of the wires into the plug 500 will now be described with reference to FIGS. 38–41. As shown in FIG. 38, cable 514 includes four wires 608. Each pair of wires 608 is encased by a wire pair shield 610. Ground layer 612 is also housed within cable 514 and is pulled back over the outside jacket of cable 514. Wires 608 are inserted into wire openings 606 in termination caps 558. As described above, each wire opening 606 is aligned with an insulation contact 184 and thus each wire is positioned above an insulation displacement contact 184 (shown in FIG. 5). It is understood that boot 512 is placed over cable 514 prior to inserting the wires into termination caps 558. Once the wires are positioned in the termination caps 558, force is applied to each termination cap towards the plug core 506 in the direction shown by the arrows in FIG. 38. A single hand tool can be used to apply force to all two termination caps 558 at the same time for easy installation.

Figure 39:
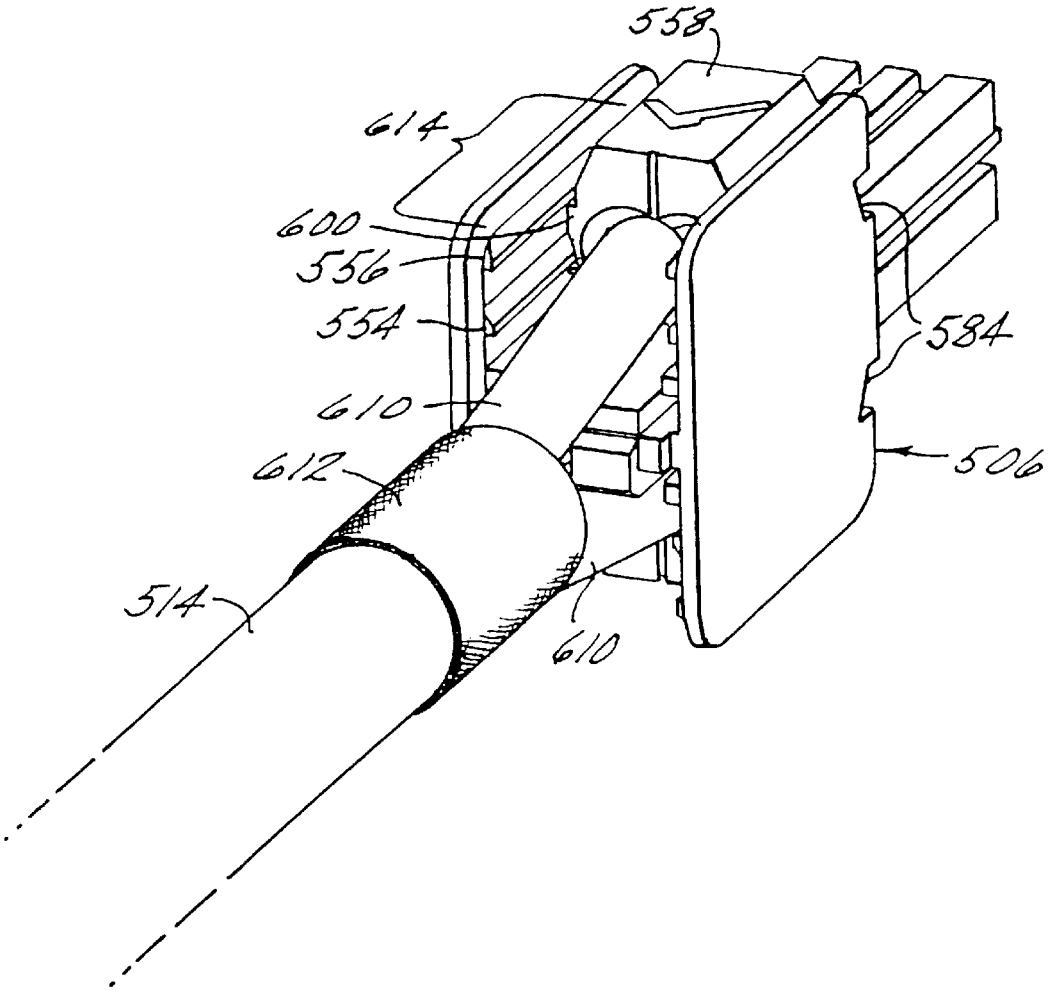
FIG. 39 is a perspective view of the assembly procedure for the plug of FIG. 33.

FIG. 39 shows the termination caps 558 in a second position. First lip 600 and second lip 602 now straddle second ledge 554 to hold the termination cap 558 in the second position. In this state, the wires 608 positioned in wire openings 606 are driven onto insulation displacement contacts 184. As is known in the art, the insulation displacement contacts 184 split the insulation on each wire 608 thereby making electrical contact between the wires 608 and the contacts 160. An important aspect of the invention shown in FIG. 39 is the use of a buffer zone 614. The length of the planar shield 532 extend beyond the rear of each termination cap 558 to establish a buffer zone 614. Each wire pair rests in the buffer zone 614. The buffer zone 614 is important because during installation, the wire pair shield 610 is removed so that individual wires can be inserted in wire openings 606. Even assuming the installer removed the exact recommended length of wire pair shield 610, a small amount of exposed wire will create cross talk between adjacent pairs at frequencies of greater than 600 MHZ. In non-ideal installations, the installer will remove too much of the wire pair shield 610. Thus, the buffer zone 614 reduces cross talk in ideal or non-ideal installations and enhances the connector performance. The buffer zone 614 should have a length, measured from the rear of the termination cap 558 greater than the length of exposed wire 608 (wire pair shield removed) in a worst case installation.

Figure 40:
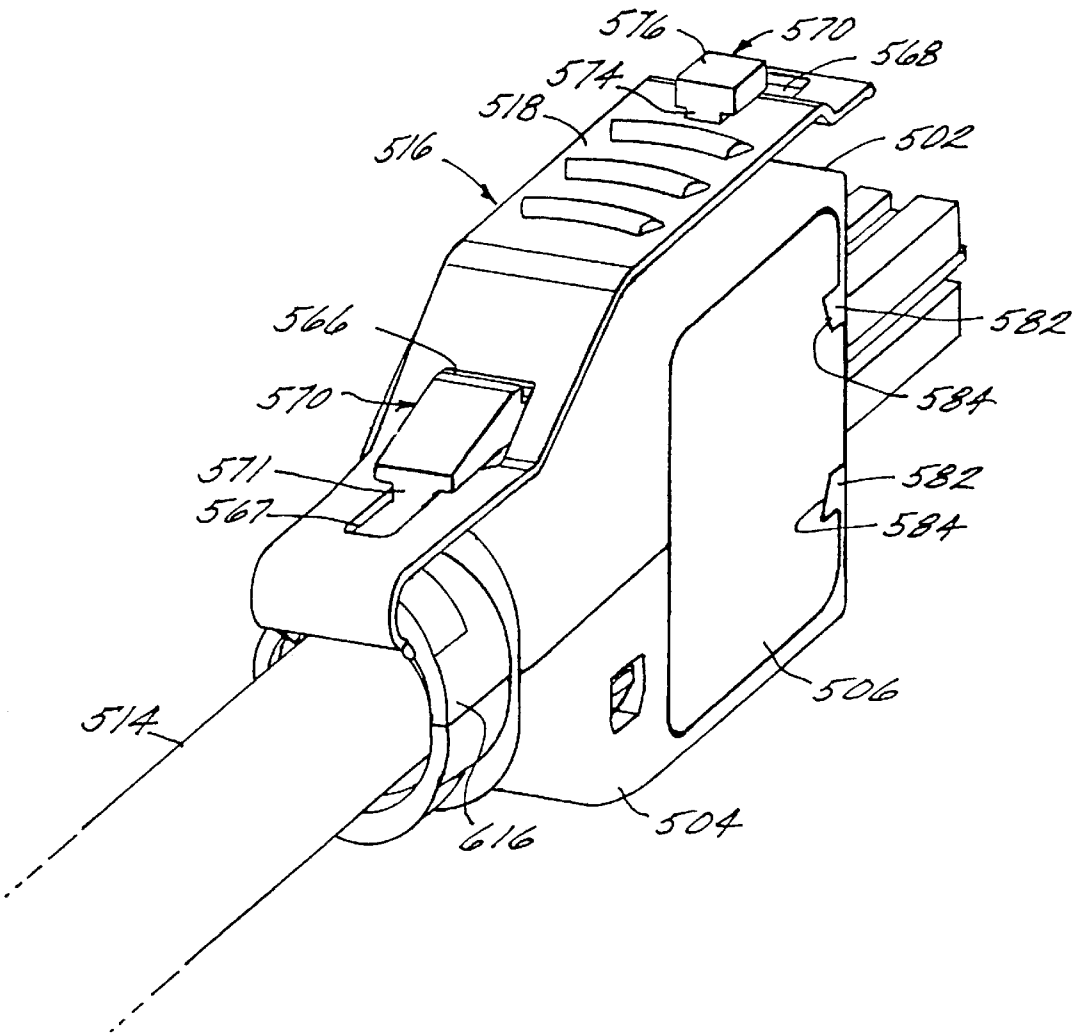
FIG. 40 is a perspective view of the assembly procedure for the plug of FIG. 33.
Figure 41:
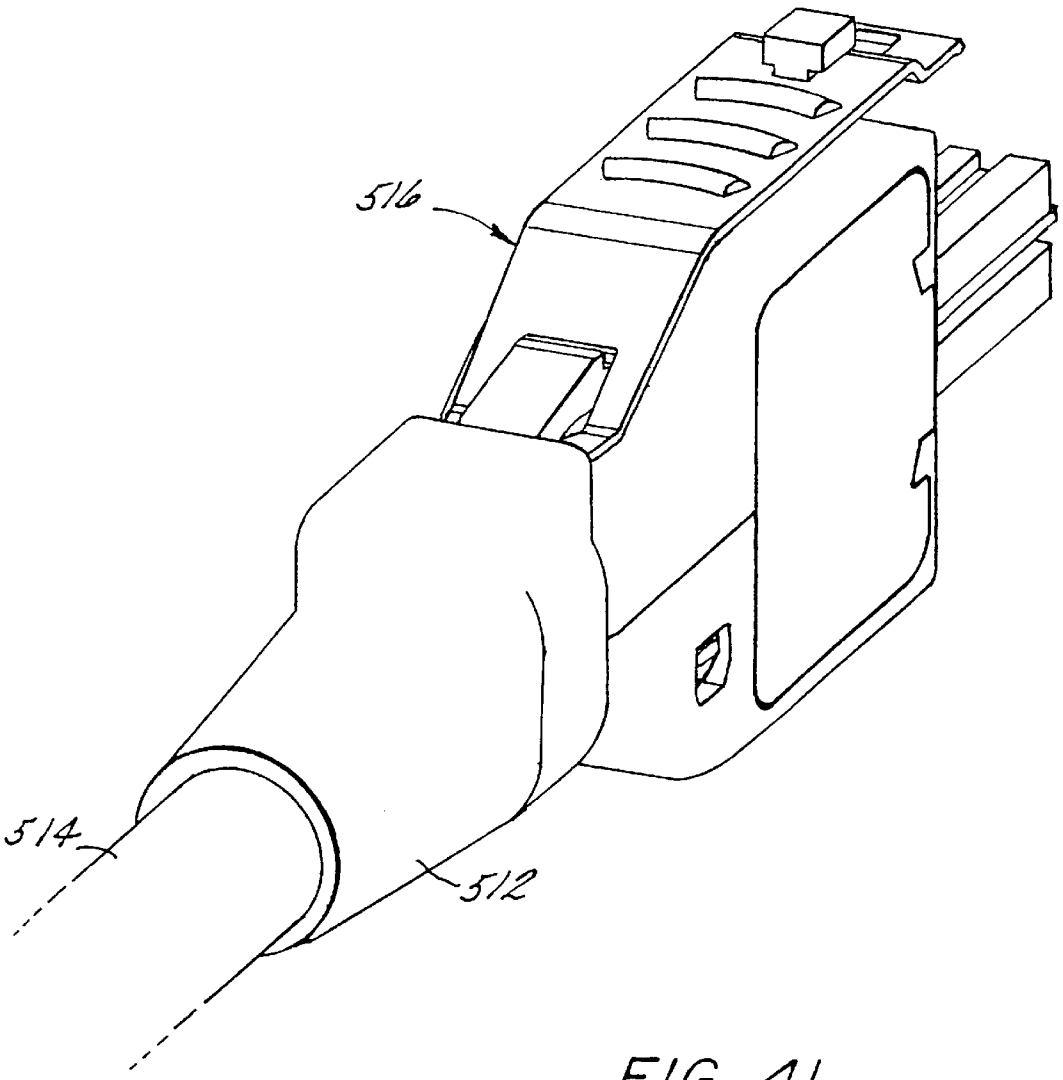
FIG. 41 is a perspective view of the assembly procedure for the plug of FIG. 33.

The next step in the installation process is the placement of the top cover 502 and bottom cover 504 on plug core 506 as shown in FIG. 40. Top cover 502 and bottom cover 504 each include projections 582 that engage similarly shaped recesses 584 on plug core 506 to secure the top cover 502 and bottom cover 504 to plug core 506. In addition, top cover latches 528 engage bottom cover openings 530 to secure the top cover 502 to the bottom cover 504. Latch 516 is secured to top cover 502 by aligning pawl 570 with first receiving opening 566 and slidably engaging neck 571 with slot 567 wherein slot 567 is integrally connected with first receiving opening 566. During the engagement of the latch 516 to the top cover 502, post 572 is received in second receiving opening 568 whereby the neck 574 of post 572 is slidably engaged with slot 569. Latch 516 is shown in FIG. 40 in a first position in which latch body 518 abuts against the head portion 576 of post 572 by virtue of latch 516 being constructed of a resilient material and due to the interlocking of neck 571 with slot 567. Shield contact 560 of latch 516 is disposed under neck 616 of top cover 502 so that shield contact 560 engages cable 514. Barbs 564 on shield contact 560 penetrate the ground layer 612 and the cable jacket to mechanically and electrically connect the shield contact 560 to cable 514. The final step in the plug assembly is securing the boot 512 to the plug 500. As shown in FIG. 41, the boot 512 is snapped onto the top and bottom covers. Lip 513 on the inside surface of boot 512 engages the groove 526 formed in top cover 502 and bottom cover 504.

Figure 42:
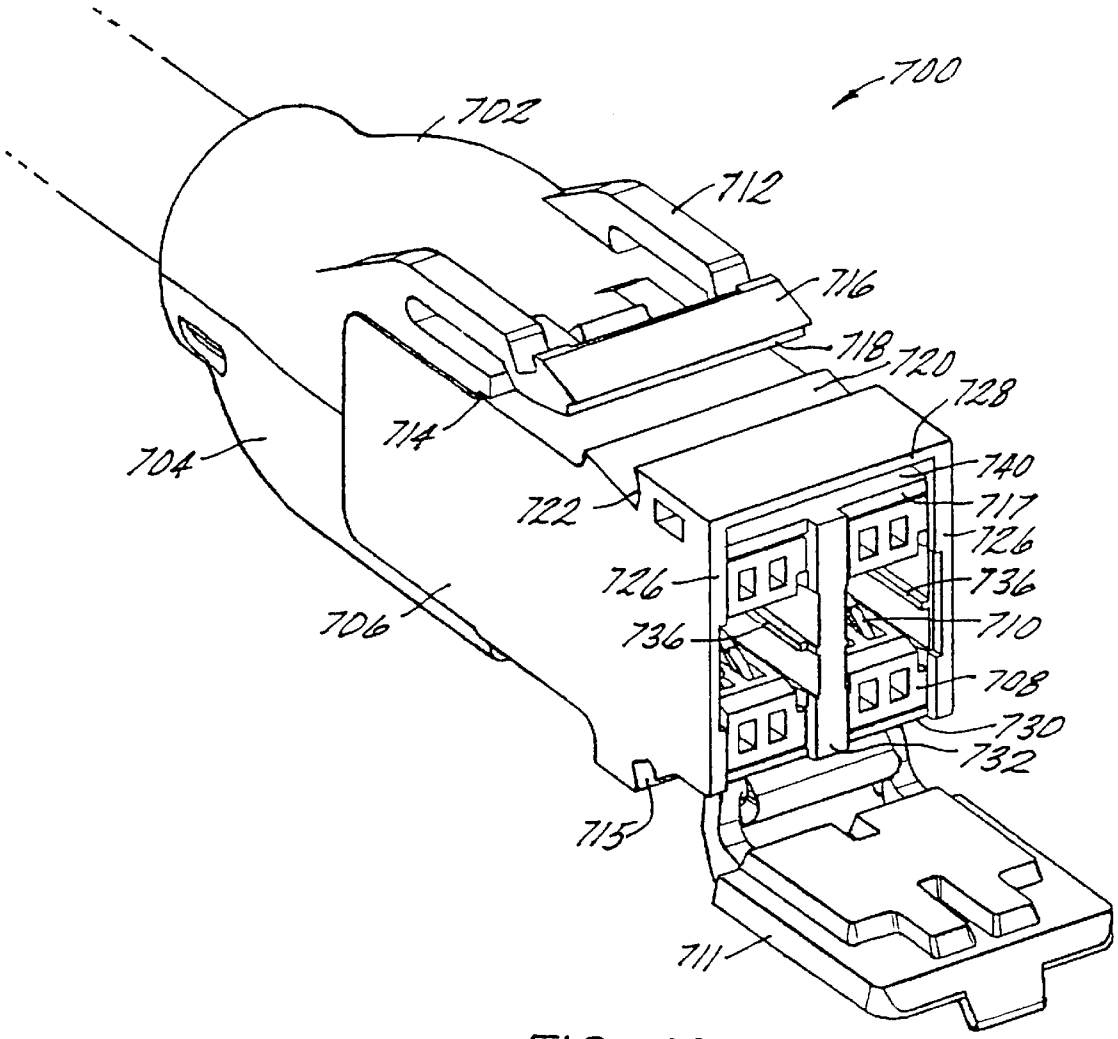
FIG. 42 is a perspective view of an outlet of a first alternate embodiment of the present invention.

FIG. 42 is a perspective view of an assembled outlet of a first alternative embodiment, shown generally as 700 wherein outlet 700 is for use with plug 500. Outlet 700 is similar to outlet 300 except that second planar shield 336 is replaced by vertical shield 732. The outlet 700 includes a top cover 702, bottom cover 704 and a core 706. The top cover 702, bottom cover 704, and core 706 are all conductive to provide shielding as described herein. These conductive components may be made from metal, metallized plastic or any other known conductive material. Core 706 supports insulative contact carriers 708. Each contact carrier includes contacts 710. An optional door 711 is also provided to prevent contamination (e.g. dust) from entering outlet 700.

Top cover 702 includes a pair of resilient arms 712 having notches 714 formed therein. Notches 714 receive the edge of a faceplate as described with reference to FIG. 23. Another notch 715 is formed on the bottom of outlet core 706 for receiving another edge of the faceplate. Notches 714 and 715 lie in a plane that is at an oblique angle relative to the front face 717 of outlet 700. When mounted in a faceplate, this directs the outlet toward the ground and provides for a gravity feed design. The gravity feed reduces the bend angle of the cable connected to plug 500 and reduces the likelihood that the cable will be bent beyond the minimum bend radius and cause signal degradation or loss. Alternatively, notches 714 and 715 may lie in a plane parallel to the front face 717 of outlet 700. A member 716 connects the ends of resilient arms 714 and includes a recess 718 on a front face thereof Recess 718 receives one edge of an identification icon 724 (shown in FIG. 43). The identification icon 724 rests on support surface 720 and engages a recess 722. Both the support surface 720 and recess 722 are formed on the outlet core 706.

The top cover 702 and bottom cover 704 of FIG. 42 are described herein with reference to FIGS. 14–16. The outlet core of FIG. 42 is generally rectangular and includes side walls 726, top wall 728, and bottom wall 730. One notable difference between outlet 300 of FIG. 13 and outlet 700 of FIG. 42 is a vertical planar shield 732 extending the entire length of outlet core 706 thereby dividing core 706 into a left and a right half for providing enhanced performance by isolation of the contact pairs. Each half is designed to receive a two-pair plug 500 of FIG. 33. Side walls 726 and vertical shield 732 include ribs 736 for engaging recesses 550 in planar shield 532 to create overlapping shield members.

Figure 47:
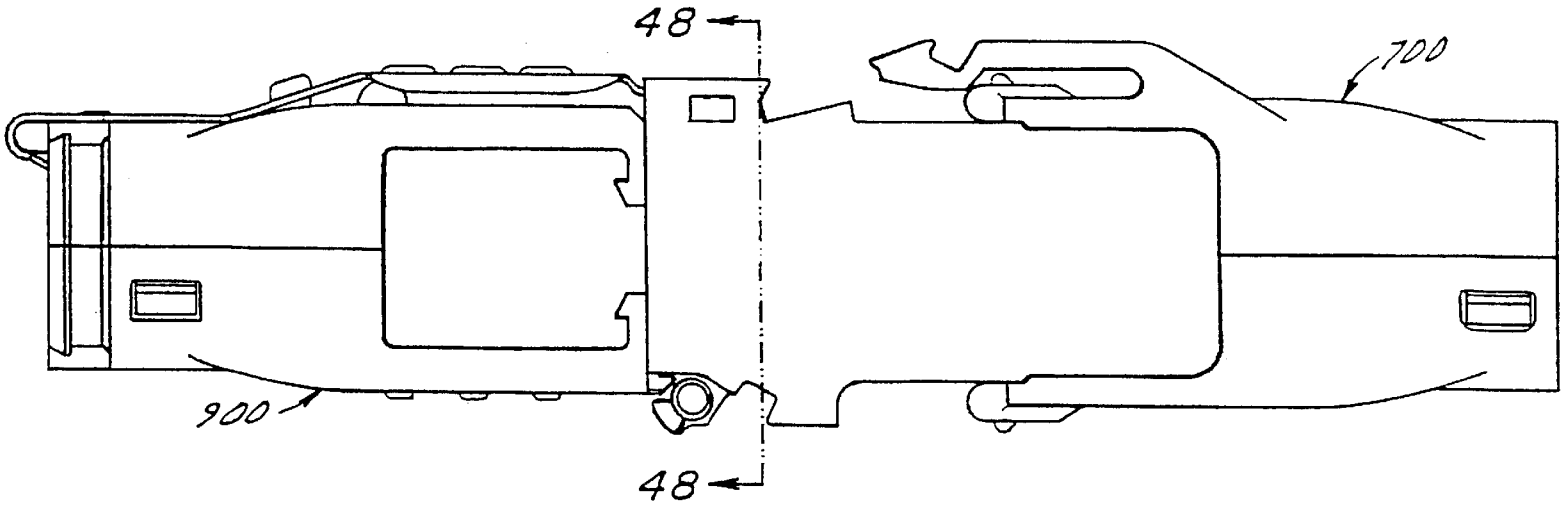
FIG. 47 is a side view of the plug of FIG. 44 and the outlet of FIG. 42.

An important feature of outlet 700 is the formation of opening 740 in outlet core 706. Opening 740 is designed to receive latch extension 524 of plug 500 and serves to lock plug 500 to outlet 700. Latch extension 524 is guided into opening 740 and as shown in FIG. 47, the underside of top wall 728 of outlet core 706 includes a lip 1200 (FIG. 59) for engaging opening 568 in latch extension 524. As latch extension 524 is inserted into opening 740, a beveled surface 1202 of the lip permits the latch extension 524 to slidably engage with the outlet core 706 by locking the latch extension 524 with a shoulder portion 1204 of the lip 1200. To release the plug 500, the latch 516 is pressed towards the top cover 502 to disengage opening 568 from lip 1200. In a similar fashion to outlet 300 of FIG. 13, the top cover 702, bottom cover 704 and core 706 of outlet 700 have overlapping joints to better isolate and shield the contact pairs so that enhanced performance results.

Figure 43:
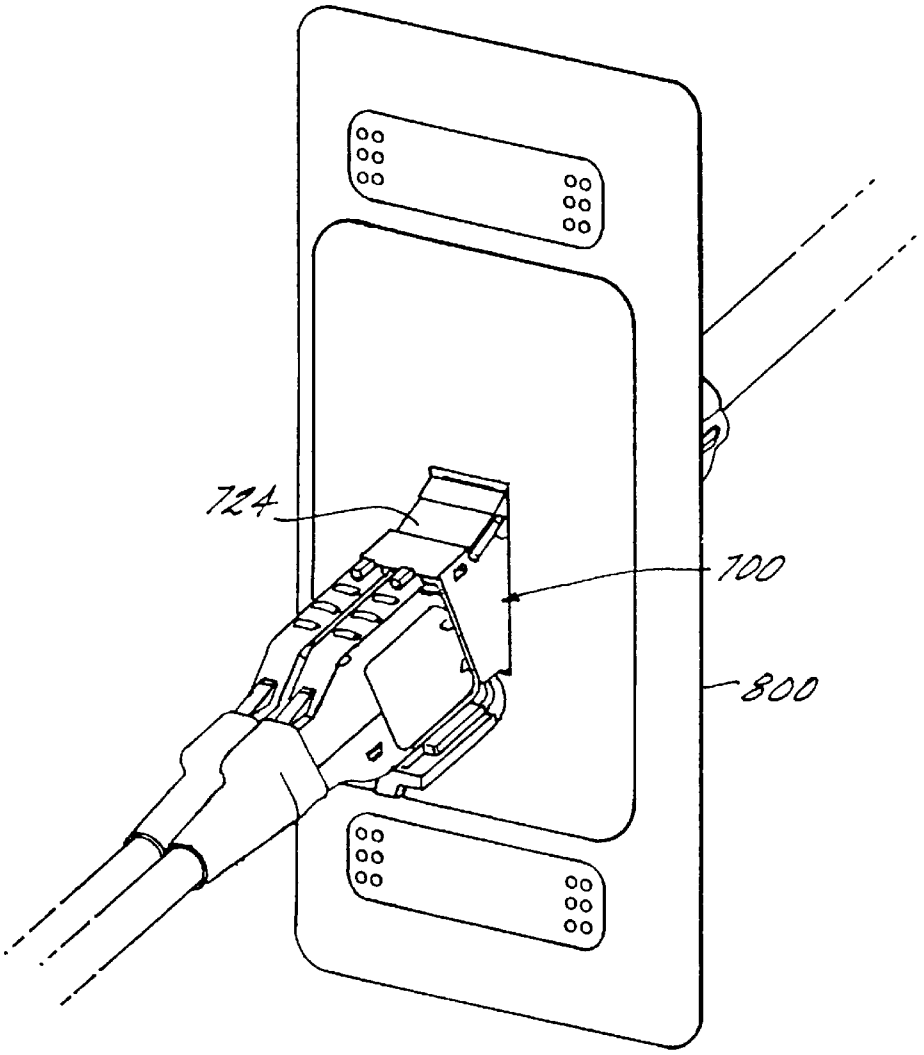
FIG. 43 is a perspective view of two plugs of FIG. 33 mated with the outlet of FIG. 42 mounted in the faceplate.

FIG. 43 is a perspective view of two plugs 500 of FIG. 33 mated with outlet 700. In FIG. 43, outlet 700 is mounted in a faceplate 800. The opening of outlet 700 is at an angle relative to the faceplate. This angle is established by notch 714 on the outlet top cover 702 and notch 715 on the outlet core 706 lying in a plane at an oblique angle relative to the face 717 of the outlet. As noted previously, this creates a gravity feed orientation in which the cable connected to a plug mated with outlet 700 is angled towards the floor thereby reducing the bend on the cable. This reduces the likelihood that the cable will be bent below the minimum bend radius. The identification icon 724 also serves as a lock securing the outlet 700 in the faceplate 800. To install the outlet 700 in the faceplate 800, the resilient arms 712 are deflected until both notch 714 and notch 715 are aligned with the edge of the faceplate opening. At this point, arms 712 return to their original position. When the identification icon 724 is positioned in recess 718 and recess 722, this prevents the arms 712 from deflecting towards outlet core 706 and thus locks the outlet 700 in position in the faceplate 800. In this embodiment, the use of two-pair plugs 500 in outlet 700 occupies the same amount of space as the use of one four-pair plug 100 in outlet 300, Advantageously, the user may select whether to insert one or two plugs 500 in outlet 700 without the need for concern about whether said installation will require additional space.

Figure 44:
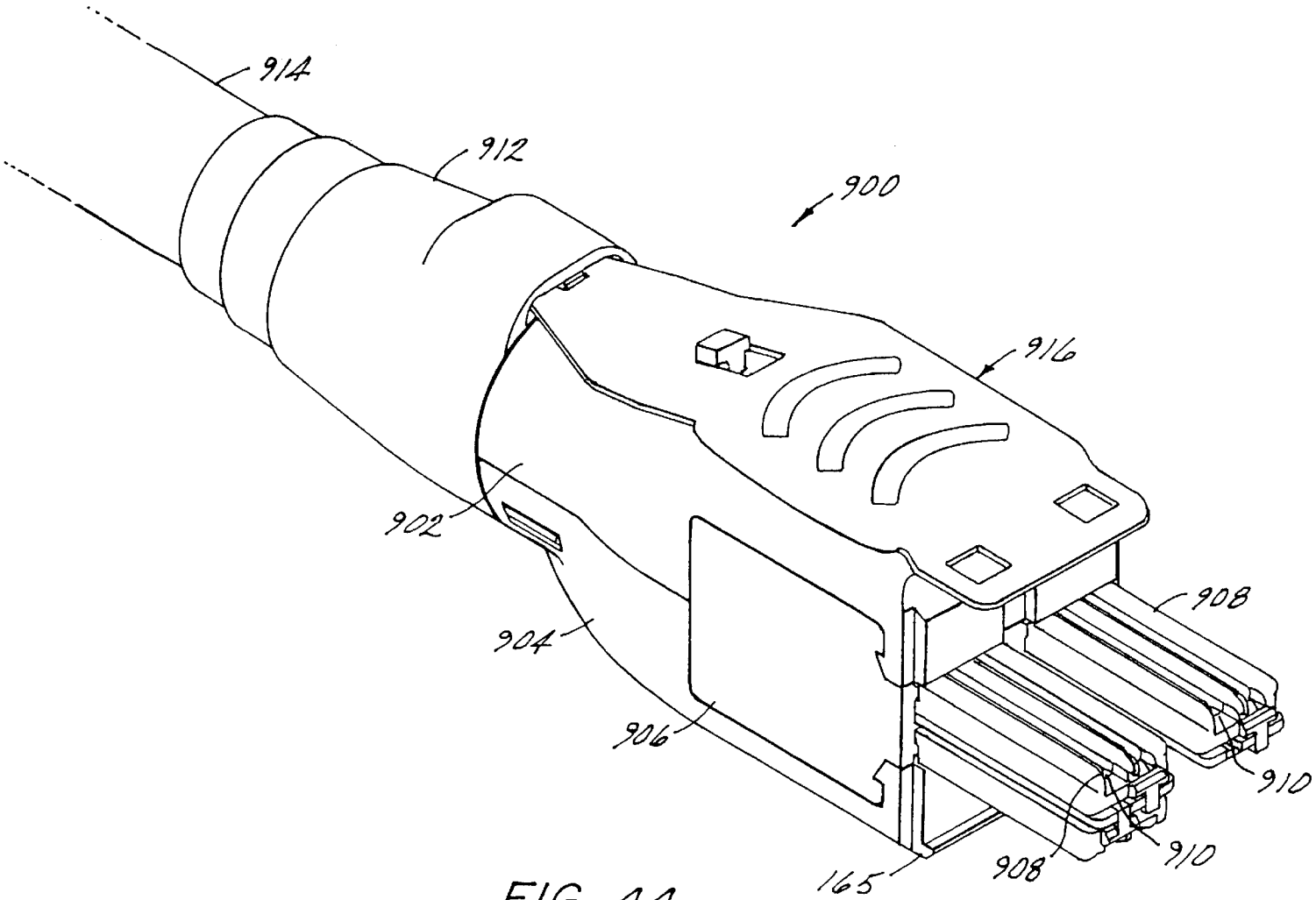
FIG. 44 is a perspective view of a plug of a second alternate embodiment in accordance with the present invention.

FIG. 44 is a perspective view of an assembled plug of a second alternative embodiment in accordance with the present invention, shown generally at 900. Plug 900 mates with outlet 700 and is generally similar to plug 100 described herein but includes a space in the first planar shield for accommodating vertical shield 732 in outlet 700. The plug 900 includes a top cover 902, a bottom cover 904 and a core 906. The top cover 902, bottom cover 904 and core 906 are all conductive to provide shielding as described herein. These conductive components may be made from metal, metallized plastic or any other known conductive material. Core 906 supports insulative (e.g. plastic) contact carriers 908. Each contact carrier 908 includes two contacts 910 defining a pair. A boot 912 provides strain relief and is made from a pliable plastic or rubber. Also shown in FIG. 44 is a cable 914 entering boot 912. A latch 916 is provided on the top cover 902 for coupling the plug 900 to the outlet 700 of FIG. 42 and described herein.

Figure 45:
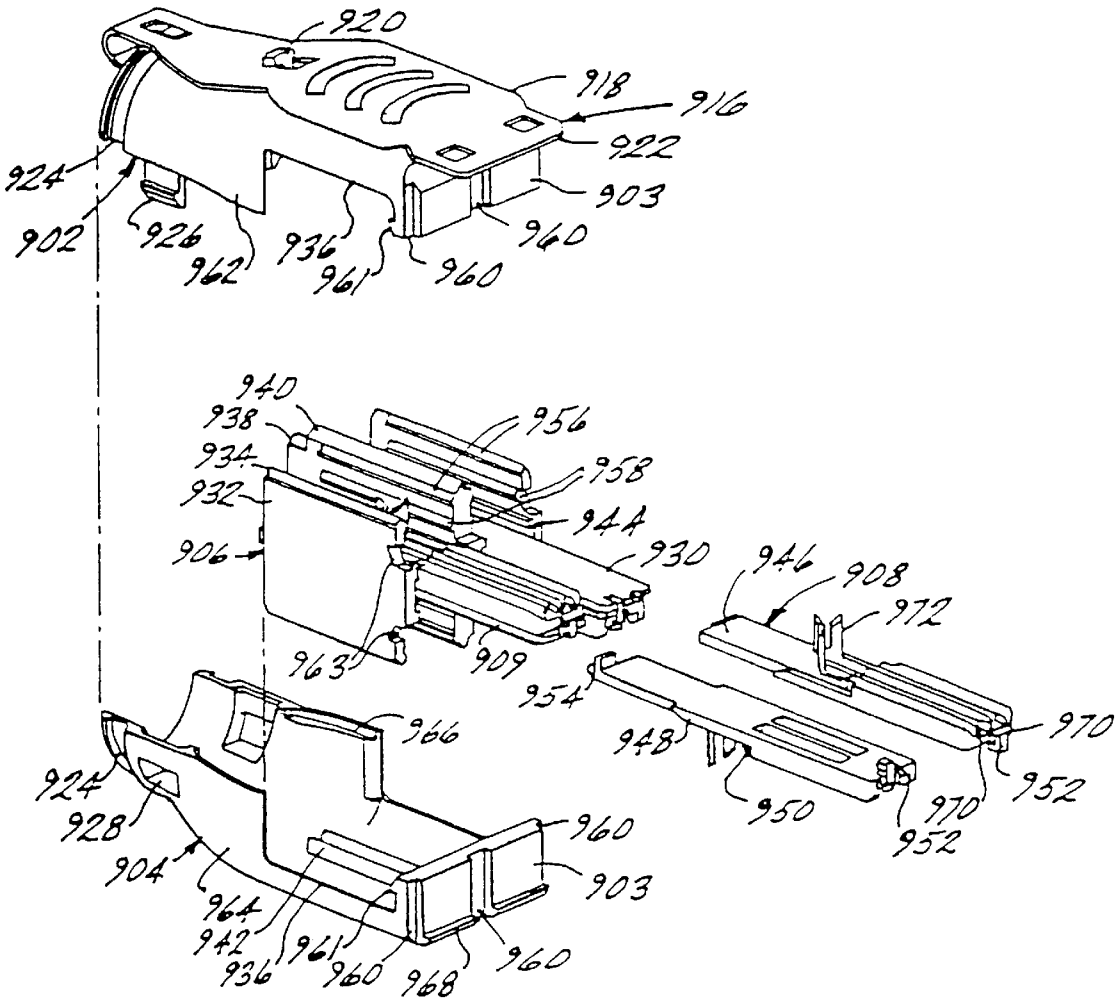
FIG. 45 is an exploded, perspective view of the plug of FIG. 44.

FIG. 45 is an exploded, perspective view of an alternative plug 900. Plug 900 is similar to plug 100 in that it includes four pairs of contacts. The first planar shield 930 (i.e. horizontal) includes an opening for receiving the vertical shield 732 in outlet 700. Latch 916 is made up of a latch body 918 secured to the top cover at latch engaging pawl 920. Latch 916 includes a latch extension 922 for engaging opening 740 formed in outlet 700. In addition to securing the plug 900 to outlet 700, latch extension 922 provides for electrical contact from the cable ground layer to the outlet core 706. Top cover 902 includes a semi-circular groove 924 and bottom cover 904 includes a similar semi-circular groove 924 that receives a circular lip in boot 912 (shown generally at 513 on boot 512 in FIG. 37) as described herein. Two top cover latches 926 engage two bottom recesses 928 to secure top cover 902 to bottom cover 904.

Plug core 906 includes a planar shield 930. Formed in planar shield 930 are recesses 909 (similar to recess 550) to receive ribs 736 in the outlet 700 to which plug 900 is mated. Plug core 906 also includes side walls 932. The top and bottom of each side wall 932 include a ridge 934. Ridges 934 extend beyond side wall 932 and overlap an edge 936 of the top cover 902 and bottom cover 904. Ridges 934 are shown as having generally triangular cross section, but it is understood that different geometries may be used without departing from the scope of the invention. Ridges 934 serve to locate the core 906 within the top and bottom covers and overlap the edges of the top and bottom cover to provide better shielding than a butt joint. A center shield 938 is provided within the core 906. Center shield 938 is parallel to side walls 932. The center shield 938 also includes a ridge 940 on the top and bottom surfaces. As shown in FIG. 45, central ridge 940 is triangular, however, it is understood that other geometries may be used without departing from the invention. Central ridge 940 engages channels 942 formed in top cover 902 and bottom cover 904.

Two ribs 944 are formed on the inside surface of each side wall 932 and are parallel and spaced apart from planar shield 930. Similar ribs are formed on each surface of center shield 938. Contact carrier 908 has a planar base 946 which rests on the planar shield 930. Base 946 includes two flanges 948 extending away from the base and a stop 950 adjacent to the flanges. When the contact carrier is installed in the core 906, flange 948 is placed under rib 944 to hold the contact carrier 908 to the planar shield 930. The contact carrier is slid into core 906 until stop 950 contacts the end of rib 944. In this position, a tab 952 is provided so that when contact carrier 908 is slid into core, tab 952 contacts a similarly shaped recess in planar shield 930 and positions contact carrier 908 in core 906. The contact carrier 908 also includes a lip 954 that extends substantially perpendicular to the planar base 946 and beyond the edge of planar shield 930 to prevent the contact carrier 908 from sliding out of core 906. The inside of each side wall 932 and each side of center wall 938 also include a first ledge 956 and a second ledge 958 which are used to secure a termination cap to the plug core 906. Similar to the bottom cover 904, a channel (not shown) is formed in the top cover 902 for receiving ridge 940 of center shield 938 on plug core 906. The front face 903 of plug 900 also includes three recessed areas 960 that receive extensions on the front face 717 of outlet 700 as described herein. Top cover 902 includes side wall recesses for receiving rear extensions on plug core 906 to create an overlap between the rear of plug core side wall 932 and the plug core top cover (not shown). As shown with respect to plug 100 of FIGS. 3 and 4, plug 900 also contains similar overlapping between wall extensions (not shown) on the side walls 962 of the top cover 902 and the outlet side wall recesses which engage each other to create overlap between the side walls 962 of the top plug cover 902 and the side walls 964 of the bottom cover 904. Bottom cover 904 and top cover 902 include projections 961 to engage similarly shaped recess 963 in side walls 932 of core 906.

Bottom cover 904 is similar to top cover 902. Bottom cover also includes a channel 942 for receiving ridge 940 on center shield 938. As noted above, this allows the central ridge 940 to be overlapped by the sides of the channel 942 and provides better shielding than a conventional butt joint. Bottom cover 904 includes side walls 964 having side wall recesses 966 for receiving side wall extensions (not shown) on top cover 902. The front face 903 of the bottom cover 904 is similar to that of top cover 902 and includes recesses 960 for receiving the vertical planar shield 732 of the outlet 700 whereby front face 903 of plug 900 engages with the vertical planar shield 732 in an overlapping manner. The front face 903 of bottom cover 904 also includes as lip 968, interrupted by recess 960, that overlaps the outside surface of the bottom wall 730 of the outlet core 706.

Contact carrier 908 includes two channels 970, each of which receives a contact 972. Each contact 972 has a generally planar body, a contact end and a termination end (as shown in FIG. 5). The termination end includes an insulation displacement contact that pierces the insulation of individual wires in cable 914 to make an electrical contact with the wire as is known in the art. Installation of the wires in the insulation displacement contact is described herein with reference to FIGS. 8–10. Each insulation displacement contact is angled relative to the longitudinal axis of the contact body at an angle of 45 degrees. As shown in FIG. 44, the plug 900 includes four contact carriers 908, each having a pair of contacts 972 for a total of eight contacts.

Figure 46:
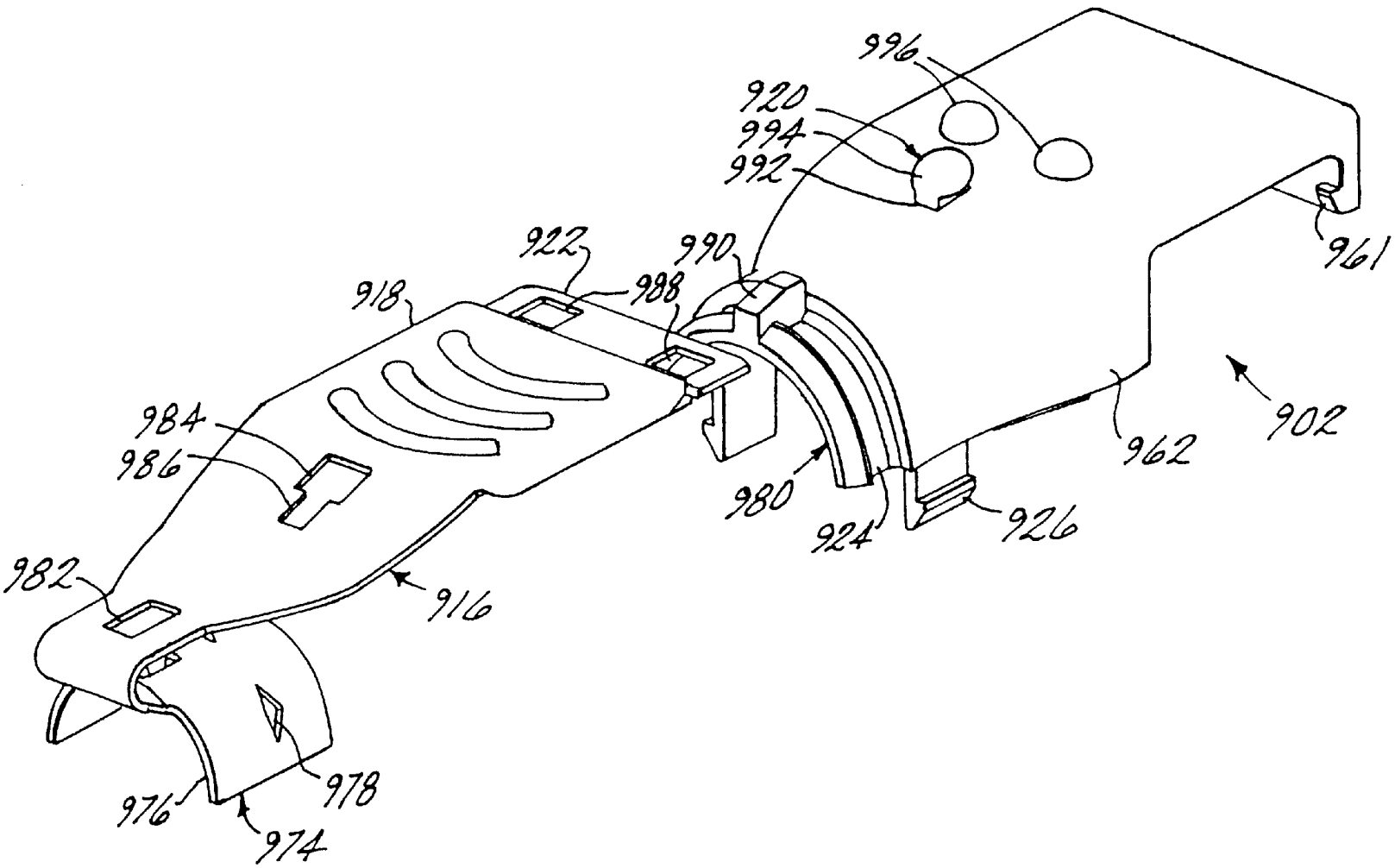
FIG. 46 is an exploded, perspective view of the top cover and latch of the plug of FIG. 44.

FIG. 46 is an exploded, perspective view of the top cover 902 and latch 916. Latch 916 includes a shield contact 974 which electrically connects the ground layer of cable 914 to the outlet core 706 of outlet 700. By employing the latch assembly of FIG. 46, a more direct electrical path from the cable ground layer to the outlet core 706 is realized in accordance with the present invention. Shield contact 974 is conductive and is preferably made from metal. Shield contact 974 has an arcuate portion 976 formed to generally follow the shape of cable 914. Arcuate portion 976 includes barbs 978 that pierce the ground layer of cable 914 and the cable jacket. This electrically and mechanically connects the shield contact 974 to cable 914. When latch 916 is coupled to top cover 902, arcuate portion 976 fits underneath neck 980 of top cover 902. Neck 980 is generally semi-circular in shape but is within the scope of this invention that neck 980 may have other forms but preferably neck 980 and shield contact 974 have similar shapes so that proper coupling between the two results when the latch 916 is engaged with the top cover 902. Latch 916 includes a first opening 982, a second opening 984 having a slot 986 integrally connected thereto, and a pair of third openings 988. First opening 982 is for receiving pawl 990 formed in top cover 902 and second opening 984 is for receiving post 920 formed in top cover 902. Post 920 includes a neck 992 and a head 994. Integrally connected to second opening 984 is a slot 986 for engaging neck 992 of post 920. Latch 916 is engaged with top cover 902 by aligning head 994 of post 920 with second opening 984 and aligning pawl 990 with first opening 982 and sliding the latch 916 in the direction toward post 920 so that neck 992 of post 920 slidably engages with slot 986 and pawl 990 is disposed within first opening 982. Top cover 902 also includes a pair of nubs 996 formed on top cover 902 wherein the latch body 918 contacts nubs 996 when the latch body 918 is pressed towards the top cover 902. Openings 988 engage lips 1200 formed in housing 700 as described above.

Figure 48:
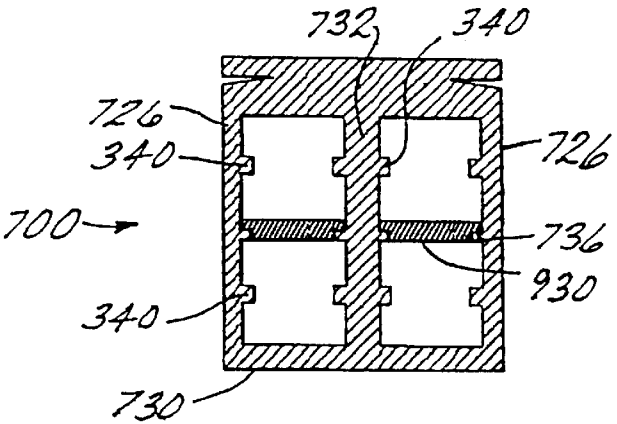
FIG. 48 is a cross sectional view taken along the line 48—48 of FIG. 47.

The enhanced telecommunications plug of FIG. 44 and outlet of FIG. 42 provide individually shielding of each pair of contacts. Overlapping between the components that shield each pair of contacts is provided thereby resulting in better shielding of the pairs of contacts than would result the junctions between the components were conventional butt joints. FIGS. 47–48 illustrate the overlapping of components. FIG. 47 is a side view of plug 900 and outlet 700. FIG. 48 is a cross-sectional view taken along line 48—48 of FIG. 47 and shows the overlap between various plug shield members and the outlet 700. Ribs 736 on outlet side wall 726 serve to secure plug 900 to outlet core 706. Ribs 736 serve to engage recesses 909 formed in planar shield 930 of plug 900 to allow planar shield to slidably enter outlet core 706 and be securely coupled to outlet core 706. Ribs 340 are formed on outlet side walls 726 and on vertical planar shield 732 of outlet core 706 to hold the contact carriers 708. In accordance with the present invention, each contact carrier is enclosed in a quadrant where all shield joints have some overlap and the amount of shielding between pairs is enhanced as compared to a shield arrangement using butt joints. The vertical planar shield 732 of outlet 700 and the planar shield 930 of plug 900 create the four quadrant system shown in FIG. 48, wherein each contact carrier is enclosed in a separate quadrant having the enhanced shielding characteristics disclosed herein.

Figure 49:
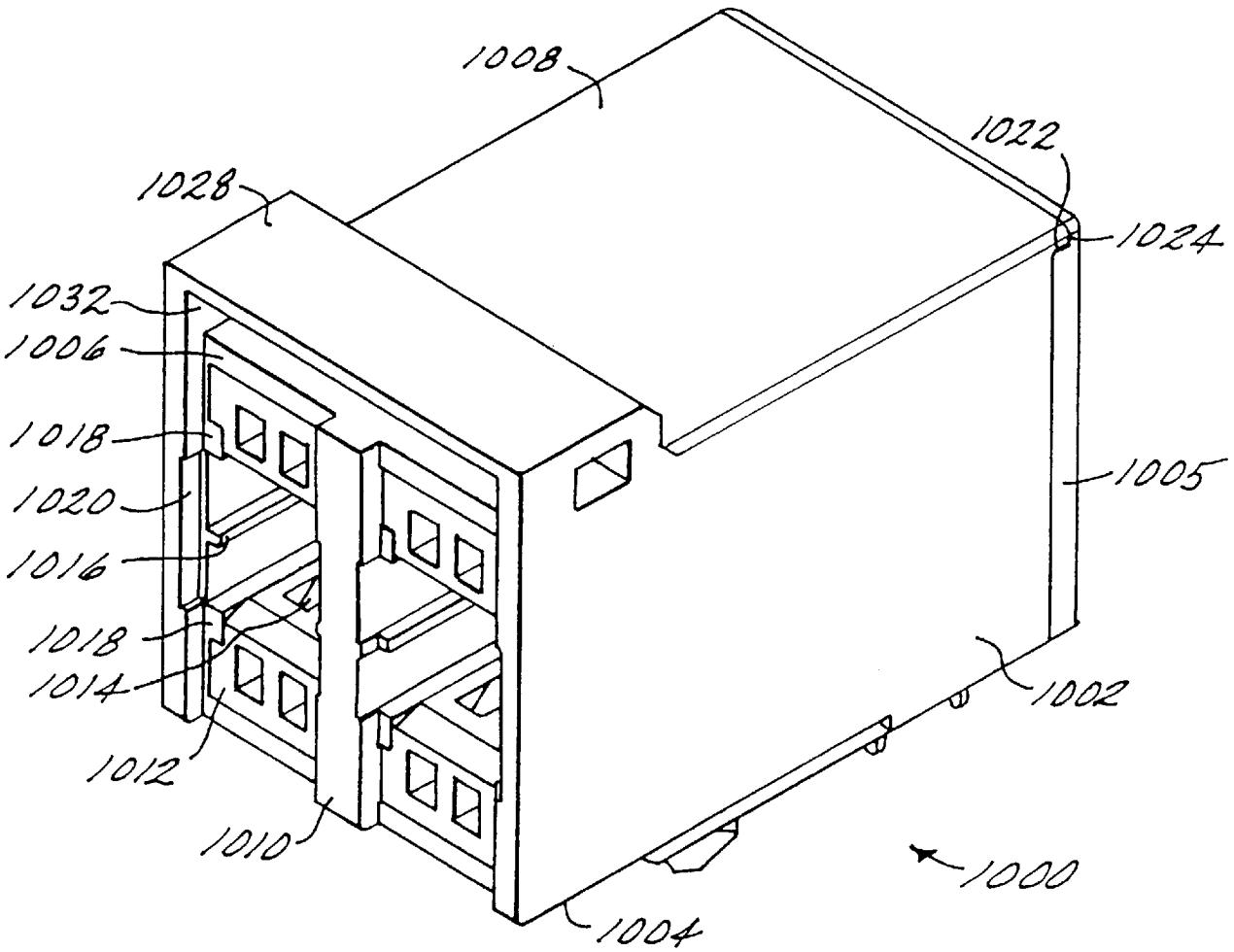
FIG. 49 is a perspective view of an outlet core suitable for use with a printed circuit board in accordance with the present invention.

FIG. 49 is a perspective view of an alternative outlet 1000 which is suitable for mounting on a printed circuit board. Outlet 1000 includes a top 1008, bottom 1004, sides 1002, rear cover 1005. The top 1008, bottom 1004, sides 1002 and rear cover 1005 are all conductive to provide shielding as described herein. These conductive components may be made from metal, metallized plastic or any other known conductive material. Outlet 1000 supports insulative contact carriers 1012. Each contact carrier 1012 includes contacts 1014.

The outlet 1000 is generally rectangular and includes a vertical planar shield 1010 which extends substantially the entire length of outlet 1000 thereby dividing outlet 1000 into a left and aright half. Vertical planar shield 1010 serves to isolate the contact pairs and thereby enhance the performance of the connector. Each half is designed to receive a two-pair plug 500 of FIG. 33. While the description of outlet 1000 makes reference to plug 500, it is understood that outlet 1000 may be used to mate with plug 900 in a similar manner. Side walls 1002 and vertical planar shield 1010 include ribs 1016 for engaging recess 550 formed in planar shield 532 of plug 500 to create an overlap between the outlet and plug shield members.

Figure 59:
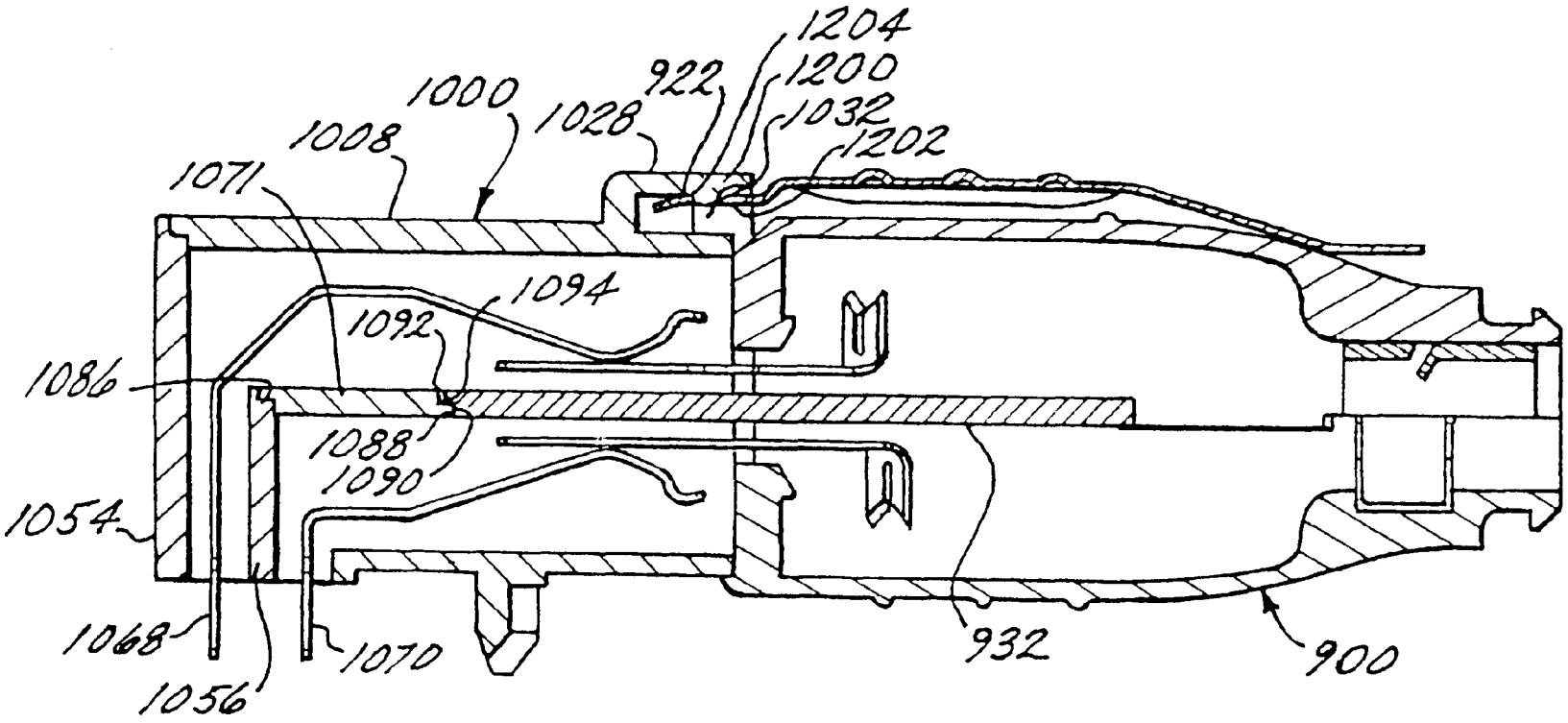
FIG. 59 is a cross-sectional view taken along the line 59—59 of FIG. 58B.

An important feature of outlet core 1000 is the formation of opening 1032 in the outlet 1000. Opening 1032 is created by hood 1028 having four sides and positioned on top 1008. Opening 1032 is designed to receive latch extension 524 of plug 500 and serves to lock plug 500 to outlet 700. Latch extension 524 is guided into opening 1032 and as shown in FIG. 59, the underside of hood 1028 includes a lip portion 1200 for engaging latch extension 524. As latch extension 524 is inserted into opening 1032, the beveled surface 1202 of the lip permits the latch extension 524 to slidably engage with the outlet 1000 by locking the latch extension 524 with the shoulder portion 1204 of the lip. Top 1008 of outlet 1000 includes a lip 1022 to engage similarly shaped recess 1024 in rear cover 1005.

Figure 50:
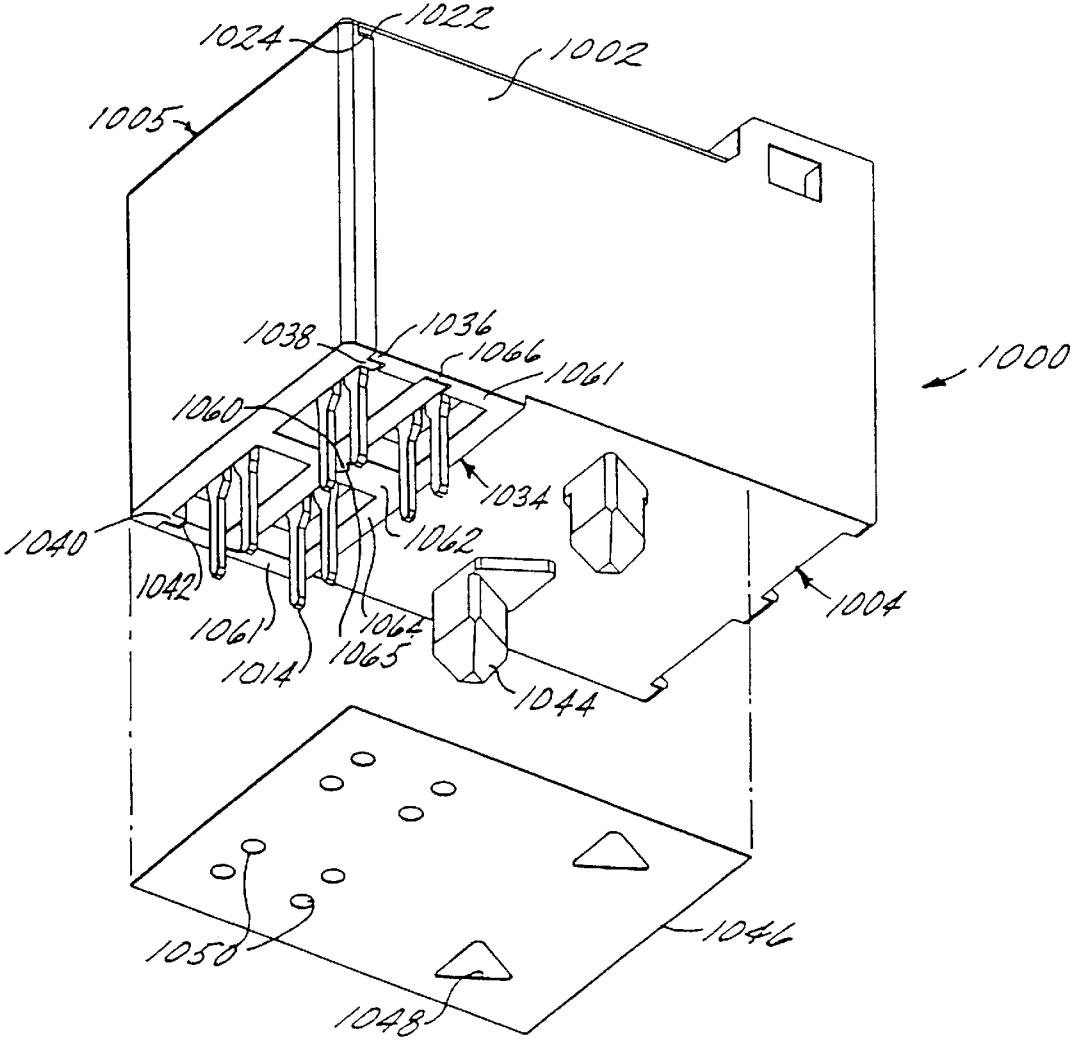
FIG. 50 is a perspective view of the core of the outlet of FIG. 49.

FIG. 50 is a perspective view of the bottom of outlet 1000. Bottom 1004 includes a rear stepped portion 1034 extending outwardly. Sides 1061 of rear stepped portion are an extension of side wall 1002 and center 1062 of the stepped portion is an extension of the vertical shield 1010. Sides 1061 and side walls 1002 have a lip 1036 to that overlaps a ridge 1040 formed on rear cover 1005. Sides 1061 also contain a recess 1066 to engage inner shield 1056 of rear cover 1005 (as shown in FIG. 51).

Extending from the bottom 1004 of core 1000 are a pair of posts 1044 for securing the outlet 1000 to a circuit board. Posts 1044 are shown as being generally triangular in shape however it is within the scope of the invention that other shaped are suitable. Also shown in FIG. 50 is an insulating film 1046 having first openings 1048 for receiving posts 1044 and second openings 1050 for receiving contacts 1052.

Figure 51:
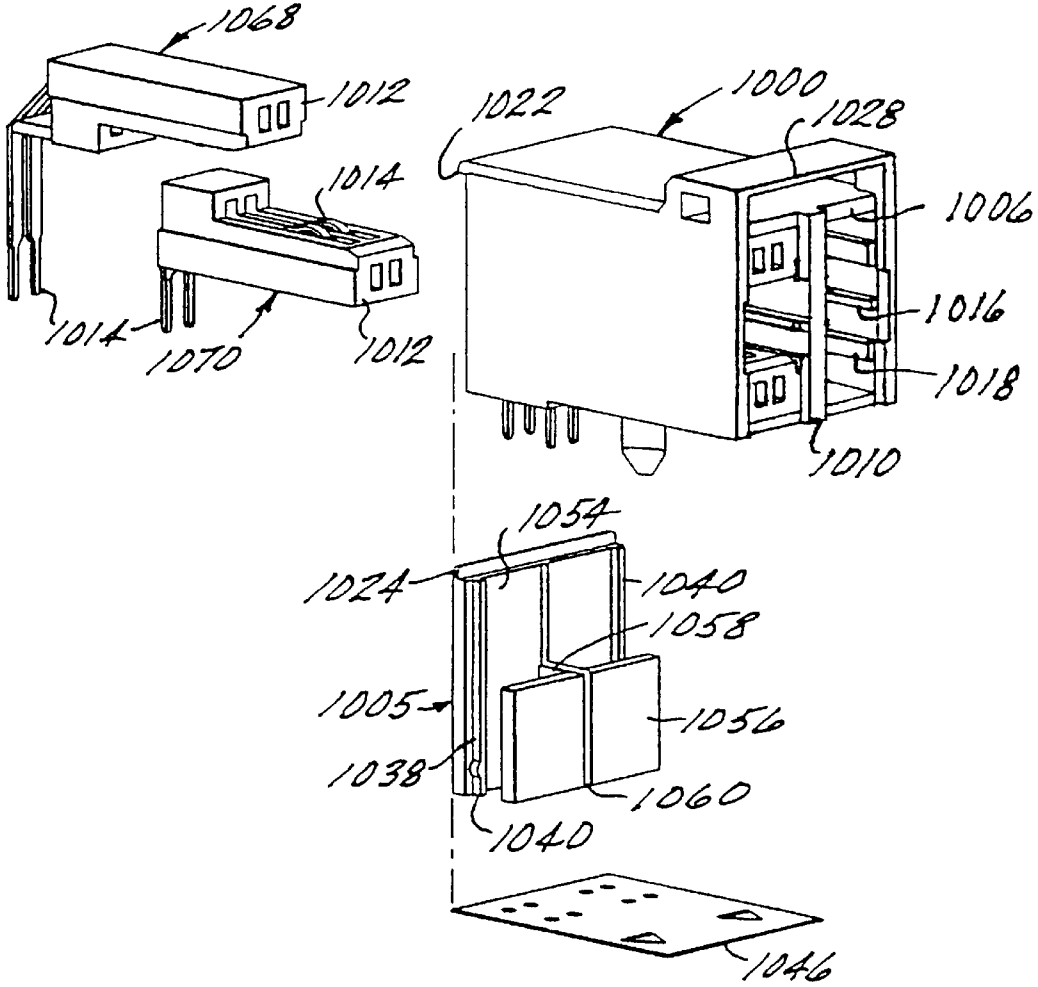
FIG. 51 is an exploded, perspective view of an outlet for use with a printed circuit board.
Figure 52:
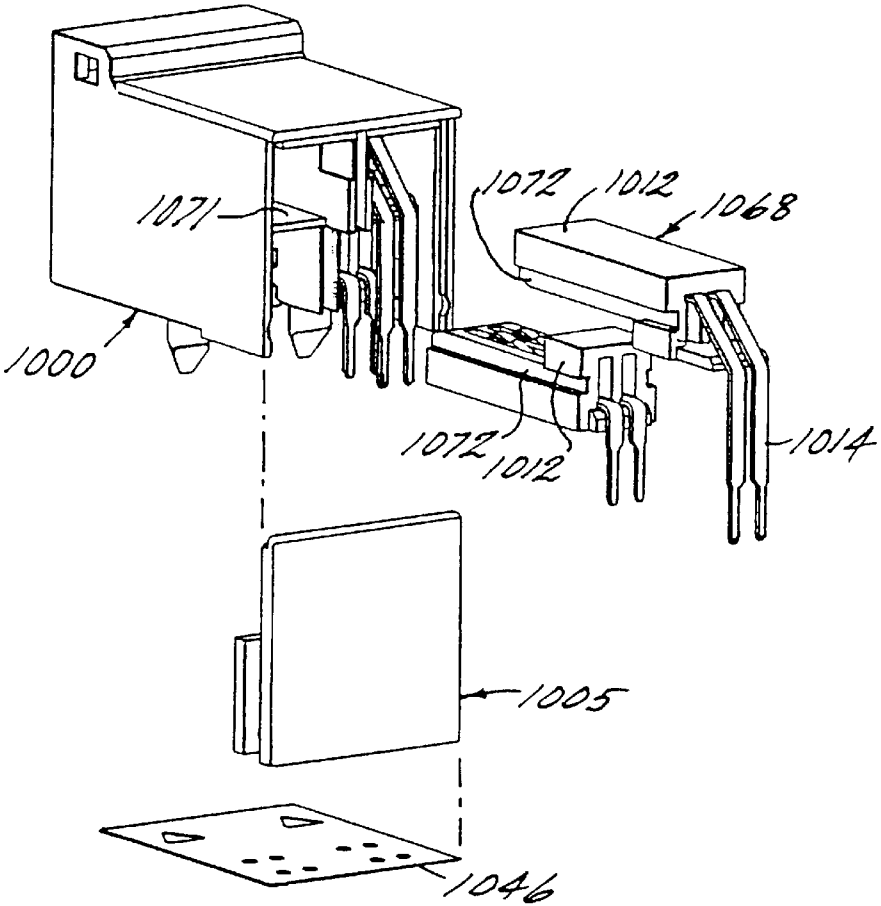
FIG. 52 is another perspective view of the outlet of FIG. 51.
Figure 53:
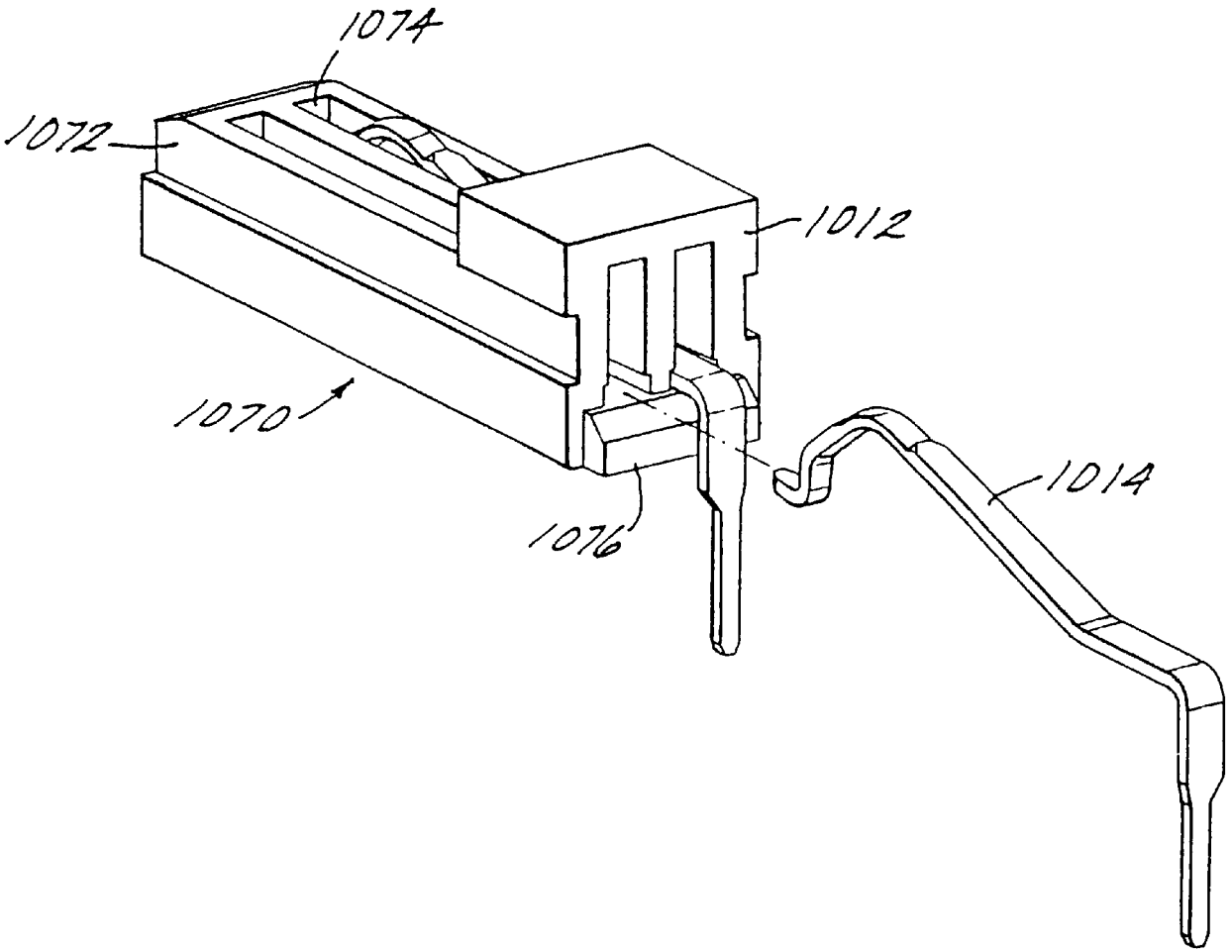
FIG. 53 is a perspective view of the bottom contact carrier of the outlet of FIG. 51.
Figure 54:
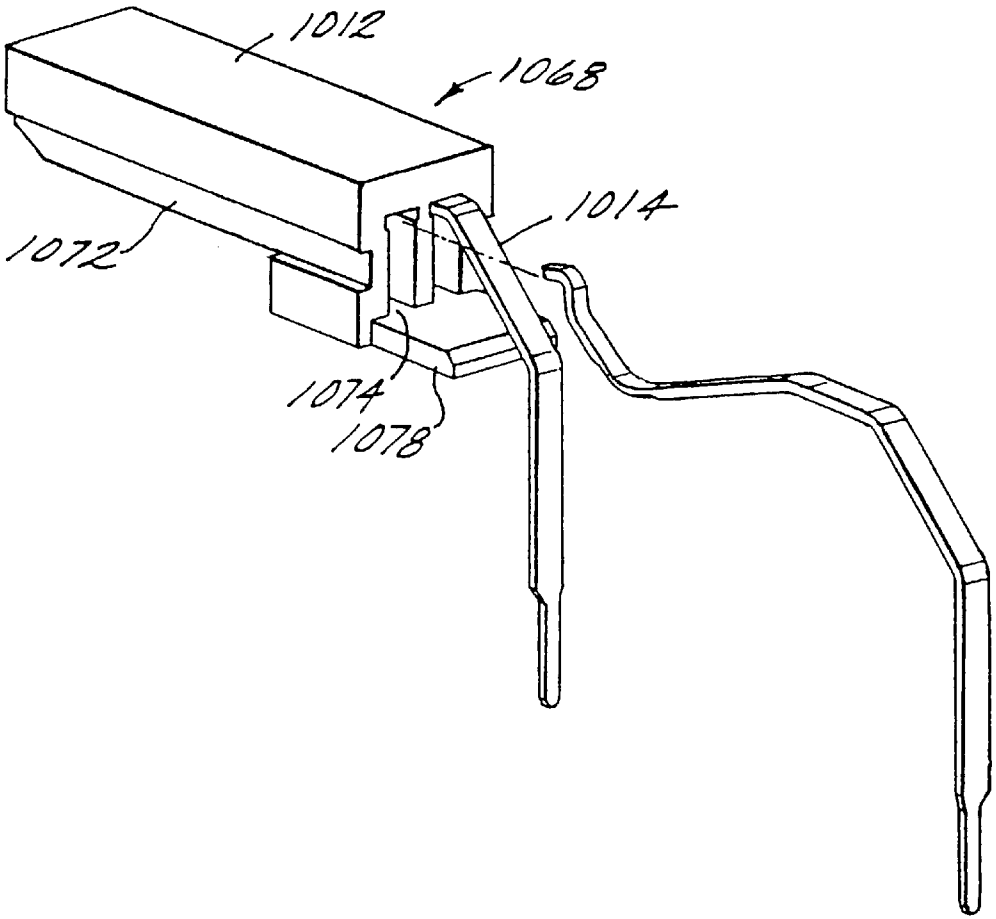
FIG. 54 is a perspective view of the top contact carrier of the outlet of FIG. 51.

FIG. 51 is an exploded, perspective view of outlet 1000. Rear cover 1005 comprises an outer shield 1054 and an inner shield 1056 which is substantially parallel to outer shield 1054. Between outer shield 1054 and inner shield 1056 is center shield 1058 which is integrally connected to outer shield 1054 and inner shield 1056. Center shield 1058 is substantially perpendicular to outer shield 1054 and inner shield 1056. Rear cover 1005 provides for electrical shielding between top contacts 1068 and bottom contacts 1070. Together with the planar shield of the plug to be mated with outlet 1000 and the center member 1062 of the rear stepped portion 1034 effective, continuous shielding is provided between pairs of contacts within outlet 1000. A quadrant system is presented in accordance with the present invention whereby each pair of contacts is provided in a quadrant electrically shielded from the other contact pairs by the outlet 1000 of the present invention and the overlapping structural seams therein. Outer shield 1054 includes recess 1024 for receiving similarly shaped lip 1022 of the top 1008. Outer shield 1054 also includes two ridges 1040 for overlapping lip 1036 for in side walls 1002 and extensions 1061. Inner shield 1056 has a central ridge 1060 for engaging a similarly shaped recess 1065 of center member 1062 of rear stepped portion 1034 and shield 1010. When rear cover 1005 is inserted into outlet 1000 overlapping between the seams of the rear cover 1005 and the outlet 1000 results whereby each pair of contacts 1014 is enclosed in a quadrant where all shield joints have some overlap and the amount of shielding between pairs is enhanced as compared to a shield arrangement using butt joints. Also shown in FIG. 51 is a top contact assembly 1068 and a bottom contact assembly 1070. Contact 1014 within contact carrier 1012 is positioned so that the contact is substantially perpendicular to the contact carrier 1012 when contact 1014 is travels downward through each quadrant defined by the overlap between rear cover 1005 and FIGS. 52 is a further exploded perspective view of outlet 1000 illustrating the rear of the outlet 1000 and the perpendicular bend of contacts 1014. A horizontal shield 1071 is provided within outlet 1000 for engaging the planar shield of the plug (e.g. planar shield 932 of plug 900). As shown in FIG. 59, horizontal shield 1071 at one end has a recess 1086 to engage the inner shield 1056 and at the other end has a lip 1088 to engage a similarly shaped recess 1090 in the planar shield of the plug and has a recess 1092 to engage a similarly shaped lip 1094 in the planar shield. Recess 1072 in contact carrier 1012 is for engaging rib 1018 in the outlet core 1000 to allow contact carrier 1012 to slidably enter outlet core 1000 and be securely coupled to outlet core 1000. FIG. 53 is a perspective view of bottom contact assembly 1070. Bottom contact assembly 1070 includes a contact carrier 1012 with recess 1072 and contact 1014 disposed within channel 1074. Bottom contact assembly 1070 further includes a shelf 1076. Contact 1014 is bent down over shelf 1076 and directed downward whereby each contact is angled relative to the longitudinal axis of the contact body at an angle of about 90°. FIG. 54 is a perspective view of top contact assembly 1068. Top contact assembly 1068 includes a contact carrier 1012 with recess 1072 and contact 1014 disposed within channel 1074. Top contact assembly 1068 further includes an extended shelf 1078. Contact 1014 is bent down over shelf 1078 and directed downward whereby each contact is angled relative to the longitudinal axis of the contact body at an angle of about 90°.

Figure 55:
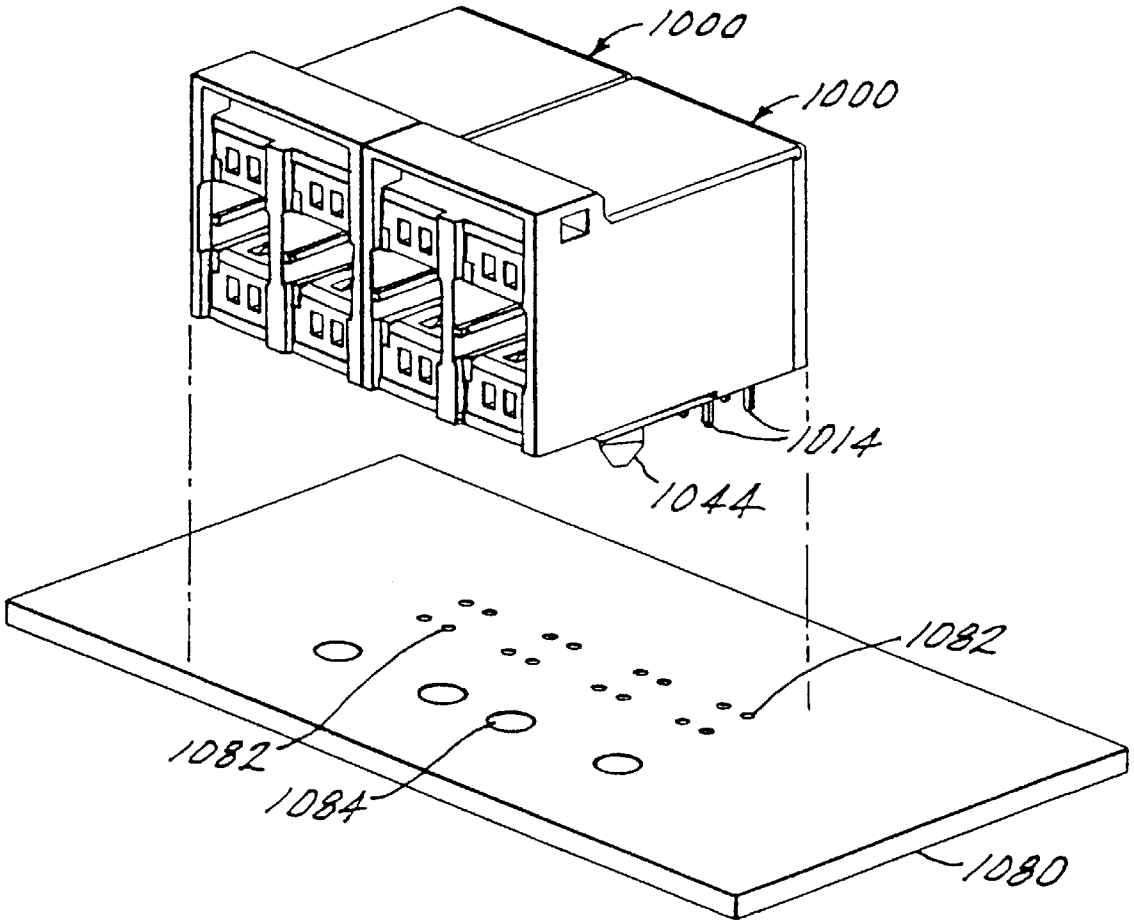
FIG. 55 is a perspective view of the assembly of two printed circuit board outlet cores of FIG. 49 onto a simplified printed circuit board.
Figure 56:
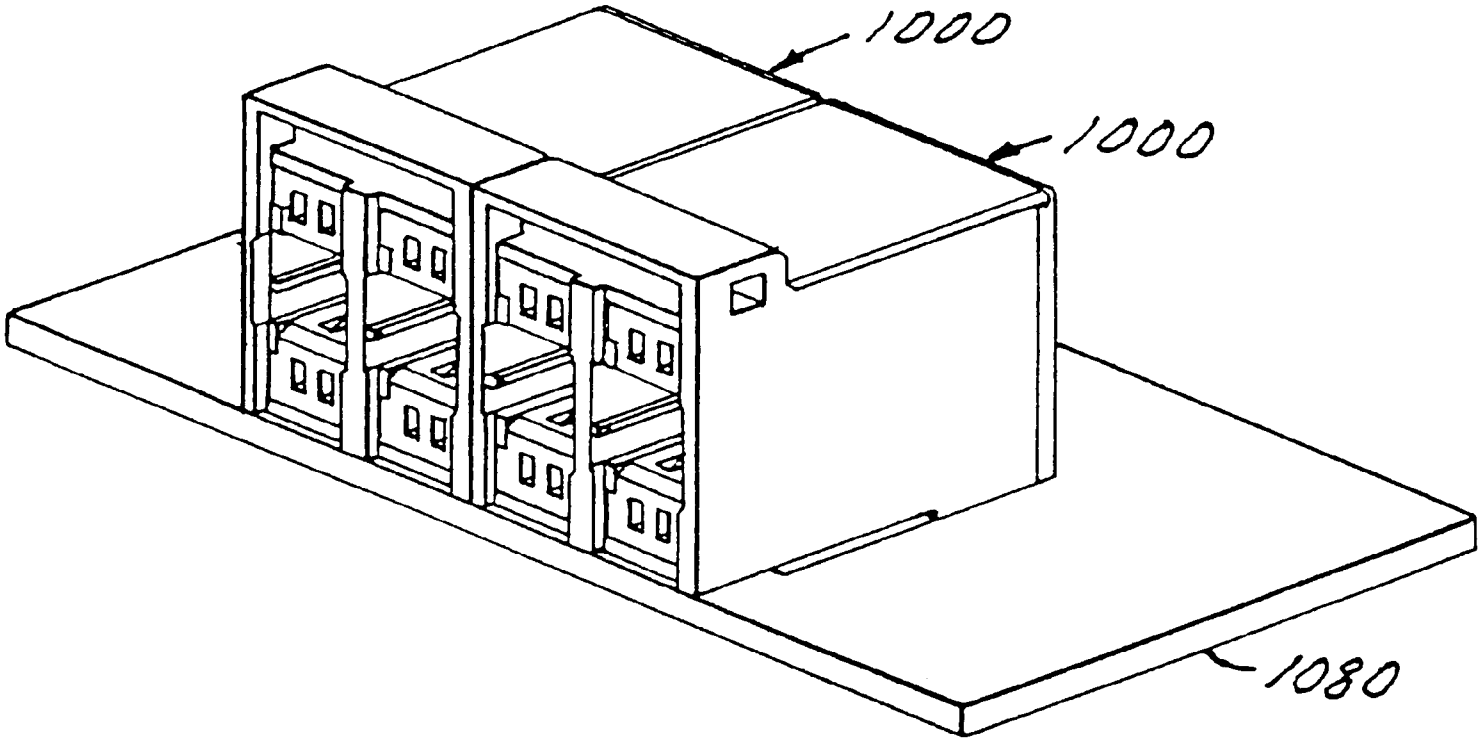
FIG. 56 is a perspective view of the assembly of two printed circuit board outlets of FIG. 49 onto a simplified printed circuit board.
Figure 57:
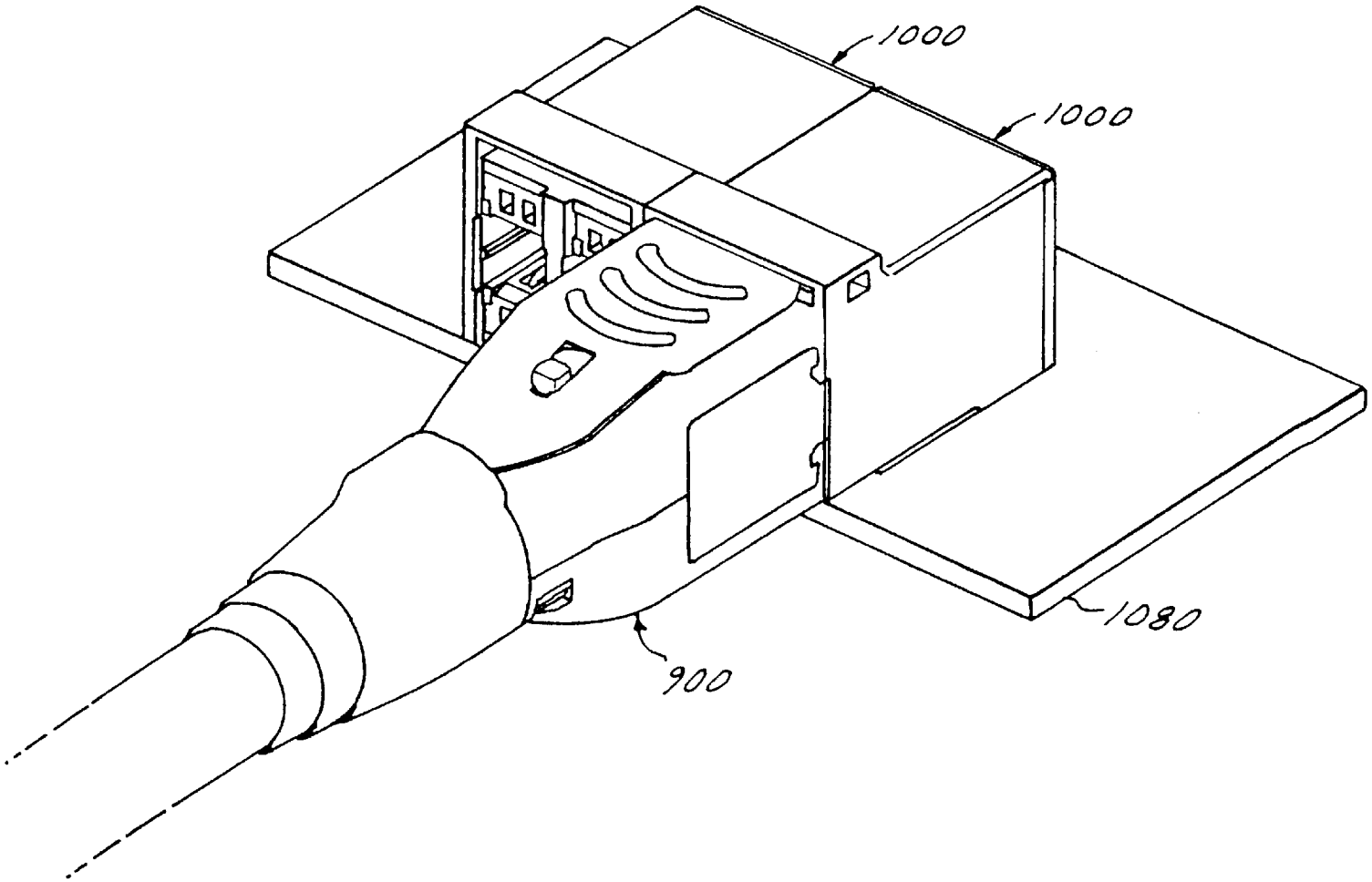
FIG. 57 is a perspective view of plug 900 of FIG. 44 mated with outlet 1000 of FIG. 56.
Figure 58B:
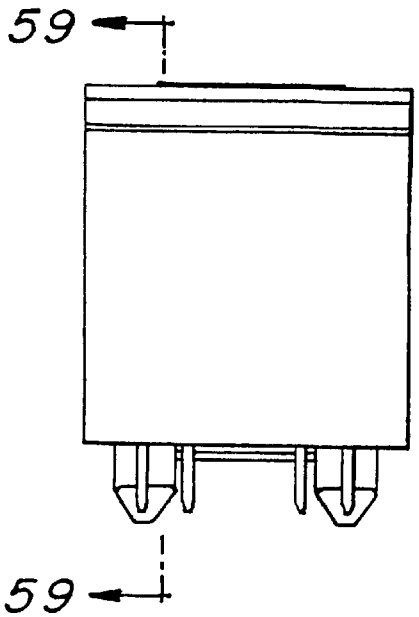
FIG. 58B is a rear view of plug 900 of FIG. 44 mated with outlet 1000 of FIG. 56.
Figure 58A:
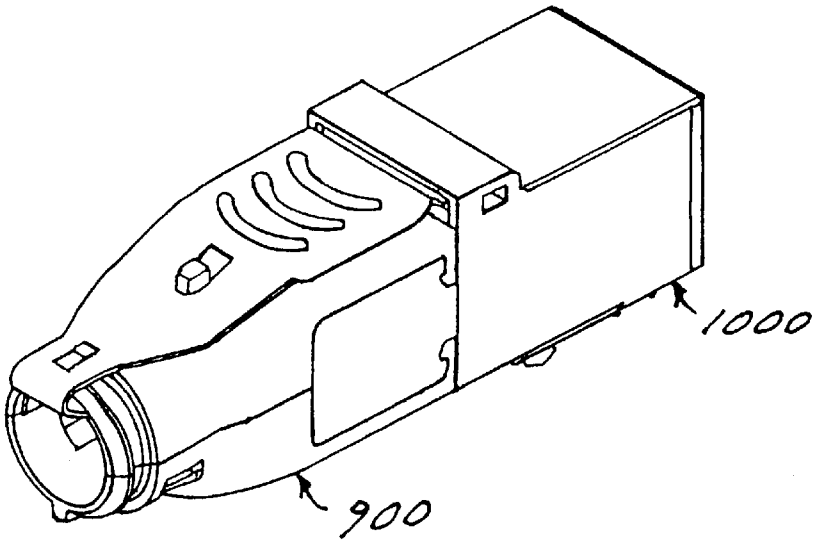
FIG. 58A is another perspective view of plug 900 of FIG. 44 mated with outlet 1000 of FIG. 56.

FIG. 55 is a perspective view of a pair of outlets 1000 of FIG. 49 and a simplified printed circuit board 1080 having a series of openings 1082 to receive the contacts 1014 of outlet 1000 and a series of second openings 1084 to receive posts 1044 of outlet 1000. To mount outlet 1000 on printed circuit board 1080, contacts 1014 and posts 1044 are aligned with first openings 1082 and second openings 1084, respectively and then each is inserted into the respective opening. Insulating film 1046 (shown in FIG. 49) on the bottom 1004 of outlet 1000 rests between the outlet 1000 and the printed circuit board 1080 to prevent an electrical short. FIG. 56 is a perspective view of a pair of outlets 1000 mounted onto a simplified circuit board 1080. FIG. 57 is a perspective view of plug 900 of FIG. 44 mated with outlet 1000 of FIG. 49. As shown in FIG. 59, latch extension 922 of plug 900 is inserted into opening 1032 of outlet core 1000. The underside of hood 1028 of outlet 1000 includes a lip portion for engaging latch extension 922. As latch extension 922 is inserted into opening 1032, the beveled surface of the lip permits the latch extension to slidably engage with the outlet core 1000 by locking the latch extension 922 with the shoulder portion of the lip (as shown in FIG. 59).

FIGS. 58–61 illustrate the overlapping of components between plug 900 when it is mated with outlet 1000. FIG. 58A is another perspective view of plug 900 mated with outlet 1000. FIG. 58B is a rear view of plug 900 mated with outlet 1000. FIG. 59 is a cross-sectional view taken along line 59–59 of FIG. 58B and shows the overlap between the structural components of plug 900 and outlet 1000. Also, shown is the engagement of latch extension 922 with the lip portion of opening 1032 of outlet core 1000. An important aspect of the present invention is that this engagement between the latch extension and the outlet core provides a more direct electrical path from the ground layer of the cable 514 to the outlet core 1000.

Outer shield 1054 and inner shield 1056 effectively shield the top and bottom contacts 1068 and 1070. Horizontal shield 1071 and planar shield 932 of plug 900 overlap and the horizontal shield 1071 and the inner shield 1056 overlap to shield the top contacts 1068 from the bottom contacts 1070. Top 1008 of the outlet 1000 and the outer shield 1054 overlap also to effectively shield the contacts.

Figure 61A:
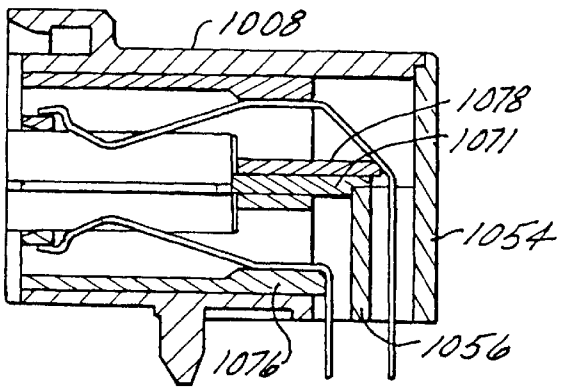
FIG. 61A is a cross-sectional view taken along line 61A—61A of FIG. 60.
Figure 61B:
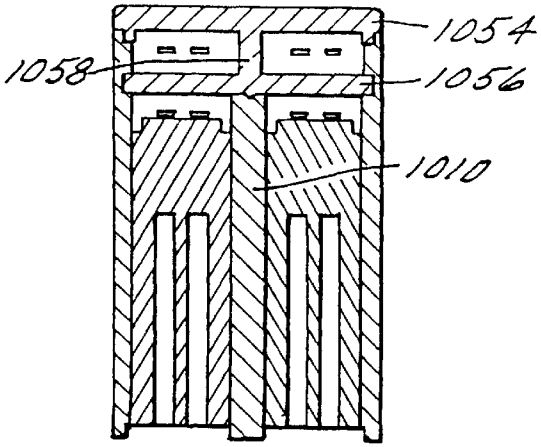
FIG. 61B is a cross-sectional view taken along line 61B—61B of FIG. 60.
Figure 60:
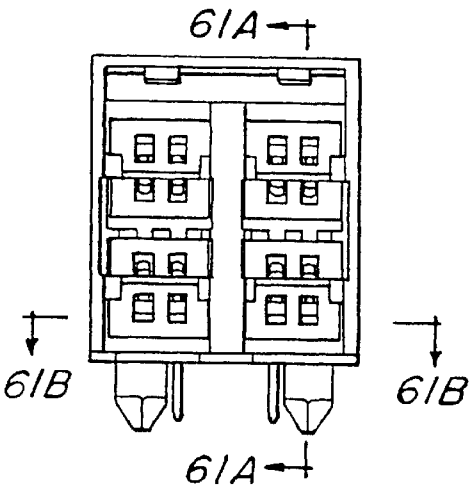
FIG. 60 is a front view of outlet 1000 of FIG. 51.

FIG. 60 is a front view of outlet 1000. FIG. 61B is a cross-section taken along line 61B—61B of FIG. 60 and shows the overlap between outer shield 1054, inner shield 1056 and center shield 1058 of the rear cover 1005 and the side walls 1002 and vertical shield member 1010. This overlap provides for the enhanced shielding protection of each contact pair in the respective shielded quadrant. FIG. 61B is a cross-section taken along line 61A—61A of FIG. 60 showing the shielding overlap in accordance with the present invention.

While preferred embodiments have been shown and described, various modifications and substitutions may be made thereto without departing from the spirit and scope of the invention. Accordingly, it is to be understood that the present invention has been described by way of illustration and not limitation.

What is claimed is:

1. A telecommunications connector for mounting on a printed circuit board, the connector comprising:

a conductive housing hag a top, bottom, side walls joining said top and bottom, and a rear having an outer shield, an inner shield and a center shield joining said outer shield and said inner shield, said top, bottom, side walls and rear being in electrical contact, a vertical shield extending between said top and bottom;

a horizontal shield positioned between said top and bottom and between said sidewalls, said horizontal shield and said vertical shield defining four quadrants, each of said four quadrants containing contacts corresponding to a tip and ring pair;

wherein a first edge of said horizontal shield contacts said inner shield; and a plurality of said contacts extend beyond the bottom of said conductive housing, a first set of said contacts being positioned between said outer shield and said inner shield, a second set of said contacts being positioned between said inner shield an said bottom.

2. The telecommunications connector of claim 1 wherein said side walls are integral with said top.

3. The telecommunications connector of claim 1 wherein said top is integral with said vertical shield.

4. The telecommunications connector of claim 1 wherein said horizontal shield is integral with said vertical shield.

5. The telecommunications connector of claim 1 wherein said horizontal shield is integral with said side walls.

6. The telecommunications connector of claim 1 wherein said outer shield is integral said center shield.

7. The telecommunications connector of claim 1 wherein said inner shield is integral with said center shield.

8. The telecommunications connector of claim 1 wherein said top joins said rear at an overlap joint.

9. The telecommunications connector of clam 1 wherein said side walls join said rear at overlap joints.

10. The telecommunications connector of claim 1 wherein said vertical shield joins said rear at an overlap joint.

11. The telecommunications connector of claim 1 wherein said horizontal shield joins said rear at an overlap joint.

* * * * *

UNITED STATES PATENT AND TRADEMARK OFFICE

CERTIFICATE OF CORRECTION

PATENT NO. : 6,224,423 B1
DATED : May 1, 2001
INVENTOR(S) : Yip et al.

It is certified that error appears in the above-identified patent and that said Letters Patent is hereby corrected as shown below:

Title page,
Add the following references to the References Cited section:

| | | |
|---|---|---|
| 5,876,248 | 3/1999 | Brunker et al. |
| 5,890,917 | 4/1999 | Ishida et al. |
| 5,660,551 | 8/1997 | Sakurai et al. |
| 6,045,389 | 4/2000 | Ferrill et al. |
| 6,077,122 | 6/2000 | Elkhatib et al. |
| 250597 | 1995 | Taiwan |

Signed and Sealed this

Twentieth Day of November, 2001

*Attest:*

Nicholas P. Godici

*Attesting Officer*

NICHOLAS P. GODICI
*Acting Director of the United States Patent and Trademark Office*

UNITED STATES PATENT AND TRADEMARK OFFICE

CERTIFICATE OF CORRECTION

PATENT NO. : 6,224,423 B1
DATED : May 1, 2001
INVENTOR(S) : Yip et al.

It is certified that error appears in the above-identified patent and that said Letters Patent is hereby corrected as shown below:

Title page,
Add the following references to the References Cited section:

| | | |
|---|---|---|
| 5,876,248 | 3/1999 | Brunker et al. |
| 5,890,917 | 4/1999 | Ishida et al. |
| 5,660,551 | 8/1997 | Sakurai et al. |
| 6,045,389 | 4/2000 | Ferrill et al. |
| 6,077,122 | 6/2000 | Elkhatib et al. |
| 250597 | 1995 | Taiwan |

Signed and Sealed this

Twenty-seventh Day of November, 2001

*Attest:*

Nicholas P. Godici

NICHOLAS P. GODICI
*Acting Director of the United States Patent and Trademark Office*

*Attesting Officer*